US010000062B2

(12) United States Patent
Fujioka

(10) Patent No.: US 10,000,062 B2
(45) Date of Patent: Jun. 19, 2018

(54) LIQUID EJECTING APPARATUS

(71) Applicant: SEIKO EPSON CORPORATION, Tokyo (JP)

(72) Inventor: Kazuyuki Fujioka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/452,523

(22) Filed: Mar. 7, 2017

(65) Prior Publication Data

US 2017/0259574 A1 Sep. 14, 2017

(30) Foreign Application Priority Data

Mar. 8, 2016 (JP) ..... 2016-044123

(51) Int. Cl.
*B41J 2/165* (2006.01)

(52) U.S. Cl.
CPC ..... *B41J 2/16535* (2013.01)

(58) Field of Classification Search
None
See application file for complete search history.

(56) References Cited

U.S. PATENT DOCUMENTS

| | | | |
|---|---|---|---|
| 2003/0218652 | A1 | 11/2003 | Nakashima |
| 2004/0223029 | A1 | 11/2004 | Nishino |
| 2010/0079539 | A1 | 4/2010 | Inoue |
| 2013/0265364 | A1 | 10/2013 | Kawakami et al. |

FOREIGN PATENT DOCUMENTS

| | | |
|---|---|---|
| JP | 2004-042628 | 2/2004 |
| JP | 2004-322461 | 11/2004 |
| JP | 2010-036459 | 2/2010 |
| JP | 2010-082856 | 4/2010 |
| JP | 2011-126062 | 6/2011 |
| JP | 2013-215910 | 10/2013 |
| JP | 2014-076595 | 5/2014 |

*Primary Examiner* — Alejandro Valencia
(74) *Attorney, Agent, or Firm* — Workman Nydegger

(57) ABSTRACT

A liquid ejecting apparatus includes a liquid ejecting unit having nozzles able to eject a liquid to a medium, a wiping unit able to wipe the liquid ejecting unit, a waste liquid receiving unit which receives a waste liquid which is discharged by a maintenance operation for maintaining the liquid ejecting unit, at a position facing the liquid ejecting unit, and a collection unit which comes in contact with the waste liquid receiving unit to collect the waste liquid which is received by the waste receiving unit, in which the wiping unit comes in contact with the collection unit to wipe the waste liquid which is collected by the collection unit.

8 Claims, 30 Drawing Sheets

LIQUID EJECTING APPARATUS

BACKGROUND

1. Technical Field

The present invention relates to a liquid ejecting apparatus, such as an ink jet printer.

2. Related Art

As an example of a liquid ejecting apparatus which ejects liquid onto a medium, an ink jet printer that performs printing while ejecting ink (liquid) from nozzles of a liquid ejecting unit onto a sheet (medium) is widely known (for example, see JP-A-2010-82856). In such a printer, water in the ink in the nozzles is evaporated from a nozzle opening, thereby the viscosity of the ink in the nozzles is increased. Therefore, clogging in the nozzle easily occurs.

Accordingly, the clogging of the nozzle is suppressed by flushing (dummy jet) for ejecting the ink in the nozzle into a nozzle cap independently (in a dummy) of printing, in a state where an ink jet line head (liquid ejecting unit) is moved to a maintenance position at an appropriate timing during printing.

In the above-described printer, when flushing is repeatedly performed, the ink (waste liquid) ejected into the nozzle cap is dried and an accumulated material of a component (for example, pigment, synthetic resin, or the like) included in the ink is generated. When the accumulated material is stored in the nozzle cap, in a case where the ink jet line head is moved to the maintenance position, there is a problem in that the ink jet line head is contaminated by contacting with the accumulated material.

Such a problem is not limited to ink jet printers that perform printing while ejecting ink, and is generally common in a liquid ejecting apparatus having nozzles for ejecting a liquid.

SUMMARY

An advantage of some aspects of the invention is to provide a liquid ejecting apparatus that is capable of suppressing contamination due to waste liquid.

Hereinafter, means of the invention and operation effects thereof will be described.

According to an aspect of the invention, there is a provided a liquid ejecting apparatus including a liquid ejecting unit having nozzles able to eject a liquid to a medium, a wiping unit able to wipe the liquid ejecting unit, a waste liquid receiving unit which receives a waste liquid which is discharged by a maintenance operation for maintaining the liquid ejecting unit, at a position facing the liquid ejecting unit, and a collection unit which comes in contact with the waste liquid receiving unit to collect the waste liquid which is received by the waste liquid receiving unit, in which the wiping unit comes in contact with the collection unit to wipe the waste liquid which is collected by the collection unit.

According to the configuration, the waste liquid (an accumulated material generated by dryness of the waste liquid) which is received by the waste liquid receiving unit is collected by the collection unit and the waste liquid collected by the collection unit is wiped by the wiping unit and is collected. Accordingly, contaminant due to the waste liquid can be suppressed.

In the liquid ejecting apparatus, it is preferable that the wiping unit comes in contact with the collection unit after wiping the liquid ejecting unit.

According to the configuration, the waste liquid collected by the collection unit can be suppressed from being attached to the liquid ejecting unit.

In the liquid ejecting apparatus, it is preferable that the waste liquid receiving unit be disposed further to the downstream side than the wiping unit in a wiping direction when the wiping unit wipes the liquid ejecting unit.

According to the configuration, since the liquid easily scatters toward the downstream side of the wiping direction when the liquid ejecting unit is wiped by the wiping unit, the scattered liquid can be easily collected by the waste liquid receiving unit.

It is preferable that the liquid ejecting apparatus further include a relative moving mechanism which relatively moves the wiping unit and the waste liquid receiving unit, and the liquid ejecting unit and the collection unit in the wiping direction where the wiping unit wipes the liquid ejecting unit.

According to the configuration, the wiping unit and the waste liquid receiving unit, and the liquid ejecting unit and the collection unit can be relatively moved by the relative moving mechanism in the wiping direction.

It is preferable that the liquid ejecting apparatus further include a base portion which holds the wiping unit and the waste liquid receiving unit, in which the relative moving mechanism moves the base portion to the liquid ejecting unit and the collection unit.

According to the configuration, the base portion, the wiping unit, and the waste liquid receiving unit can be moved together to the liquid ejecting unit and the collection unit by the relative moving mechanism.

It is preferable that the liquid ejecting apparatus further include a carriage which holds the liquid ejecting unit and the collection unit, in which the relative moving mechanism move the carriage to the wiping unit and the waste liquid receiving unit.

According to the configuration, the carriage, the liquid ejecting unit, and the collection unit can be moved together to the wiping unit and the waste liquid receiving unit by the relative moving mechanism.

It is preferable that the liquid ejecting apparatus further include a moving mechanism which moves the liquid ejecting unit in a direction orthogonal to both directions of the movement direction where the relative moving mechanism moves the base portion and a direction where the liquid ejecting unit ejects the liquid, in which the moving mechanism move the liquid ejecting unit to a position capable of facing the waste liquid receiving unit and the wiping unit, in which the liquid is ejected to the waste liquid receiving unit from the nozzle in a state where the liquid ejecting unit faces the waste liquid receiving unit, in which the relative moving mechanism relatively moves the wiping unit to the liquid ejecting unit to wipe the liquid ejecting unit, in which the liquid ejecting unit is retreated by the moving mechanism from a position facing a region where the base portion moves, and in which the wiping unit comes in contact with the collection unit by the relative moving mechanism.

According to the configuration, since the liquid ejecting unit is retreated from the position facing the region where the base portion moves before the waste liquid collected by the collection unit is wiped by the wiping unit, in a case where the waste liquid is scattered when the collection unit is wiped by the wiping unit, the scattered liquid can be suppressed from being attached to the liquid ejecting unit.

In the liquid ejecting apparatus, it is preferable that the collection unit be deformable in a direction where the liquid ejecting unit ejects the liquid.

According to the configuration, the amount of contact between the waste liquid receiving unit and the collection unit and the amount of contact between the wiping unit and the collection unit can be adjusted by displacing the recovering unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Below, an ink jet printer that prints text, images or the like while ejecting ink that is a liquid will be described as an example of the liquid ejecting apparatus with reference to the drawings.

Figure 1:
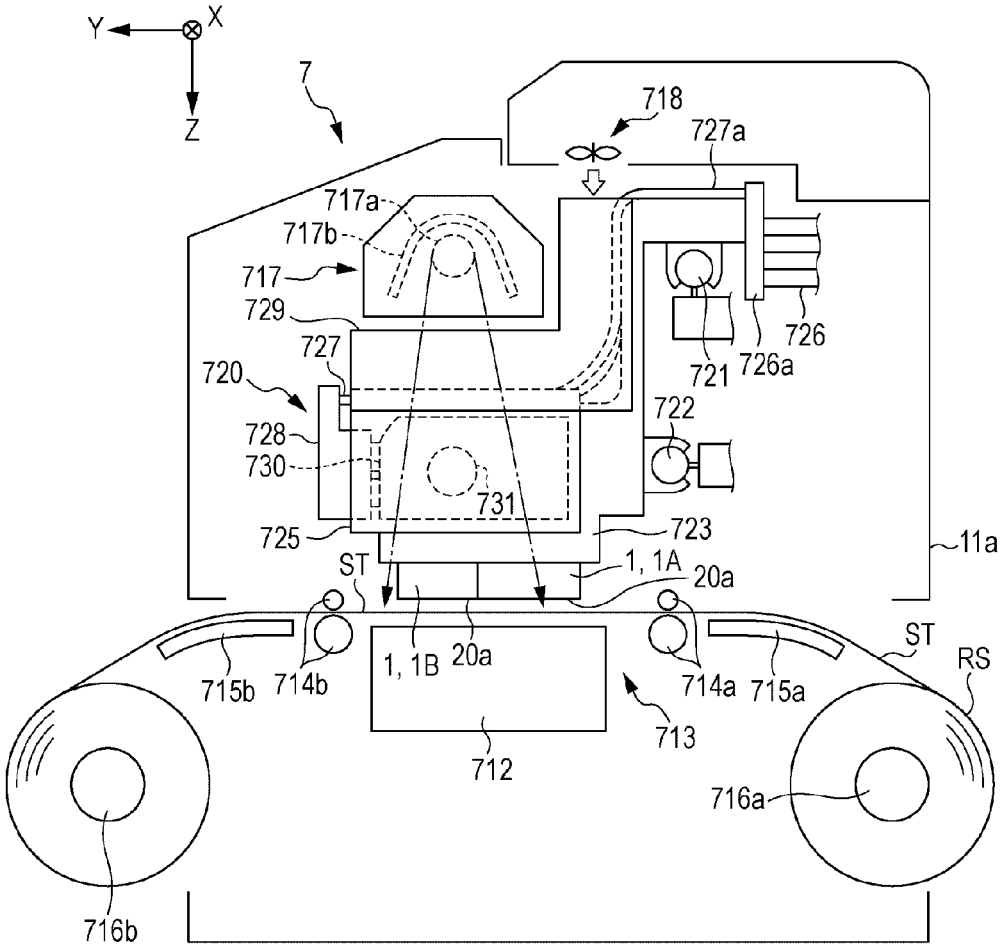
FIG. 1 is a schematic view showing an embodiment of a liquid ejecting apparatus of a first embodiment.

As shown in FIG. 1, the liquid ejecting apparatus 7 is provided with a transport unit 713 with which the sheet-like medium ST supported on the support stand 712 is transported in the transport direction Y along the surface of the support stand 712, a printing unit 720 that performed printing while ejecting ink as an example of the first liquid to the transported medium ST, and a heating unit 717 and a blower 718 for causing the ink landed on the medium ST to dry.

The support stand 712, the transport unit 713, the heating unit 717, the blower 718, and the printing unit 720 are assembled in a printer main body 11*a* configured by a housing, a frame and the like. In the printer main body 11*a*, the support stand 712 extends in the width direction (in FIG. 1, direction orthogonal to the paper surface) of the medium ST.

Figure 13:
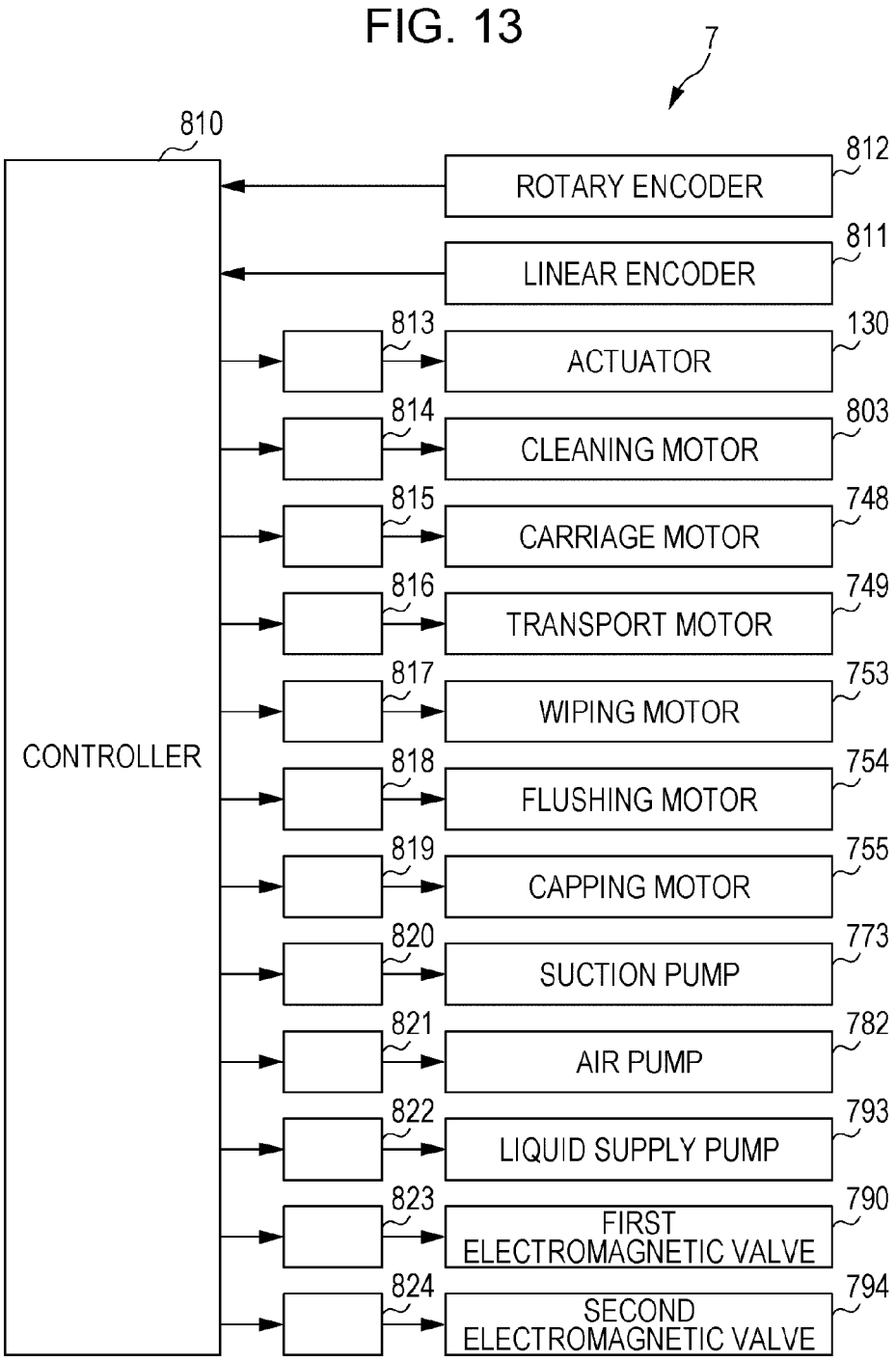
FIG. 13 is a block diagram showing an electrical configuration of the liquid ejecting apparatus.

The transport unit 713 is provided with a transport roller pair 714*a* and a transport roller pair 714*b* arranged on the upstream side and the downstream side of the support stand 712 in the transport direction Y, respectively, and driven by a transport motor 749 (refer to FIG. 13). The transport unit 713 is further provided with a guide plate 715*a* and a guide plate 715*b* that guide while supporting the medium ST respectively arranged on the upstream side of the transport roller pair 714*a* and the downstream side of the transport roller pair 714*b* in the transport direction Y.

The transport unit 713 transports the medium ST along the surface of the guide plate 715*a*, the support stand 712, and the guide plate 715*b* by the transport roller pairs 714*a* and 714*b* rotating while interposing the medium ST. In the embodiment, the medium ST is continuously transported by being delivered from a roll sheet RS rolled in a roll shape on a supply reel 716*a*. The medium ST continuously transported while being delivered from the roll sheet RS is wound up in a roll shape by the winding reel 716*b* after an image is printed with ink being attached by the printing unit 720.

The printing unit 720 is guided on guide shafts 721 and 722 extended along the scanning direction X that is the width direction of the medium ST orthogonal to the transport direction Y of the medium ST, and is provided with a carriage 723 able to reciprocate in the scanning direction X by the power of the carriage motor 748 that configures a moving mechanism (refer to FIG. 13). In the embodiment, the scanning direction X is a direction that intersects (as an example, is orthogonal to) both the transport direction Y and the power direction Z.

Two liquid ejecting units 1 (1A, 1B) that eject ink, a liquid supply path 727 that supplies ink to the liquid ejecting units 1 (1A, 1B), a storage portion 730 that temporarily stores the ink supplied through the liquid supply path 727, and a flow channel adapter 728 connected to the storage portion 730 are provided on the carriage 723. The storage portion 730 is held to the storage portion holder 725 attached to the carriage 723.

In the embodiment, the ejection direction of the ink droplets (liquid droplets) from the liquid ejecting units 1 is the power direction Z. The carriage motor 748 (refer to FIG. 13) moves the carriage 723 and two liquid ejecting units 1 (1A and 1B) by driving the carriage motor in a direction X orthogonal (as an example, orthogonal) to both a transport direction Y and a power direction Z.

The storage portion 730 is provided with a differential pressure valve 731 provided at a position along the liquid supply path 727 for supplying ink to the liquid ejecting units 1. The differential pressure valve 731 is opened when the pressure of the ink on the downstream side reaches a predetermined reduced pressure with respect to atmospheric pressure according to the ejection (consuming) of ink by the liquid ejecting units 1A and 1B positioned on the downstream side thereof, and is closed the ink is supplied to the liquid ejecting units 1A and 1B from the storage portion 730 by the valve to release the reduced pressure on the downstream side. The differential pressure valve 731 functions as a unidirectional valve (check valve) that allows the supply of ink from the upstream side (storage portion 730 side) to the downstream side (liquid ejecting unit 1 side) and, on the other hand, suppresses backward flow of ink from the downstream side to the upstream side without opening even if the pressure of the ink on the downstream side becomes high.

The liquid ejecting unit 1 is attached to the lower end portion of the carriage 723 in a posture facing the support stands 712 spaced with a predetermined gap in the power direction Z. On the other hand, the storage portion 730 is attached to the upper side that is the side opposite the liquid ejecting unit 1 in the power direction Z from the carriage 723.

The end portion on the upstream side of the supply tube 727*a* that configures a portion of the liquid supply path 727 is connected to the end portion on the downstream side of a plurality of ink supply tubes 726 that are able to track deformation in the reciprocating carriage 723 passing through a connector 726*a* attached to a portion of the carriage 723. The end portion on the downstream side of the supply tube 727*a* is connected to the flow channel adapter 728 at a position further to the upstream side than the storage portion 730. Accordingly, the ink from the ink tank, not shown, in which the ink is accommodated is supplied to the storage portion 730 passing through the ink supply tube 726, the supply tube 727*a*, and the flow channel adapter 728.

In the printing unit 720, ink is ejected from the openings of the plurality of nozzles 21 (refer to FIG. 3) of the liquid ejecting unit 1 to the medium ST on the support stand 712 in a process where the carriage 723 moves (reciprocates) in the scanning direction X. The heating unit 717 for causing the ink landed on the medium ST to be heated and dried is arranged at an upper position spaced from the support stand 712 in the liquid ejecting apparatus 7 by a gap with a predetermined length in the power direction Z. The printing unit 720 is able to reciprocate along the scanning direction X between the heating unit 717 and the support stand 712.

The heating unit 717 is provided with a heating member 717*a* such as an infrared heater arranged extending along the scanning direction X that is the same as the extension direction of the support stand 712 and a reflection plate 717*b*, and heats the ink attached to the medium ST through heat (for example, radiation heating) such as infrared rays radiated to the area indicated by the dashed-line arrow in FIG. 1. The blower 718 by which ink attached to the medium ST is dried with an air flow is arranged at an upper position with a gap in which the printing unit 720 in the liquid ejecting apparatus 7 is able to reciprocate between the blower 718 and the support stand 712.

A heat blocking member 729 that blocks heat transfer from the heating unit 717 is provided at a position between the storage portion 730 and the heating unit 717 on the carriage 723. The heat blocking member 729 is formed with a metal material with good thermal conductivity, such as stainless steel or aluminum, and covers at least the upper surface portion facing the heating unit 717 of the storage portion 730.

In the liquid ejecting apparatus 7, a storage portion 730 is arranged for at least each type of ink. The liquid ejecting apparatus 7 of the embodiment is provided with a storage portion 730 in which colored ink is stored, and is capable of color printing and black and white printing. The ink colors of the colored inks are, as an example, cyan, magenta, yellow, black, and white. A preservative is included in each colored ink.

The white ink (solid printing, or fill printing) is used for base printing and the like before performing color printing in cases where the medium ST is a transparent or semi-transparent medium or is a dark colored medium. Naturally, the colored ink used may be arbitrarily selected, and may be any of the three colors of cyan, magenta, and yellow. It is also possible to further add at least one colored ink from light cyan, light magenta, light yellow, orange, green, grey and the like in addition to the above three colors.

Figure 2:
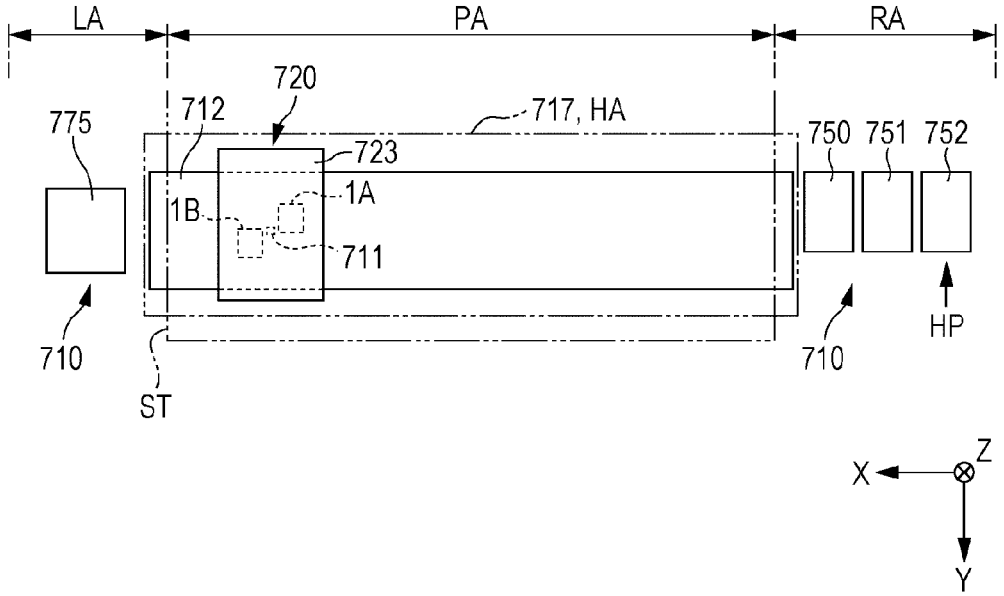
FIG. 2 is a plan view schematically showing a disposing of configuration elements of the liquid ejecting apparatus.

As shown in FIG. 2, two liquid ejecting units 1A and 1B attached to the lower end portion of the carriage 723 are arranged so as to be separated by a predetermined gap in the scanning direction X and shifted by a predetermined distance in the transport direction Y. A temperature sensor 711 is provided at a position between the two liquid ejecting units 1A and 1B in the scanning direction X on the lower end portion of the carriage 723.

The movement region in which the liquid ejecting units 1A and 1B are able to move in the scanning direction X includes the printing region PA on which ink from the nozzles 21 of the liquid ejecting units 1A and 1B can be landed during printing of the medium ST and non-printing regions RA and LA that are regions outside the printing region PA at which the liquid ejecting units 1A and 1B able to move in the scanning direction X do not oppose the medium ST during transport. The region facing the printing region PA in the scanning direction X is the heating region HA on which the heating unit 717 by which ink landed on the medium ST is fixed through heating is provided.

The region with the maximum width in the scanning direction X in which ink droplets ejected from the liquid ejecting units 1A and 1B are landed with respect to the maximum width of the medium ST transported on the support stand 712 is the printing region PA. That is, ink droplets ejected from the liquid ejecting units 1A and 1B to the medium ST land within the printing region PA. In a case where the printing unit 720 has an edgeless printing function, the printing region PA is slightly wider in the scanning direction X than the range of the medium ST of the maximum width transported.

The non-printing regions RA and LA are present on both sides (left and right sides, respectively, in FIG. 2) of the printing region PA in the scanning direction X. The fluid ejecting device 775 for performing maintenance of the liquid ejecting unit 1 is provided in the non-printing region LA position on the left side of the printing region PA in FIG. 2. Meanwhile, a wiper unit 750, a flushing unit 751, and a cap unit 752 are provided in the non-printing region RA positioned on the right side of the printing region PA in FIG. 2.

The fluid ejecting device 775, the wiper unit 750, the flushing unit 751, and the cap unit 752 configure a maintenance device 710 for performing maintenance on the liquid ejecting unit 1. The position at which the cap unit 752 is present in the scanning direction X is the home position HP of the liquid ejecting units 1A and 1B.

Configuration of Head Unit

Next, the configuration of the head unit 2 will be described in detail.

The liquid ejecting unit 1 includes a plurality (in the embodiment, 4) of head units 2 provided for each color of ink (for each type of the liquid).

Figure 3:
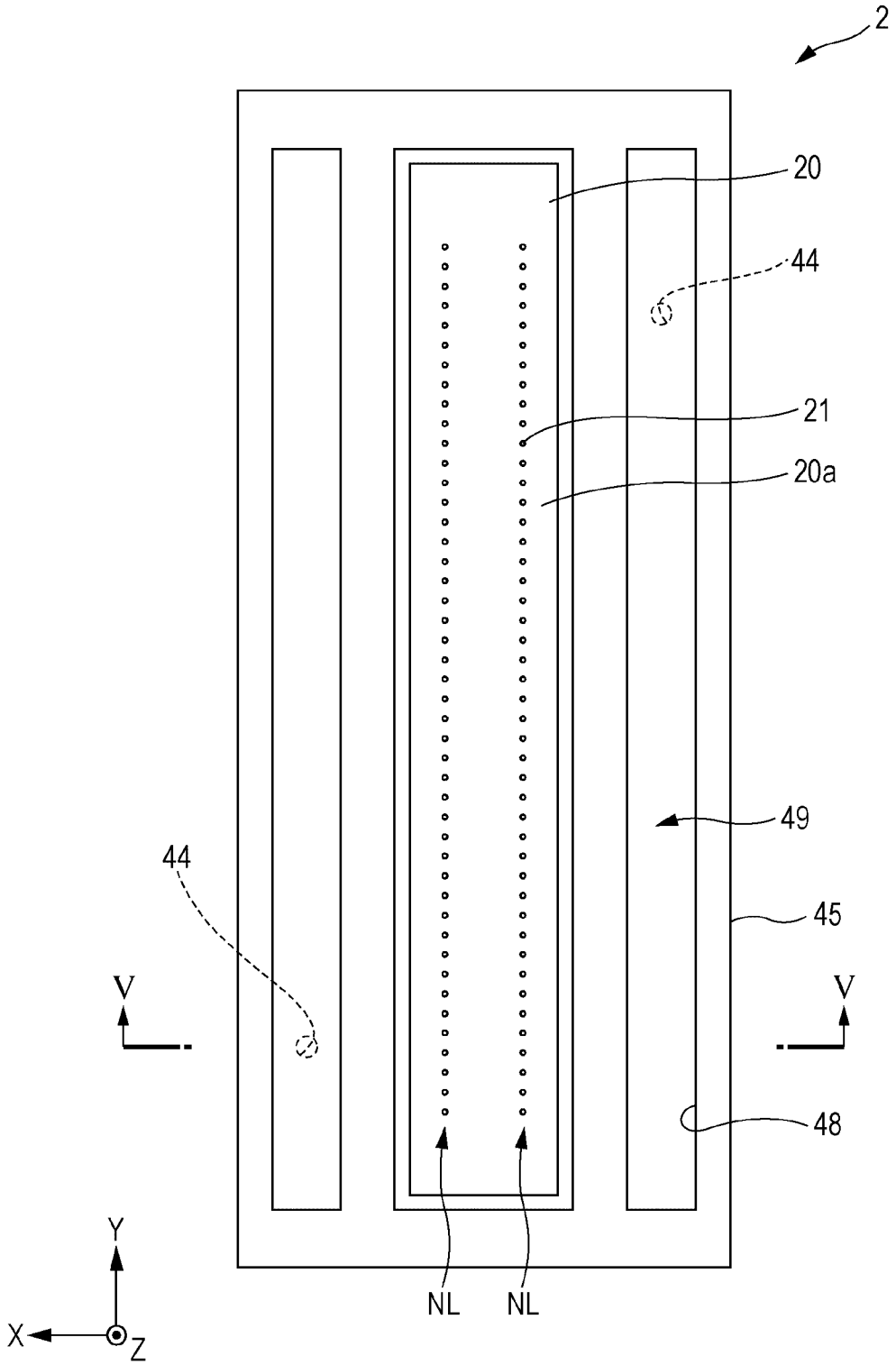
FIG. 3 is a bottom view of a head unit.

As shown in FIG. 3, a nozzle row NL is configured by lining up multiple (for example, 180) nozzle 21 openings for ejecting ink in one direction (in the embodiment, transport direction Y) at a fixed nozzle pitch in the one head unit 2.

In the embodiment, by providing two nozzle rows NL lined up in the scanning direction X in one head unit 2, a total of 8 nozzle rows NL in which two rows at the time positioned approaching one another are arranged with a fixed gap in the scanning direction X are formed in one liquid ejecting unit 1. The two liquid ejecting units 1 have a positional relationship in the transport direction Y in which the same nozzle pitch is obtained with each other between the nozzles 21 at the end portions when the multiple nozzles 21 that configure each of the nozzle rows NL are projected in the scanning direction X.

Figure 4:
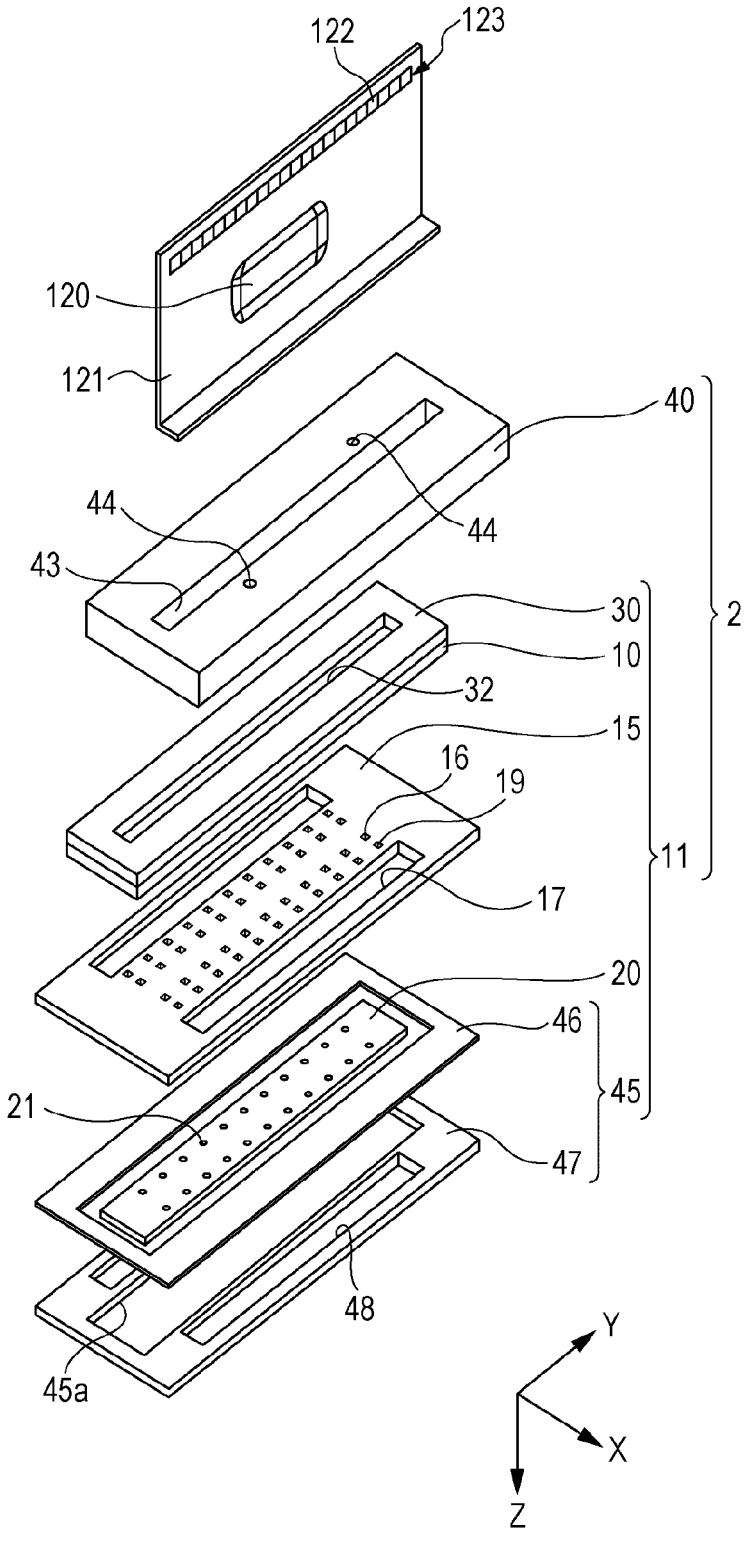
FIG. 4 is an exploded perspective view of the head unit.

As shown in FIG. 4, the head unit 2 is provided with a plurality of members, such as a head main body 11, and a flow channel-forming member 40 fixed to one surface (upper surface) side of the head main body 11. The head main body 11 is equipped with a flow channel-forming substrate 10, a communication plate 15 provided on one surface (lower surface) side of the flow channel-forming substrate 10, a nozzle plate 20 provided on the opposite surface (lower surface) side to the flow channel-forming substrate 10 of the communication plate 15, a protective substrate 30 provided on the opposite side (upper side) to the communication plate 15 of the flow channel-forming substrate 10, and a compliance substrate 45 provided on the surface side on which the nozzle plate 20 of the communication plate 15 is provided.

It is possible for the flow channel-forming substrate 10 to use a metal such as stainless steel or Ni, a ceramic material represented by $ZrO_2$ or $Al_2O_3$, a glass ceramic material, or an oxide such as MgO or $LaAlO_3$. In the embodiment, the flow channel-forming substrate 10 is formed from a singly crystal silicon substrate.

Figure 5:
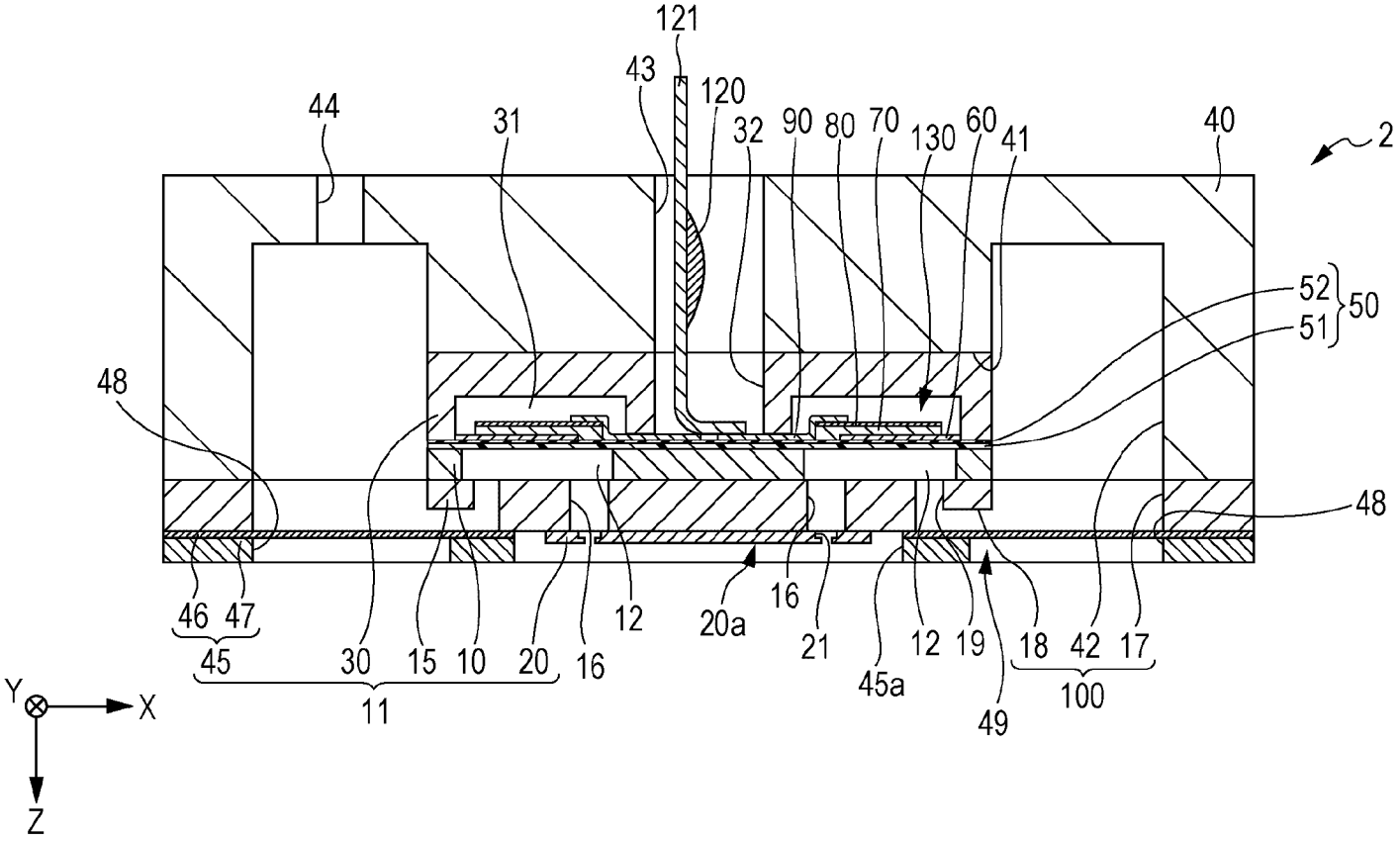
FIG. 5 is a cross-sectional view taken along line V-V in FIG. 3.

As shown in the FIG. 5, by subjecting the flow channel-forming substrate 10 to anisotropic etching from one surface side, the pressure generating chambers 12 partitioned by a plurality of partition walls are provided in parallel along the direction in which the plurality of openings of the nozzle 21 that discharge the ink are provided in parallel. A plurality of rows (in the embodiment, 2) in which the pressure generating chambers 12 are arranged in parallel in the transport direction Y are provided on the flow channel-forming substrate 10 so as to be lined up in the scanning direction X.

On the flow channel-forming substrate 10, a supply path or the like that has a narrower opening area than the pressure generating chamber 12 and contributes flow channel resistance of the ink flowing into the pressure generating chamber 12 may be provided on one end side of the pressure generating chamber 12 in the transport direction Y.

As shown in FIGS. 4 and 5, the communication plate 15 and the nozzle plate 20 are layered in the power direction Z on one surface (lower surface) side of the flow channel-forming substrate 10. That is, the liquid ejecting unit 1 is equipped with a communication plate 15 provided on one surface of the flow channel-forming substrate 10, and a nozzle plate 20 in which nozzles 21 provided in the opposite surface side to the flow channel-forming substrate 10 of the communication plate 15 are provided are formed.

A nozzle communication path 16 that communicates with the pressure generating chamber 12 and the opening of the nozzle 21 is provided on the communication plate 15. The communication plate 15 has a larger area than the flow channel-forming substrate 10, and the nozzle plate 20 has a smaller area than the flow channel-forming substrate 10. Because the nozzles 21 of the nozzle plate 20 and the pressure generating chamber 12 are separated by provided the communication plate 15 in this way, ink present in the pressure generating chamber 12 does not easily thicken due to evaporation of the water content in the ink from the nozzle 21. Since the nozzle plate 20 may only cover the opening of the nozzle communication path 16 that communicates the pressure generating chamber 12 with the nozzle 21, it is possible for the area of the nozzle plate 20 to be made comparatively small and possible to achieve cost reductions.

As shown in FIG. 5, a first manifold portion 17 that configures a portion of the common liquid chamber (manifold) 100 and a second manifold portion 18 (restricted flow channel, orifice flow channel) are provided in the communication plate 15. The first manifold portion 17 is provided passing through the communication plate 15 in the thickness direction (power direction Z that is the layering direction of the communication plate 15 and the flow channel-forming substrate 10). The second manifold portion 18 is provided opening to the nozzle plate 20 side of the communication plate 15 without penetrating the communication plate 15 in the thickness direction.

A supply communication path 19 that communicates with one end portion of the pressure generating chamber 12 in the transport direction Y is independently provided for each pressure generating chamber 12 on the communication plate 15. The supply communication path 19 communicates between the second manifold portion 18 and the pressure generating chamber 12.

It is possible for a metal such as stainless steel or nickel (Ni) or a ceramic such as zirconia ($ZrO_2$) to be used as such a communication plate 15. It is preferable that the communication plate 15 is a material with the same coefficient of linear expansion as the flow channel-forming substrate 10. That is, in a case of using a material with a coefficient of linear expansion that differs greatly from the flow channel-forming substrate 10 as the communication plate 15, warping arises in the flow channel-forming substrate 10 and the communication plate 15 by being heated or cooled. In the embodiment, by using the same material as the flow channel-forming substrate 10, that is, a singly crystal silicon substrate, as the communication plate 15, it is possible to suppress the occurrence of cracks, peeling and the like caused by warping or heating due to heating.

The surface (lower surface) that discharges ink droplets from both surfaces of the nozzle plate 20, that is the surface on the opposite side to the pressure generating chamber 12 is referred to as the liquid ejecting surface 20*a*, and the opening of the nozzle 21 opened in the liquid ejecting surface 20*a* is referred to as the nozzle opening.

It is possible to use a metal such as stainless steel (SUS), an organic matter such as a polyimide resin, or a singly crystal silicon substrate as the nozzle plate 20. By using a single crystal silicon substrate as the nozzle plate 20, it is possible for the coefficient of linear expansion of the nozzle plate 20 and the communication plate 15 to be made the same, and to suppress the occurrence of cracks, peeling and the like caused by warping or heating due to being heated or cooled.

Meanwhile, a diaphragm 50 is formed on the opposite surface side to the communication plate 15 of the flow channel-forming substrate 10. In the embodiment, an elastic film 51 composed of silicon oxide provided on the flow channel-forming substrate 10 side and an insulating film 52 composed of zirconium oxide provided on the elastic film 51 are provided as the diaphragm 50. The liquid flow channel of the pressure generating chamber 12 or the like, is formed by anisotropic etching of the flow channel-forming substrate 10 from one surface side (surface side to which the nozzle plate 20 is bonded), and the other surface of the liquid flow channel of the pressure generating chamber 12 or the like is defined by the elastic film 51.

An actuator (piezoelectric actuator) 130 that is a pressure generating unit of the embodiment, and includes a first electrode 60, a piezoelectric layer 70, and a second electrode 80 is provided on the diaphragm 50 of the flow channel-forming substrate 10. The actuator 130 refers to a portion including the first electrode 60, the piezoelectric layer 70, and the second electrode 80.

Generally, either of the electrodes in the actuator 130 forms a common electrode, and the other electrode is configured by being patterned for each pressure generating chamber 12. In the embodiment, the first electrode 60 is made the common electrode by being continuously provided along the plurality of actuators 130, and the second electrode 80 made an individual electrode by being individually provided for each actuator 130.

Naturally, there is no impediment to reversing these for the convenience of the driving circuit or wiring. In the above-described examples, although a diaphragm 50 configured by an elastic film 51 and an insulating film 52 is given as an example, there is naturally no limitation thereto. For example, either one of the elastic film 51 and the insulating film 52 may be provided as the diaphragm 50, or only the first electrode 60 may act as the diaphragm without providing the elastic film 51 and the insulating film 52 as the diaphragm 50. The actuator 130 itself may be set to substantially serve as the diaphragm.

The piezoelectric layer 70 is formed from a piezoelectric material of an oxide having a polarized structure, and for example, it is possible for the piezoelectric material to be formed from a perovskite oxide represented by general formula $ABO_3$, and it is possible to use a lead-based piezoelectric material including lead or a non-lead based piezoelectric material not including lead.

One end portion of the lead electrode 90 formed from gold (Au) or the like that is drawn from the vicinity of the end portion on the opposite side to the supply communication path 19 and is extended onto the diaphragm 50 is connected to each of the second electrodes 80 which are individual electrodes of the actuator 130.

A wiring substrate 121 that is an example of a flexible wiring substrate on which a driving circuit 120 for driving the actuator 130 is connected to the other end portion of the lead electrode 90. The wiring substrate 121 is a sheet-like flexible substrate, and it is possible for a COF substrate or the like to be used.

A second terminal row 123 in which a plurality of second terminals (wiring terminals) 122 that are electrically connected to the first terminal 311 of the head substrate 300, described later, is arranged in parallel is formed on one surface of the wiring substrate 121. The second terminals 122 of the embodiment are plurally arranged in parallel along the scanning direction X to form the second terminal row 123. The driving circuit 120 may not be provided on the wiring substrate 121. That is, the wiring substrate 121 is not limited to a COF substrate, and may be FFC, FPC or the like.

A protective substrate 30 having approximately the same size as the flow channel-forming substrate 10 is bonded to the surface of the actuator 130 side of the flow channel-forming substrate 10. The protective substrate 30 includes a holding portion 31 that is a space for protecting the actuator 130.

The holding portion 31 has a concave shape opened to the flow channel-forming substrate 10 without passing through the protective substrate 30 in the power direction Z that is the thickness direction. A holding portion 31 is provided independently for each row configured by the actuator 130 provided in parallel in the scanning direction X. That is, the holding portion 31 is provided so as to accommodate the rows provided in parallel in the scanning direction X of the actuator 130, and is provided for each row of actuators 130, that is, two are provided in parallel in the transport direction Y. The holding portion 31 may have a space that does not hinder the movement of the actuator 130, and the space may or may not be sealed.

The protective substrate 30 has a through hole 32 that passes through in the power direction Z that is the thickness direction. The through hole 32 is provided along the scanning direction X that is the arrangement direction of the plurality of actuators 130 between the two holding portions 31 arranged in parallel in the transport direction Y. That is, the through holes 32 form openings having a long side in the arrangement direction of the plurality of actuators 130. The other end portion of the lead electrode 90 is arranged extending so as to be exposed inside the through hole 32, and the lead electrode 90 and the wiring substrate 121 are electrically connected inside the through hole 32.

It is preferable to use materials having substantially the same coefficient of thermal expansion as the flow channel-forming substrate 10, such as glass, and ceramic materials as the protective substrate 30, and in the present embodiment, the protective substrate 30 is formed using a silicon single crystal substrate of the same material as the flow channel-forming substrate 10. The method of bonding of the flow channel-forming substrate 10 and the protective substrate 30 is not particularly limited, and in the embodiment, the flow channel-forming substrate 10 and the protective substrate 30 are bonded passing through a bonding agent (not shown).

The head unit 2 with such a configuration is provided with a flow channel-forming member 40 that, along with the head main body 11, defines the common liquid chamber 100 that communicates with the plurality of pressure generating chamber 12. The flow channel-forming member 40 has substantially the same shape as the above-described communication plate 15 seen in plan view, and is bonded to the protective substrate 30 and also bonded to the above-described communication plate 15. Specifically, the flow channel-forming member 40 includes a concavity 41, in the protective substrate 30 side, with a depth at which the flow channel-forming substrate 10 and the protective substrate 30 are accommodated.

The concavity 41 has a wider opening area than the surface bonded to the flow channel-forming substrate 10 of the protective substrate 30. The opening surface on the nozzle plate 20 side of the concavity 41 is sealed by the communication plate 15 in a state in which the flow channel-forming substrate 10 or the like is accommodated in the concavity 41. In so doing, the third manifold portion 42 is defined by the flow channel-forming member 40 and the head main body 11 on the outer peripheral portion of the flow channel-forming substrate 10. The common liquid chamber 100 of the embodiment is configured by the first and second manifold portions 17 and 18 provided on the communication plate 15 and the third manifold portion 42 defined by the flow channel-forming member 40 and the head main body 11.

That is, the common liquid chamber 100 is equipped with the first manifold portion 17, the second manifold portion 18, and the third manifold portion 42. A common liquid chamber 100 of the embodiment is arranged on either outer side of the two rows of pressure generating chambers 12 in the transport direction Y, and the two common liquid chambers 100 provided on both outer sides of the two rows of pressure generating chambers 12 are independently provided so as to not communicate in the head unit 2. That is, one common liquid chamber 100 is provided to communicate for each row (row provided in parallel to the scanning direction X) of the pressure generating chambers 12 of the embodiment. In other words, a common liquid chamber 100 is provided for each nozzle group. Naturally, the two common liquid chambers 100 may communicate.

In this way, the flow channel-forming member 40 is a member that forms a flow channel (common liquid chamber 100) for ink supplied to the head main body 11, and has an introduction port 44 that communicates with the common liquid chamber 100. That is, the introduction port 44 is an opening that in an entrance that introduces ink supplied to the head main body 11 to the common liquid chamber 100.

A connection port 43 in which the wiring substrate 121 is inserted communicating with the through hole 32 of the protective substrate 30 is provided in the flow channel-forming member 40. The other end portion of the wiring substrate 121 is extended to the opposite side to the ejection direction of the ink droplets that is the penetration direction of the through hole 32 and the connection port 43, that is, the power direction Z.

It is possible to use a resin, a metal or the like as the material for such a flow channel-forming member 40. Incidentally, mass production at a low cost is possible by forming a resin material as the flow channel-forming member 40.

A compliance substrate 45 is provided on the surface in which the first and second manifold portions 17 and 18 of the communication plate 15 open. The compliance substrate 45 has approximately the same size as the above-described communication plate 15 in plan view, and a first exposure opening 45*a* that exposes the nozzle plate 20 is provided. The opening on the liquid ejecting surface 20*a* side of the first manifold portion 17 and the second manifold portion 18 is sealed in a state where the compliance substrate 45 exposes the nozzle plate 20 by the first exposure opening 45*a*. That is, the compliance substrate 45 defines a portion of the common liquid chamber 100.

In the embodiment, such a compliance substrate 45 is provided with a sealing film 46 and a fixed substrate 47. The sealing film 46 is formed from a film-like thin film having flexibility (for example, a thin film with a thickness of 20 μm or less formed by a polyphenylene sulfide (PPS)), and the fixed substrate 47 is formed by a hard material such as a metal such as stainless steel (SUS). Because the region facing the common liquid chamber 100 of the fixed substrate 47 forms an opening 48 that is completely removed in the thickness direction, one surface of the common liquid chamber 100 is a compliance portion 49 that is a flexible portion sealed only by the sealing film 46 having flexibility. In the embodiment, one compliance portion 49 is provided corresponding to one common liquid chamber 100. That is, in the embodiment, because two common liquid chambers 100 are provided, two compliance portions 49 are provided on both ends in the transport direction Y with the nozzle plate 20 interposed.

In a head unit 2 with such a configuration, when ejecting ink, ink is pulled in passing through the introduction port 44 and the internal portion of the flow channel is filled with ink form the common liquid chamber 100 until reaching the nozzles 21. Thereafter, the diaphragm 50 is flexurally deformed along with the actuator 130 by applying a voltage to each actuator 130 corresponding to the pressure generating chamber 12 according to signals from the driving circuit 120. In so doing, the pressure in the pressure generating chamber 12 increases, and ink droplets are ejected from a predetermined opening of the nozzle 21.

Configuration of Liquid Ejecting Unit

Next, the liquid ejecting unit 1 having the head unit 2 will be described in detail.

Figure 6:
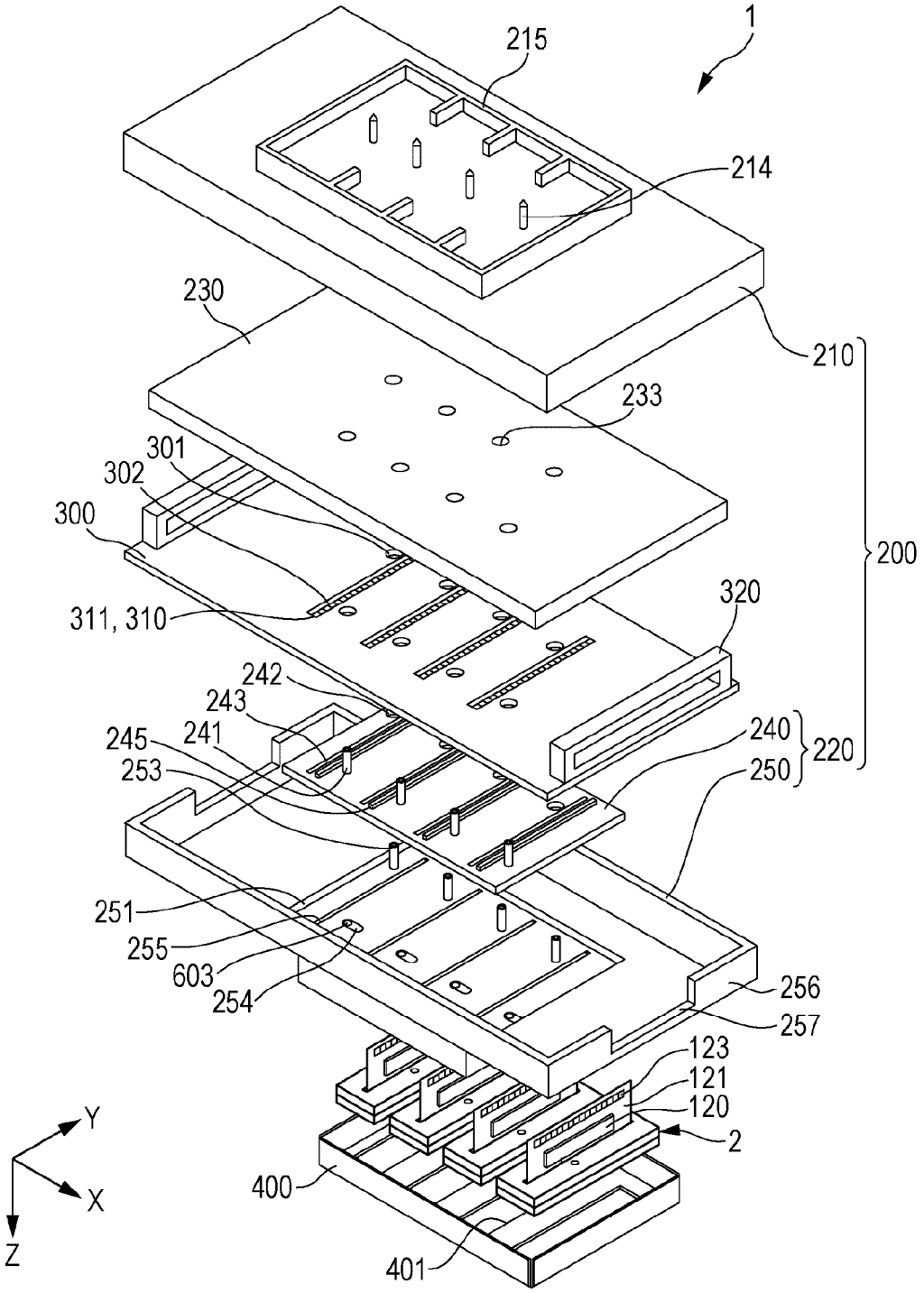
FIG. 6 is an exploded perspective view of a liquid ejecting unit.

As shown in FIG. 6, the liquid ejecting unit 1 is provided with four head units 2, a flow channel member 200 including a holder member that holds the head units 2 and supplies ink to the head unit 2, a head substrate 300 held to the flow channel member 200, and a wiring substrate 121 that is an example of a flexible wiring substrate.

Figure 7:
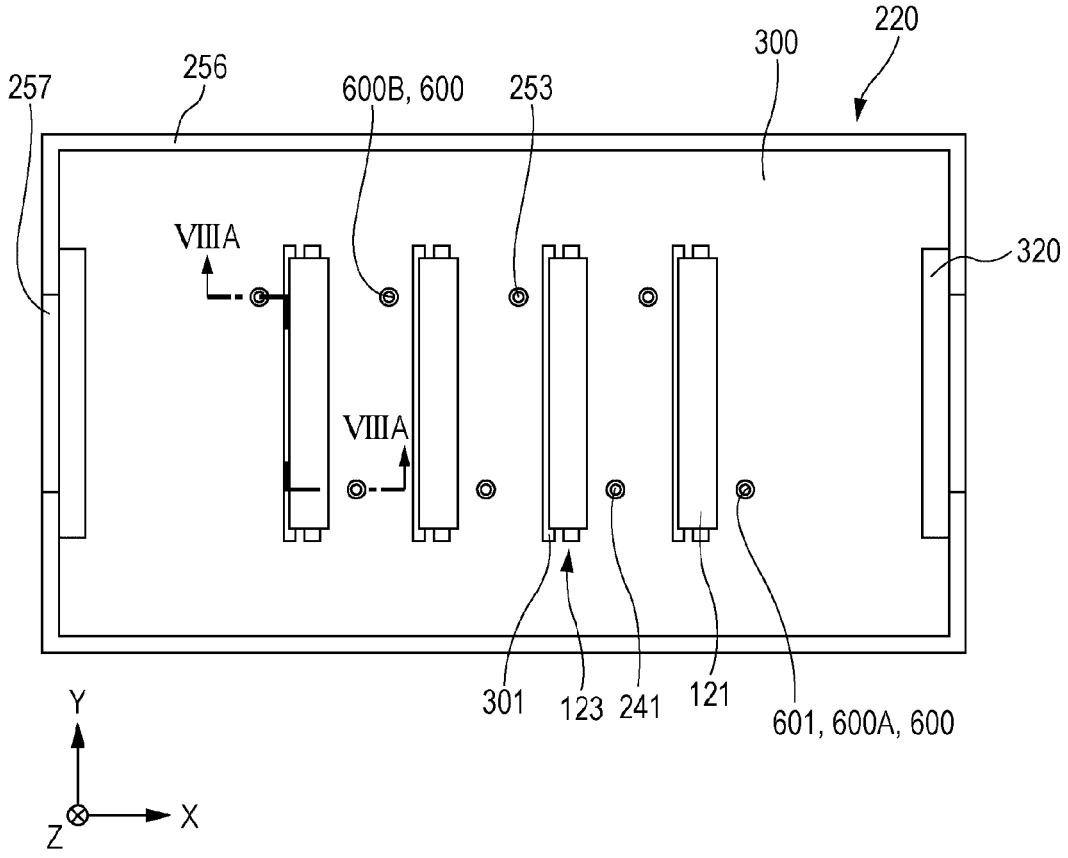
FIG. 7 is a plan view of the liquid ejecting unit.

FIG. 7 shows a plan view of the liquid ejecting unit 1 with the depiction of the seal member 230 and the upstream flow channel member 210 omitted.

Figure 8A:
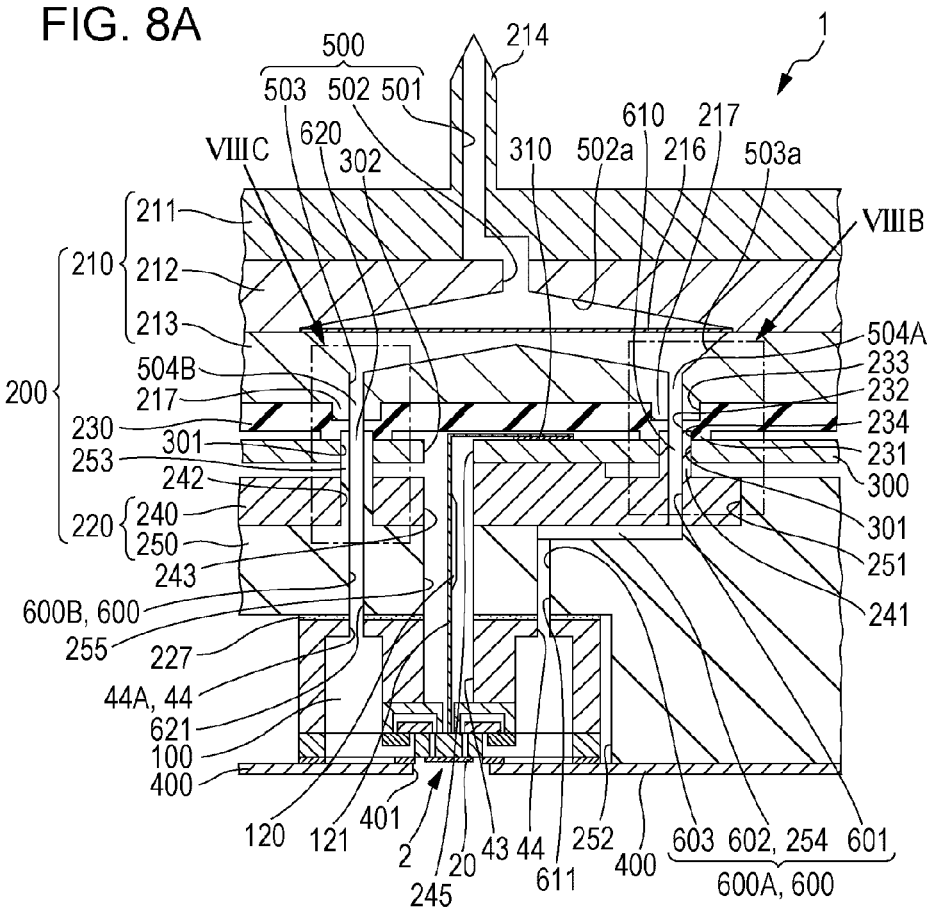
FIG. 8A is a cross-sectional view taken along line VIIIA-VIIIA in FIG. 7.
Figure 8B:
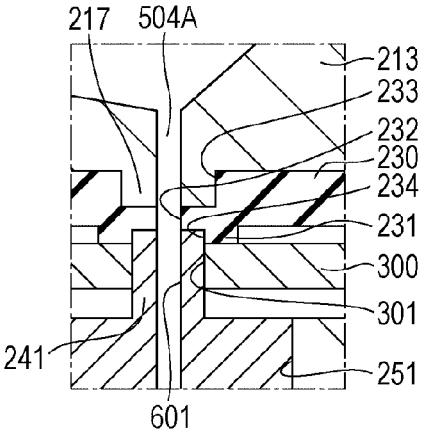
FIG. 8B is an expanded view of the inside of a dashed line frame on the right side in FIG. 8A.
Figure 8C:
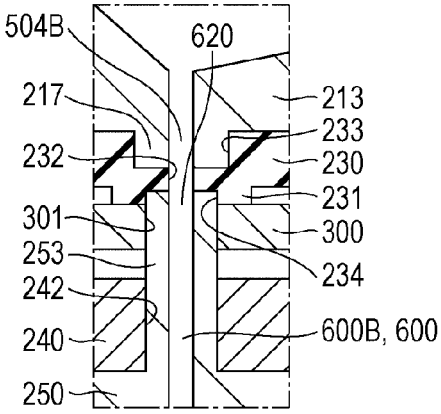
FIG. 8C is an expanded view of the inside of the dashed line frame on the left side in FIG. 8A.

As shown in FIGS. 8A to 8C, the flow channel member 200 is provided with an upstream flow channel member 210, a downstream flow channel member 220 that is an example of holder member, and a seal member 230 arranged between the upstream flow channel member 210 and the downstream flow channel member 220.

The upstream flow channel member 210 includes an upstream flow channel 500 that is a flow channel for ink. In the embodiment, the upstream flow channel member 210 is configured by the first upstream flow channel member 211, the second upstream flow channel member 212, and the third upstream flow channel member 213 being layered in the power direction Z. The upstream flow channel 500 is configured by providing, on each of the above members, a first upstream flow channel 501, a second upstream flow channel 502, and a third upstream flow channel 503, and linking the flow channels to one another.

The upstream flow channel member 210 is not limited to such a form, and may be configured with a single member or a plurality of two or more members. The layering direction of the plurality of members that configure the upstream flow channel member 210 is also not particularly limited, and may be the scanning direction X or the transport direction Y.

The first upstream flow channel member 211 includes a connector 214 connected to a liquid holding member, such as an ink tank or ink cartridge in which ink (liquid) is held, on the opposite surface side to the downstream flow channel member 220. In the embodiment, the connector 214 protrudes in a needle shape. The liquid holding portion such as an ink cartridge may be directly connected to the connector 214 or the liquid holding portion such as an ink tank may be connected passing through a supply pipe or the like such as a tube.

The first upstream flow channel 501 is provided on the first upstream flow channel member 211. The first upstream flow channel 501 is configured by a flow channel extending in the power direction Z and a flow channel or the like extending in the plane including a direction orthogonal to the power direction Z, that is, the scanning direction X and the transport direction Y according to the position of the second upstream flow channel 502, described later, opened to the top surface of the connector 214. A guide wall 215 (refer to FIG. 6) for positioning the liquid holding portion is provided on the periphery of the connector 214 of the first upstream flow channel member 211.

The second upstream flow channel member 212 is fixed to the opposite surface side to the connector 214 of the first upstream flow channel member 211, and includes a second upstream flow channel 502 linked to the first upstream flow channel 501. A first liquid reservoir unit 502*a* for which the inner diameter is widened more than the second upstream flow channel 502 is provided on the downstream side (third upstream flow channel member 213 side) of the second upstream flow channel 502.

The third upstream flow channel member 213 is provided on the opposite side to the first upstream flow channel member 211 of the second upstream flow channel member 212. The third upstream flow channel 503 is provided on the third upstream flow channel member 213. The opening part on the second upstream flow channel 502 side of the third upstream flow channel 503 forms a second liquid reservoir unit 503*a* widened in accordance with the first liquid reservoir unit 502*a*.

A filter 216 for removing air bubbles or foreign materials included in the ink is provided at the opening part (between the first liquid reservoir unit 502*a* and the second liquid reservoir unit 503*a*) of the second liquid reservoir unit 503*a*. In so doing, the ink supplied from the second upstream flow channel 502 (first liquid reservoir unit 502*a*) is supplied to the third upstream flow channel 503 (second liquid reservoir unit 503*a*) passing through the filter 216.

It is possible to use a network body such as a metal mesh or a resin net, a porous body, or a metal plate in which fine through holes are drilled as the filter 216. It is possible to use a metal sintered filter in which a metal mesh filter or a metal fiber, for example, a SUS fine wire is formed in a felt forms or is compressed and sintered, an electroforming metal filter, an electron beam worked metal filter, a laser beam worked metal filter or the like as specific examples of the network body.

In particular, it is preferable that the bubble point pressure (pressure at which the meniscus is formed by the filter perforations is damaged) does not fluctuate, and a filter having a high definition hole diameter is suitable. The nominal filtration grain size of the filter is preferably smaller than the diameter of the nozzle opening in a case where the nozzle opening is a circular shape, in order that the foreign materials in the ink are not allowed to reach the nozzle opening.

In order that the foreign materials in the ink are not allowed to reach the nozzle opening in a case where a stainless steel mesh filter is employed as the filter 216, a twilled Dutch weave (nominal filtration grain size 10 μm) in which the nominal filtration grain size of the filter is smaller than the nozzle opening (for example, in a case where the nozzle opening is a circular shape, the diameter of the nozzle opening is 20 μm), and in this case, the bubble point pressure (pressure at which the meniscus at formed by the filter perforations is damaged) generated by the ink (surface tension 28 mN/m) is 3 to 5 kPa. In a case where the twilled Dutch weave (nominal filtration grain size 5 μm) is employed, the bubble point pressure (pressure at which the meniscus is formed by the filter perforations is damaged) generated by the ink is 0 to 15 kPa.

The third upstream flow channel 503 is branched in two further to the downstream side (opposite side to the second upstream flow channel) than the second liquid reservoir unit 503*a*, and the third upstream flow channel 503 opens as a first exit port 504A and a second exit port 504B in the surface of the downstream flow channel member 220 of the third upstream flow channel member 213. Below, in a case where the first exit port 504A and the second exit port 504B are not distinguished, they are referred to as the exit port 504.

That is, the upstream flow channel 500 corresponding to one connector 214 includes a first upstream flow channel 501, a second upstream flow channel 502, and a third upstream flow channel 503, and the upstream flow channel 500 opens as two exit ports 504 (first exit port 504A and second exit port 504B) in the downstream flow channel member 220 side. In other words, the two exit ports 504 (first exit port 504A and second exit port 504B) are provided communicating to the shared flow channel.

A third projection 217 protruding toward the downstream flow channel member 220 side is provided on the downstream flow channel member 220 side of the third upstream flow channel member 213. A third projection 217 is provided for each third upstream flow channel 503 and the exit port 504 is provided opened in the tip surface of the third projection 217.

The first upstream flow channel member 211, the second upstream flow channel member 212, and the third upstream flow channel member 213 in which the upstream flow channel 500 is provided are integrally layered by an adhesive or melting or the like. Although it is possible for the first upstream flow channel member 211, the second upstream flow channel member 212, and the third upstream flow channel member 213 to be fixed by a screw, a clamp or the like, in order to suppress leakage of ink (liquid) from the connection part from the first upstream flow channel 501 to the third upstream flow channel 503, bonding by an adhesive, melting or the like is preferable.

In the embodiment, four connectors 214 are provided in one upstream flow channel member 210, and four independent upstream flow channels 500 are provided in one upstream flow channel member 210. Ink corresponding to each of the four head units 2 is supplied to each upstream flow channel 500. The one upstream flow channel 500 branches in two, and each branch is connected to the two introduction ports 44 of the head unit 2 linked to the downstream flow channel 600, described below.

In the embodiment, although an example is provided of a configuration in which the upstream flow channel 500 is branched in two further to the downstream (downstream flow channel member 220 side) than the filter 216, there is no particular limitation thereto, and the upstream flow channel 500 may be branched into three or more further to the downstream side than the filter 216. One upstream flow channel 500 may not be branched further to the downstream than the filter 216.

The downstream flow channel member 220 is bonded to the upstream flow channel member 210, and is an example of the holder member having a downstream flow channel 600 that communicates with the upstream flow channel 500. The downstream flow channel member 220 according to the embodiment is configured from a first downstream flow channel member 240 that is an example of a first member and a second downstream flow channel member 250 that is an example of the second member.

The downstream flow channel member 220 includes a downstream flow channel 600 that is a flow channel for ink. The downstream flow channel 600 according to the embodiment is configured by two downstream flow channels 600A and 600B with different shapes.

The first downstream flow channel member 240 is a member formed in a substantially plate shape. The second downstream flow channel member 250 is a member provided with a first accommodation portion 251 as a concavity in the surface of the upstream flow channel member 210 side and a second accommodation portion 252 as a concavity in the surface of the opposite side to the upstream flow channel member 210.

The first accommodation portion 251 is made large enough for the first downstream flow channel member 240 to be accommodated. The second accommodation portion 252 is made large enough for the four head units 2 to be accommodated. The second accommodation portion 252 according to the embodiment is able to accommodate four head units 2.

In the first downstream flow channel member 240, a plurality of first projections 241 is formed on the surface of the upstream flow channel member 210 side. Each first projection 241 is provided facing the third projection 217 in which the first exit port 504A is provided from the third projections 217 provided in the upstream flow channel member 210. In the embodiment, four first projections 241 are provided.

A first flow channel 601 that passes through in the power direction Z and is opened in the top surface (surface facing the upstream flow channel member 210) of the first projection 241 is provided in the first downstream flow channel member 240. The third projection 217 and the first projection 241 are bonded passing through the seal member 230, and the first exit port 504A and the first flow channel 601 communicate.

A plurality of second through holes 242 that pass through in the power direction Z are formed in the first downstream flow channel member 240. Each second through hole 242 is formed at a position at which the second projection 253 formed in the second downstream flow channel member 250 is inserted. In the embodiment, four second through holes 242 are provided.

A plurality of first insertion holes 243 in which the wiring substrate 121 electrically connected to the head unit 2 is inserted is formed on the first downstream flow channel member 240. Specifically, each first insertion hole 243 is formed so as to pass through in the power direction Z and to communicate with the second insertion hole 255 of the second downstream flow channel member 250 and the third insertion hole 302 of the head substrate 300. In the embodiment, four first insertion holes 243 corresponding to each wiring substrate 121 provided in four head units 2 are provided. A support portion 245 protruding to the head substrate 300 side and having a receiving surface is provided in the first downstream flow channel member 240.

A plurality of second projections 253 is formed in the bottom surface of the first accommodation portion 251 in the second downstream flow channel member 250. Each second projection 253 is provided facing the third projection 217 in which the second exit port 504B is provided from the third projections 217 provided in the upstream flow channel member 210. In the embodiment, four second projections 253 are provided. A downstream flow channel 600B that passes through in the power direction Z and opens in top surface of the second projection 253 and the bottom surface (surface facing the head unit 2) of the second accommodation portion 252 is provided in the second downstream flow channel member 250. The third projection 217 and the second projection 253 are bonded passing through the seal member 230, and the second exit port 504B and the downstream flow channel 600B communicate.

A plurality of third flow channels 603 that pass through in the power direction Z are formed in the second downstream flow channel member 250. Each third flow channel 603 opens in the bottom surface of the first and second accommodation portions 251 and 252. In the embodiment, four third flow channels 603 are provided.

A plurality of groove portions 254 contiguous with the third flow channels 603 is formed in the bottom surface of the first accommodation portion 251 in the second downstream flow channel member 250. The groove portion 254 forms the second flow channel 602 by being sealed to the first downstream flow channel member 240 accommodated in the first accommodation portion 251. That is, the second flow channel 602 is a flow channel defined by the groove portion 254 and the surface on the second downstream flow channel member 250 side of the first downstream flow channel member 240. The second flow channel 602 corresponds to the flow channel provided between the first member and the second member disclosed in the claims.

A plurality of second insertion holes 255 in which the wiring substrate 121 electrically connected to the head unit 2 is inserted is formed on the second downstream flow channel member 250. Specifically, each second insertion hole 255 is formed so as to pass through in the power direction Z and to communicate with the first insertion hole 243 of the first downstream flow channel member 240 and the connection port 43 of the head unit 2. In the embodiment, four second insertion holes 255 corresponding to each wiring substrate 121 provided in the four head units 2 are provided.

The downstream flow channel 600A is formed with the above-described first flow channel 601, the second flow channel 602, and the third flow channel 603 passing through. Here, the second flow channel 602 is formed by the groove formed in one surface of the first downstream flow channel member 240 being sealed by the second downstream flow channel member 250. It is possible for the second flow channel 602 to be easily formed in the downstream flow channel member 220 by bonding the first downstream flow channel member 240 and the second downstream flow channel member 250.

The second flow channel 602 is an example of a flow channel extended in the horizontal direction. The second flow channel 602 extending in the horizontal direction refers to a component (vector) in the scanning direction X or the transport direction Y being included in the extension direction of the second flow channel 602. It is possible for the height of the liquid ejecting unit 1 to be reduced in the power direction Z by extending the second flow channel 602 in the horizontal direction. When the second flow channel 602 is inclined to the horizontal direction, slight height is necessary for the liquid ejecting unit 1.

Incidentally, the extension direction of the second flow channel 602 is the direction in which ink (liquid) in the second flow channel 602 flows. Accordingly, the second flow channel 602 is provided in the horizontal direction (direction orthogonal to the power direction Z), and includes being provided intersecting in the power direction Z and the horizontal direction (in-plan direction of the scanning direction X and the transport direction Y). In the embodiment, the first and third flow channels 601 and 603 are provided along the power direction Z, and the second flow channel 602 is provided along the horizontal direction (transport direction Y). The first flow channel 601 and the third flow channel 603 may be provided in a direction intersecting in the power direction Z.

Naturally, the downstream flow channel 600A is not limited thereto, and a flow channel other than the first flow channel 601, the second flow channel 602, and the third flow channel 603 may be present. The downstream flow channel 600A may not be configured from the first flow channel 601, the second flow channel 602, and the third flow channel 603, and may be configured from one flow channel.

The downstream flow channel 600B is formed as a through hole that passes through the second downstream flow channel member 250 in the power direction Z as described above. Naturally, the downstream flow channel 600B is not limited to such a form, and may be formed along a direction intersecting the power direction Z, or a configuration may be used in which a plurality of flow channels are communicated as in the downstream flow channel 600A.

The downstream flow channels 600A and 600B are configured one at the time for one head unit 2. That is, a total of four groups of the downstream flow channels 600A and 600B are provided in the downstream flow channel member 220.

Among the openings on both ends of the downstream flow channel 600A, the opening of the first flow channel 601 with which the first exit port 504A is communicated is the first inflow port 610, and the opening of the third flow channel 603 that opens in the second accommodation portion 252 is the first outflow port 611.

From among the openings on both ends of the downstream flow channel 600B, the opening of the downstream flow channel 600B with which the second exit port 504B is communicated is the second inflow port 620, and the opening of the downstream flow channel 600B that opens in the second accommodation portion 252 is the second outflow port 621. Hereafter, in a case where the downstream flow channels 600A and 600B are not distinguished, they are referred to as the downstream flow channel 600.

As shown in FIG. 6, the downstream flow channel member 220 (holder member) holds the head unit 2 at the downward side. Specifically, a plurality (in the embodiment, 4) of the head units 2 are accommodated in the second accommodation portion 252 of the downstream flow channel member 220.

As shown in FIGS. 8A to 8C, introduction ports 44 are provided two at the time in the head unit 2. The first outflow port 611 and the second outflow port 621 of the downstream flow channel 600 (downstream flow channel 600A and downstream flow channel 600B) are provided in the downstream flow channel member 220 matching the position at which each introduction port 44 opens.

Each introduction port 44 of the head unit 2 is positioned so as to pass through the first outflow port 611 and the second outflow port 621 of the downstream flow channel 600 opened in the bottom surface portion of the second accommodation portion 252. The head unit 2 is fixed to the second accommodation portion 252 by the adhesive 227 provided at the periphery of each introduction port 44. By the head unit 2 being fixed to the second accommodation portion 252 in this way, the first and second outflow ports 611 and 621 of the downstream flow channel 600 and the introduction port 44 are communicated, and ink is supplied to the head unit 2.

The downstream flow channel member 220 (holder member) has the head substrate 300 mounted on the upward side. Specifically, the head substrate 300 is mounted on the surface of the upstream flow channel member 210 side of the downstream flow channel member 220. The head substrate 300 is a member to which the wiring substrate 121 is connected, and to which electronic components, such as circuits that controls the ejection operation or the like of the liquid ejecting unit 1 passing through the wiring substrate 121 or a resistor are mounted.

As shown in FIG. 6, a first terminal row 310 in which a plurality of first terminals (electrode terminal) 311 to which the second terminal rows 123 of the wiring substrate 121 are electronically connected are arranged in parallel is formed in the surface on the upstream flow channel member 210 side of the head substrate 300. A plurality of first terminals 311 of the embodiment is arranged in parallel along the scanning direction X to form the first terminal row 310. In the embodiment, the first terminal row 310 is an example of a mounting region electrically connected to the wiring substrate 121.

A plurality of third insertion holes 302 in which the wiring substrate 121 electrically connected to the head unit 2 is inserted is formed on the head substrate 300. Specifically, each third insertion hole 302 is formed so as to pass through in the power direction Z and to communicate with the first insertion hole 243 of the first downstream flow channel member 240. In the embodiment, four third insertion holes 302 corresponding to each wiring substrate 121 provided in the four head units 2 are provided.

The third through hole 301 passing through in the power direction Z is provided in the head substrate 300. The third through hole 301 has the first projection 241 of the first downstream flow channel member 240 and the second projection 253 of the second downstream flow channel member 250 inserted. In the embodiment, a total of eight third through holes 301 are provided so as to face the first projection 241 and the second projection 253.

The shape of the third through hole 301 formed in the head substrate 300 is not limited to the above-described forms. For example, a common through hole in which the first projection 241 and the second projection 253 are inserted may be the insertion hole. That is, for the head substrate 300, an insertion hole, notch or the like may be with formed so as to not be an impediment when connecting the downstream flow channel 600 of the downstream flow channel member 220 and the upstream flow channel 500 of the upstream flow channel member 210.

As shown in FIGS. 8A to 8C, a seal member 230 is provided between the head substrate 300 and the upstream flow channel member 210. It is possible to use an elastically deformable material (elastic material) having liquid resistance to liquids such as ink used in the liquid ejecting unit 1, for example, a rubber, elastomer or the like, as the material of the seal member 230.

The seal member 230 is a plate-like member in which a communication channel 232 passing through in the power direction Z and a fourth projection 231 protruding to the downstream flow channel member 220 side are formed. In the embodiment, eight communication channels 232 and fourth projections 231 are formed corresponding to each upstream flow channel 500 and downstream flow channel 600.

An annular first concavity 233 in which the third projection 217 is inserted is provided on the upstream flow channel member 210 side of the seal member 230. The first concavity 233 is provided at a position corresponding to the fourth projection 231.

The fourth projection 231 protrudes to the downstream flow channel member 220 side, and is provided at a position facing the first projection 241 and the second projection 253 of the downstream flow channel member 220. A second concavity 234 in which the first projection 241 and the second projection 253 are inserted is provided in the top surface (surface facing the downstream flow channel member 220) of the fourth projection 231.

One end of the communication channel 232 passes through the seal member 230 in the power direction Z and opens in the first concavity 233, and the other end opens in the second concavity 234. The fourth projection 231 is held in a state where a predetermined pressure is applied in the power direction Z between the tip surface of the third projection 217 inserted in the first concavity 233 and the tip surface of first and second projections 241 and 253 inserted in the second concavity 234. Accordingly, the upstream flow channel 500 and the downstream flow channel 600 are communicated in a state of being sealed passing through the communication channel 232.

A cover head 400 is attached to the second accommodation portion 252 side (lower side) of the downstream flow channel member 220. The cover head 400 is a member to which the head unit 2 is fixed, and fixed to the downstream flow channel member 220, and is provided with a second exposure opening 401 that exposes the nozzle 21. In the embodiment, the second exposure opening 401 has an opening with a size that exposes the nozzle plate 20, that is, substantially the same at the first exposure opening 45*a* of the compliance substrate 45.

The cover head 400 is bonded to the opposite surface side of the communication plate 15 of the compliance substrate 45, and seals the space on the opposite side to the flow channel (common liquid chamber 100) of the compliance portion 49. By covering the compliance portion 49 with the cover head 400 in this way, it is possible to suppress damage even if the compliance portion 49 contacts the medium ST. It is possible to suppress the attachment of ink (liquid) to the compliance portion 49, and to wipe the ink (liquid) attached to the surface of the cover head 400 with the wiper blade or the like, and it is possible to suppress staining of the medium ST with ink or the like attached to the cover head 400. Although not particularly shown in the drawings, the space between the cover head 400 and the compliance portion 49 is opened to the atmosphere. Naturally, the cover head 400 may be independently provided for each head unit 2.

Configuration of Maintenance Device

Next, the configuration of the maintenance device 710 will be described in detail.

Figure 9:
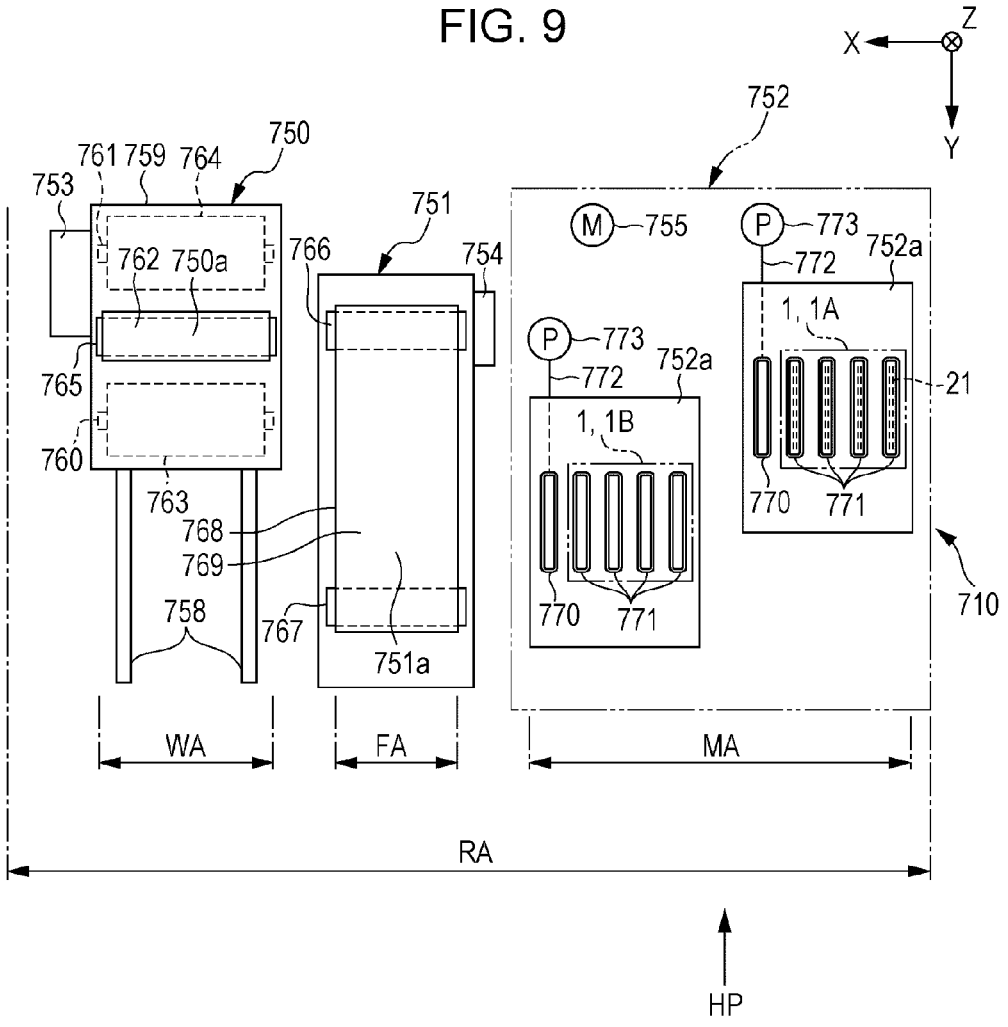
FIG. 9 is a plan view showing a configuration of a maintenance device.

As shown in FIG. 9, the non-printing region RA includes the wiping region WA in which the wiper unit 750 is provided, a receiving region FA in which the flushing unit 751 is provided and a maintenance region MA in which the cap unit 752 is provided. In the non-printing region RA, the wiping region WA, receiving region FA, and the maintenance region MA are arranged from the printing region PA (refer to FIG. 2) in the scanning direction X in the order of the wiping region WA, the receiving region FA, and the maintenance region MA.

The wiper unit 750 includes a wiping member 750*a* that wipes the liquid ejecting unit 1. The wiping member 750*a* of the embodiment is a movable type, and performs a wiping operation with the power of a wiping motor 753. The flushing unit 751 includes a liquid receiving portion 751*a* that receives ink droplets discharged by the liquid ejecting unit 1.

The liquid receiving portion 751*a* of the embodiment is configured by a belt, and the belt is moved by the power of the flushing motor 754 for a predetermined time period in which an ink staining amount exceeds a prescribed amount by the flushing of a belt. The wording "flushing" refers to an operation of forcefully ejecting (discharging) ink droplets unrelated to printing from all nozzles 21 with the purpose of preventing or resolving clogging or the like of the nozzles 21.

The cap unit 752 includes two cap units 752*a* able to contact the liquid ejecting units 1A and 1B so as to surround the openings of the nozzles 21 when the liquid ejecting units 1A and 1B are positioned at the home position HP as shown by the double dotted line in FIG. 9. The two cap units 752*a* are configured to be able to move between a contact position that contacts the liquid ejecting unit 1 that is the home position HP and a retreated position separated from the liquid ejecting unit 1 by the power of the capping motor 755.

The wiper unit 750 is equipped with a movable housing 759 that is able to reciprocate on the pair of rails 758 extending along the transport direction Y with the power of the wiping motor 753. The delivery shaft 760 and the winding shaft 761 positioned spaced at predetermined distance are each supported in the housing 759 to be able to rotate in the wiping direction (same direction as the transport direction Y). The delivery shaft 760 supports the delivery roll 763 formed by an unused cloth sheet 762, and the winding shaft 761 supports the winding roll 764 formed by the used cloth sheet 762.

The cloth sheet 762 positioned between the delivery roll 763 and the winding roll 764 forms a semi-cylindrical (convex) wiping member 750*a* of which a part is wound on the upper surface of a pressing roller 765 that is in a state of being partially protruded upward from an opening, not shown, of the central portion of the upper surface of the housing 759, and a part is wound of the pressing roller 765. The wiping member 750*a* is in a state of being biased upward.

The housing 759 is configured from a cassette that accommodates the delivery roll 763 and the winding roll 764, and a holder that is able to reciprocate in the wiping direction (in the embodiment, direction along the transport direction Y) passing through a power transmission mechanism (for example, a rack and pinion mechanism), not shown, with the power of the wiping motor 753 guided on the rails 758. The housing 759 reciprocates once in the transport direction Y between the retreat position shown in FIG. 9 and the wiping position at which the wiping member 750*a* finishes wiping the liquid ejecting unit 1 through the wiping motor 753 being forward and reverse driven.

At this time, when the reciprocation operation of the housing 759 finishes, the power transmission mechanism switches to a state of connecting the wiping motor 753 and the winding shaft 761 to be able to transmit power, and the return operation of the housing 759 and the winding operation of a predetermined amount of the cloth sheet 762 to the winding roll 764 are performed through power when the wiping motor 753 is reverse driven. The two liquid ejecting units 1A and 1B are sequentially moved with respect to the wiping region WA, and wiping on the two liquid ejecting units 1A and 1B is separately performed one direction moved to the wiping region WA at the time by one reciprocation of the housing 759.

The flushing unit 751 is provided with a driving roller 766 and a driven roller 767 that are parallel to one another opposed in the transport direction Y, and an endless belt 768 wound between the driving roller 766 and the driven roller 767. The belt 768 has a width of eight nozzle rows NL (2 rows×4 rows) or more in the scanning direction X, and is configures a liquid receiving portion 751*a* that receives ink ejected from each nozzle 21 of the liquid ejecting unit 1A and 1B. In this case, the outer peripheral surface of the belt 768 is a liquid receiving surface 769 that receives ink.

The flushing unit 751 is provided with a moisturizing liquid supply unit (not shown) able to supply a moisturizing liquid to the liquid receiving surface 769 on the lower side of the belt 768 and a liquid scraping unit (not shown) that scrapes off waste ink or the like attached to the liquid receiving surface 769 in a moist state, and the waste ink received by the liquid receiving surface 769 is removed from the belt 768 by the liquid scraping unit. Therefore, the receiving range facing the nozzles 21 in the liquid receiving surface 769 is renewed by the peripheral movement of the belt 768.

The cap unit 752 includes two cap units 752*a* able to form a closed space that surrounds the liquid ejecting surface 20*a* (refer to FIG. 3) in which the nozzles 21 open in contact with the two liquid ejecting units 1A and 1B. Each cap unit 752*a* moves between a contact position able to contact the liquid ejecting unit 1 and a retreated position separated from the liquid ejecting unit 1 by the power of the capping motor 755.

Each cap unit 752*a* is provided with one suction cap 770 and four moisturizing caps 771. Each moisturizing cap 771 suppresses drying of the nozzle 21 by performing capping that forms the closed space that surrounds two nozzle rows NL (refer to FIG. 3) at the time in contact with the liquid ejecting unit 1.

The suction cap 770 is connected to a suction pump 773 passing through a tube 772. By driving the suction pump 773 in a state where a sealed space is formed with the suction cap 770 in contact with the liquid ejecting unit 1, thickened ink, air bubbles or the like are suctioned from the nozzles 21 along with ink and discharged through the action of a negative pressure arising in the suction cap 770, thereby performing so-called suction cleaning.

Such suction cleaning is performed two nozzle rows NL at the time in the liquid ejecting units 1A and 1B. Since the droplets of ink discharged from the nozzle 21 attach to the liquid ejecting unit 1 when the suction cleaning is performed, after executing suction cleaning, it is preferable to perform wiping with the wiping member 750*a* in order to remove the attached droplets and the like.

When the wiping member 750*a* performs wiping, there is concern of foreign materials attached to the liquid ejecting unit 1 being pushed into the nozzles 21 and damaging the meniscus, and of discharge defects arising. Therefore, it is preferable to discharge the foreign materials mixed into the nozzle 21, and prepare the ink meniscus in the nozzle 21 by performing flushing after execution of the wiping.

Configuration of Fluid Ejecting Device

Next, the configuration of fluid ejecting device 775 will be described in detail.

Figure 10:
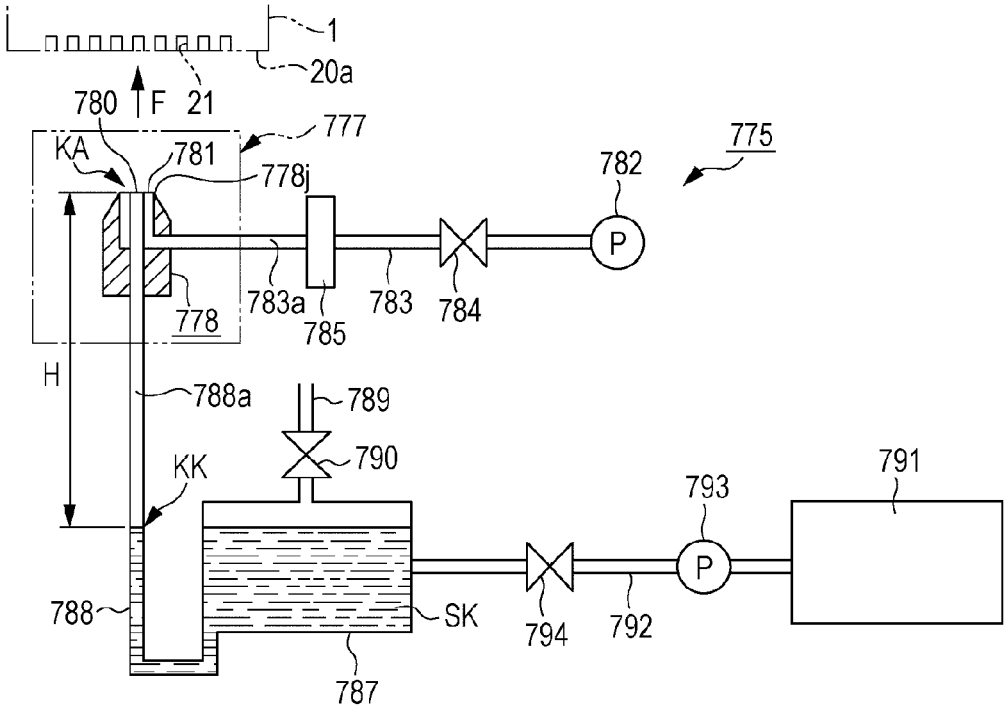
FIG. 10 is a schematic view showing a configuration of a fluid ejecting apparatus.

As shown in FIG. 10, the fluid ejecting device 775 is configured to be able to eject at least one of air (gas) and the second liquid (cleaning solution) to the liquid ejecting unit 1. The fluid ejecting device 775 is able to eject a mixed fluid in which air and the second liquid are mixed together by causing the air and the second liquid to be ejected together.

It is preferable that the second liquid be the same as the main solvent for the ink used. In the embodiment, because a water-based resin ink in which the solvent for the ink is water is adopted, although pure water is used as the second liquid, it is preferable to use the same solvent as the ink as the second liquid in a case where the solvent of the ink is solvent. A liquid in which a preservative is contained in pure water may be used as the second liquid.

It is preferable that the preservative contained in the second liquid is the same as the preservative contained in the ink, and examples thereof include aromatic halogen compounds (for example, Preventol CMK), methylene dithiocyanate, halogen-containing nitrogen sulfide compound, and 1,2-benzisothiazolin-3-one (for example, PROXEL GXL). In a case of adopting PROXEL as the preservative from the viewpoint of foaming difficulty, it is preferable that the content with respect to the second liquid be 0.05 mass % or less.

The fluid ejecting device 775 is provided with an ejecting unit 777, and the ejecting unit 777 is provided with a fluid ejecting nozzle 778 having ejection port 778*j* able to eject a mixed fluid. The fluid ejecting nozzle 778 is arranged so as to eject the mixed fluid in the ejection direction F (for example, upward orthogonal to the liquid ejecting surface 20*a*). The fluid ejecting nozzle 778 is provided with a liquid ejecting nozzle 780 from which the second liquid is ejected in the ejection direction F, and an annular gas ejecting nozzle 781 from which air is ejected in the ejection direction F and that surrounds the liquid ejecting nozzle 780.

That is, either of the liquid ejecting nozzle 780 and the gas ejecting nozzle 781 opens in the ejection direction F. The opening diameter of the liquid ejecting nozzle 780, taking attachment and solidification of the ink into consideration, is preferably sufficiently larger than the opening diameter of the nozzle 21 of the liquid ejecting unit 1, and 0.4 mm or more is preferable. In the embodiment, the opening diameter of the liquid ejecting nozzle 780 is set to 1.1 mm.

A so-called external mixing type is adopted in the fluid ejecting nozzle 778 of the embodiment in which mixing unit KA in which the second liquid and the air are mixed is positioned outside the fluid ejecting nozzle 778. Accordingly, the mixing unit KA is configured by a predetermined space that neighbors the opening of the liquid ejecting nozzle 780 and the opening of the gas ejecting nozzle 781. A gas supply pipe 783 that forms a gas flow channel 783*a* for supplying air from the air pump 782 is linked to the fluid ejecting nozzle 778. The gas flow channel 783*a* communicates with the gas ejecting nozzle 781.

A pressure regulating valve 784 that regulates the pressure of air supplied from the air pump 782 is provided at a position partway along the gas supply pipe 783. In the fluid ejecting device 775 of the embodiment, the pressure of the air supplied from the air pump 782 to the fluid ejecting nozzle 778 is set so as to be 200 kPa or higher. An air filter 785 for removing dust and the like in the air supplied to the fluid ejecting nozzle 778 is provided at position between the pressure regulating valve 784 in the gas supply pipe 783 and the fluid ejecting nozzle 778.

A liquid supply pipe 788 that forms a liquid flow channel 788*a* for supplying the second liquid accommodated in the storage tank 787 as an example of the liquid accommodating unit is linked to the fluid ejecting nozzle 778. The liquid flow channel 788*a* communicates with the liquid ejecting nozzle 780. An atmospheric open pipe 789 that opens the liquid accommodation space SK in the storage tank 787 to the atmosphere is provided on the upper end portion of the storage tank 787 and a first electromagnetic valve 790 as an example of an on-off valve is provided in the atmospheric open pipe 789.

Accordingly, whereas the liquid accommodating space SK enters a communication state that communicates with the atmosphere passing through the atmospheric open pipe 789 when the first electromagnetic valve 790 is opened, the liquid accommodating space SK enters a non-communication state that does not communicate with the atmosphere when the first electromagnetic valve 790 is closed. That is, the first electromagnetic valve 790 is configured to be able to switch the liquid accommodating space SK between the communication state and the non-communication state by an opening and closing operation.

The storage tank 787 accommodates the second liquid and is connected to a cleaning solution cartridge 791 detachably mounted to the printer main body 11*a* (refer to FIG. 1) passing through a supply pipe 792. A liquid supply pump 793 for supplying the second liquid in the cleaning solution cartridge 791 to the storage tank 787 is provided at a position partway along the supply pipe 792. A second electromagnetic valve 794 for opening and closing the supply pipe 792 is provided at a position between the liquid supply pump 793 and the storage tank 787 in the supply pipe 792.

Figure 11:
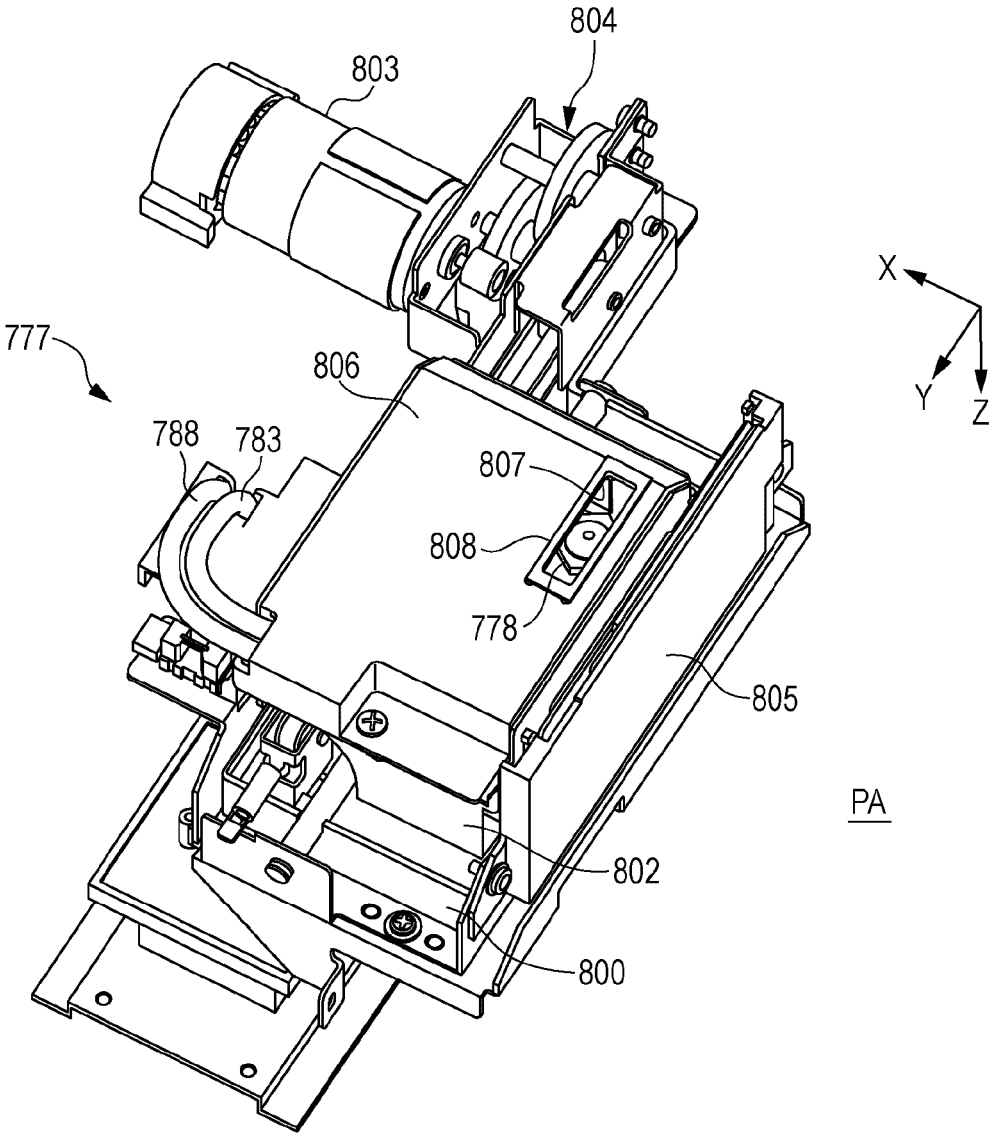
FIG. 11 is a perspective view of an ejecting unit.
Figure 12:
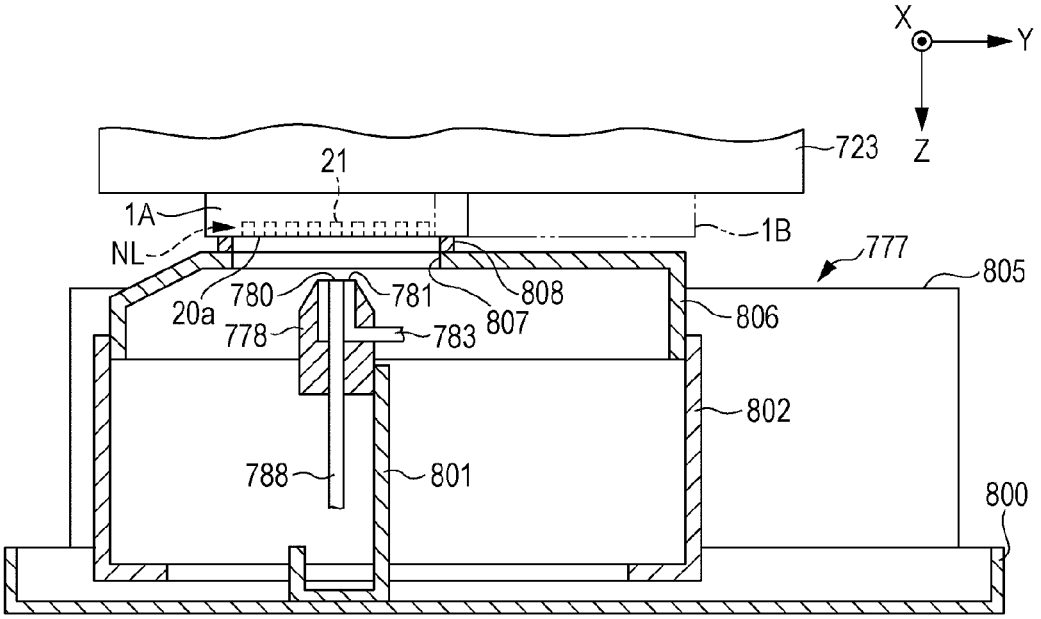
FIG. 12 is a side cross-sectional schematic view showing the usage state of the ejecting unit.

As shown in FIGS. 11 and 12, the ejecting unit 777 is provided with a bottomed rectangular box-like base member 800, a support member 801 that supports the fluid ejecting nozzle 778 and arranged in the base member 800, and a rectangular cylindrical case 802 that accommodates the fluid ejecting nozzle 778 and the support member 801 and arranged in the base member 800. The fluid ejecting nozzle 778 is fixed to the support member 801, and the support member 801 and the case 802 are configured to be able to separately reciprocate the base member 800 along the transport direction Y.

As shown in FIG. 11, the ejecting unit 777 is provided with a cleaning motor 803, a transmission mechanism 804 that transmits the driving power of the cleaning motor 803 to the support member 801, and a side plate 805 provided upright on the end portion of the printing region PA side. The support member 801 is reciprocated along the transport direction Y together with the fluid ejecting nozzle 778 by the driving power of the cleaning motor 803 being transmitted passing through the transmission mechanism 804. In this case, the case 802 is reciprocated together with the support member 801 along the transport direction Y in a case where the pressed from the inside by the support member 801.

A cover member 806 as an example of a mated member that blocks the upper end opening of the case 802 is attached to the case 802. A rectangular through hole 807 that extends in the transport direction Y is formed at a position overlapping, in the power direction Z, a portion of the movement region of the fluid ejecting nozzle 778 in the upper surface of the cover member 806. A rectangular frame-like rib portion 808 that surrounds the through hole 807 is provided in the upper surface of the cover member 806. A guide portion (not shown) that guides the case 802 when the case 802 reciprocates along the transport direction Y is provided in the surface on the case 802 side in the side plate 805.

As shown in FIG. 12, the guide portion (not shown) guides the case 802 so that the case 802 rises to positions corresponding to each of the liquid ejecting units 1A and 1B and the comes in contact with the liquid ejecting unit 1 in a state where the two nozzle rows NL positioned so that the rib portions 808 approach one another.

In the embodiment, the distance between the fluid ejecting nozzle 778 and the liquid ejecting unit 1 in the power direction Z is set to approximately 5 mm, and is longer than the distance (approximately 1 mm) between the medium ST supported by the support stand 712 shown in FIG. 1 and the liquid ejecting surface 20*a*.

Electrical Configuration of Liquid Ejecting Apparatus

Next, the electrical configuration of the liquid ejecting apparatus 7 will be described.

As shown in FIG. 13, the liquid ejecting apparatus 7 is provided with a controller 810 that controls integrally controls the liquid ejecting apparatus 7. The controller 810 is electrically connected to a linear encoder 811. The linear encoder 811 is provided with a tape-like reference plate provided so as to extend along the guide shaft 722 to the rear surface side of the carriage 723 shown in FIG. 1, and a sensor that detects light passing through a slit with a fixed pitch piercing the reference plate while fixed to the carriage 723.

The controller 810 ascertains the position in the scanning direction X of the printing unit 720, by inputting pulses at a number in proportion to the movement amount of the printing unit 720 shown in FIG. 1 from the linear encoder 811, subtracting the number of pulses input thereto when the printing unit 720 is separated from the home position HP (refer to FIG. 2), and subtracting when approaching the home position HP.

A rotary encoder 812 is electrically connected to the controller 810. The rotary encoder 812 is provided with a plate-shaped reference plate attached to the output shaft of the cleaning motor 803, and a sensor that detects light passing through a slit with a fixed pitch piercing the reference plate.

The controller 810 ascertains the position in the transport direction Y of the support member 801 (fluid ejecting nozzle 778), by inputting pulses at a number in proportion to the movement amount of the support member 801 from the rotary encoder 812, subtracting the number of pulses input thereto when support member 801 is separated from the standby position (refer to FIG. 15), and subtracting when approaching the standby position.

The controller 810 is electrically connected to the actuator 130 passing through a driving circuit 813, and controls the driving of the actuator 130. The controller 810 ascertains clogging in each nozzle 21 on the basis of the period of residual vibration of the diaphragm 50 due to the driving of the actuator 130.

The controller 810 is electrically connected to the cleaning motor 803, the carriage motor 748, the transport motor 749, the wiping motor 753, the flushing motor 754, and the capping motor 755 passing through motor driving circuits 814, 815, 816, 817, 818, and 819, respectively. The controller 810 controls the driving of each of the motors 803, 748, 749, 753, 754, and 755.

The controller 810 is electrically connected to the suction pump 773, the air pump 782, and the liquid supply pump 793 passing through the pump driving circuits 820, 821, and 822, respectively. The controller 810 controls the driving of each of the pumps 773, 782, and 793. The controller 810 is electrically connected to the first and second electromagnetic valves 790 and 794 passing through the valve driving circuits 823 and 824, respectively. The controller 810 controls the driving of each electromagnetic valve 790 and 794.

Maintenance Operation by Maintenance Device

Next, the action of the liquid ejecting apparatus 7 will be described focusing in particular on the maintenance operation that the maintenance device 710 performs on the liquid ejecting unit 1.

When printing data is input to the controller 810 through an external device or the like, ink droplets are ejected toward the surface of the medium ST from each nozzle 21 of the liquid ejecting units 1A and 1B partway through the controller 810 droving the carriage motor 748 based on the printing data to move the printing unit 720 in the scanning direction X. Thus, an image or the like is printed on the surface of the medium ST by the ejected ink droplets landing on the surface of the medium ST.

During printing of the medium ST, the printing unit 720 moves to the receiving region FA for a predetermined time period (for example, each time a predetermined time period within a range of 10 to 30 seconds elapses) with the purpose of preventing thickening or the like of the ink in the nozzles 21 that do not eject ink droplets from all of the nozzles 21, and flushing is performed while ink droplets are ejected and discharged from all of the nozzles 21.

When predetermined suction cleaning conditions are satisfied, the controller 810 controls the carriage motor 748, and performs suction cleaning with the printing unit 720 being moved to the home position HP. The suction cleaning removes thickened ink, air bubbles or the like while suctioning a predetermined amount of ink from the nozzles 21 by the suction pump 773 being driven and being acted on by the negative pressure in the suction cap 770 in a state where the suction cap 770 comes in contact with the liquid ejecting unit 1 so as to surround the nozzle NL to form a sealed space.

After the suction cleaning is finished, the controller 810 removes droplets or the like discharged from the nozzles 21 and attached to the liquid ejecting unit 1 by causing the printing unit 720 to move to the wiping region WA, and executing wiping that wipes the liquid ejecting unit 1 with the wiping member 750*a*. After execution of the wiping, the controller 810 prepares the meniscus in the nozzles 21 by causing the printing unit 720 to move to the receiving region FA and performing flushing toward the liquid receiving portion 751*a*.

Thereafter, the controller 810 detects clogging in each nozzle 21 on the basis of the period of residual vibration of the diaphragm 50 due to the driving of the actuator 130. Clogging of each nozzle 21 is detected after the suction cleaning is finished, particularly in a case where a resin ink including a synthetic resin that cured through heating or a UV ink that cures through UV (ultraviolet ray) radiation is used, because nozzles 21 occur for which clogging is not resolved even if suction cleaning is performed.

Here "clogging" includes not only a state where ink in the nozzle 21 solidifies and jams, but also includes states where the ink is not normally discharged (eject) from the nozzle 21 due to the ink hardening so that the film pulls on the meniscus in the nozzle 21 or the ink thickening in the nozzle 21, in the pressure generating chamber 12, and in the nozzle communication path 16.

When in a print job wait state in a case where clogging is not detected in all of the nozzles 21, the controller 810 performs printing on the medium ST while the printing unit 720 is moved to the printing region PA. When a nozzle 21 that is clogged is detected among all of the nozzles 21, the controller 810 performs nozzle cleaning for resolving the clogging of the nozzle 21 by causing the printing unit 720 to move to the non-printing region LA on the opposite side in the scanning direction X to the home position HP side and cleaning inside the clogged nozzle 21 with the fluid ejecting device 775.

In a case where the fluid ejecting device 775 performs nozzle cleaning, the positions thereof is matched so that the clogged nozzle 21 and the fluid ejecting nozzle 778 face in the power direction Z. In this case, the positioning in the scanning direction X (direction intersecting the direction in which the nozzle row NL extends) of the clogged nozzle 21 and the fluid ejecting nozzle 778 is performed by movement of the printing unit 720, and positioning in the transport direction Y (direction in which the nozzle row NL extends) of the clogged nozzle 21 and the fluid ejecting nozzle 778 is performed by movement of the fluid ejecting nozzle 778.

More specifically, in a case where a clogged nozzle 21 is present in the liquid ejecting unit 1A, as shown in FIG. 12, after positioning in the scanning direction X of the printing unit 720 is performed, the case 802 is moved passing through the support member 801 so that the rib portion 808 comes in contact with the liquid ejecting surface 20*a* in a state where the nozzle row NL including the clogged nozzle 21 is surrounded. Subsequently, positioning of the fluid ejecting nozzle 778 in the transport direction Y is performed while the fluid ejecting nozzle 778 is moved passing through the support member 801 so that the liquid ejecting nozzle 780 of the fluid ejecting nozzle 778 faces the clogged nozzle 21.

At this time, in the ordinary state before the mixed fluid is ejected from the fluid ejecting nozzle 778, the first electromagnetic valve 790 is opened to attain a communication state in which the liquid accommodating space SK communicates with the atmosphere and the second electromagnetic valve 794 enters a closed state.

In this state, as shown in FIG. 10, it is preferable that the height H of the gas-liquid interface KK of the second liquid in the liquid flow channel 788*a* is set so as to be −100 to −1000 mm when the height of the tip of the fluid ejecting nozzle 778 is 0. In the embodiment, the height H when the height of the tip of the fluid ejecting nozzle 778 is 0 is set to be −150 mm.

When the air pump 782 is driven to supply air to the fluid ejecting nozzle 778 in the state shown in FIGS. 10 and 12, air is ejected from the gas ejecting nozzle 781. The second liquid in the liquid flow channel 788*a* is suctioned up by the negative pressure generated by the ejection of the air and ejected from the liquid ejecting nozzle 780. In so doing, the air and the second liquid are mixed by the mixing unit KA to generate the mixed fluid, and the mixed fluid is ejected to a portion of the region of the liquid ejecting surface 20*a* that includes the clogged nozzle 21.

A large amount of the droplet-like second liquid (droplets of the second liquid with a small diameter referred to as small droplets) with a droplet shape (for example, in a case where the opening of the nozzle is circular and the shape of the droplets are spherical, a diameter of 20 μm or less that is smaller than the nozzle opening) smaller than the opening of the nozzle 21 is included in the mixed fluid, and the ejection speed of the mixed fluid from the fluid ejecting nozzle 778 at this time is set to 40 m or more per second. The kinetic energy of the small droplets is preferably the same as or higher than the kinetic energy able to damage the film like ink solidified at the gas-liquid interface to the extent damage is difficult at the energy transferred to the gas-liquid interface in the nozzle 21 by the discharging operation of ink or the flushing operation during printing.

That is, the product of the mass of the small droplets that the fluid ejecting device 775 ejects from the ejection port 778*j* toward the nozzles 21 and the square of the flight speed at the opening position of the nozzle 21 of the small droplets of the second liquid is set so as to be larger than the product of the mass of the ink droplets ejected from the nozzles 21 and the square of the flight speed of the ink droplets.

It is preferable to perform the ejection of the mixed fluid including the small droplets by the fluid ejecting device 775 to the clogged nozzle 21 (opening region in which the nozzle 21 opens) in a state where the ink of the pressure generating chamber 12 communicating with the clogged nozzle 21 pressurized by the vibration of the diaphragm 50 due to driving of the actuator 130 corresponding to the pressure generating chamber 12. When the mixed fluid is ejected from the fluid ejecting nozzle 778 to the nozzle 21, the droplet-like second liquid smaller than the opening of the nozzle 21 in the mixed fluid collides with the clogged part by passing through the opening of the nozzle 21 and entering inside the nozzle 21.

That is, the droplet-like second liquid that is smaller than the opening of the nozzle 21 collides with the ink hardened inside the nozzle 21. The hardened ink is damaged by the impact to the hardened ink by the second liquid at this time, and the clogging of the nozzle 21 is resolved. At this time, since the ink in the pressure generating chamber 12 that communicates with the nozzle 21 for which the clogging is resolved is pressurized, entrance of the mixed fluid entering into the nozzle 21 is prevented from entering into the interior of the liquid ejecting unit 1A passing through the pressure generating chamber 12.

In a case where the ejection of the mixed fluid from the fluid ejecting nozzle 778 is stopped, first, the communication state in which the liquid accommodating space SK communicates to the atmosphere is switched to the non-communication state of not communicating with the atmosphere, by closing the first electromagnetic valve 790 in a state where the mixed fluid is ejected from the fluid ejecting nozzle 778. Thus, since the liquid accommodation space SK has a negative pressure, the second liquid ejected from the liquid ejecting nozzle 780 is drawn into the liquid flow channel 788*a* by the action of the negative pressure.

In so doing, the gas-liquid interface KK (water head surface of the storage tank 787) of the second liquid in the liquid flow channel 788*a* becomes positioned further to the downward side (storage tank 787 side) than the mixing unit KA. When the air pump 782 is stopped, air is not ejected from the gas ejecting nozzle 781. In this case, since the air pump 782 is stopped in a state where the gas-liquid interface KK of the second liquid in the liquid flow channel 788*a* is positioned further to the downward side than the mixing unit KA, the second liquid in the liquid flow channel 788*a* overflowing the mixing unit KA and entering the gas ejecting nozzle 781 is suppressed.

In this case, even after the supply air from the air pump 782 to the gas ejecting nozzle 781 passing through the liquid flow channel 788*a* is stopped, the first electromagnetic valve 790 maintains a closed state, and the non-communication state of the liquid accommodation space SK is maintained. The second liquid unnecessary after the nozzle 21 is cleaned, the unnecessary ink washed away from the nozzle 21 is recovered in a waste liquid tank (not shown) from a waste liquid port (not shown) that the base member 800 includes while flowing down from inside the case 802 to inside the base member 800.

Figure 14:
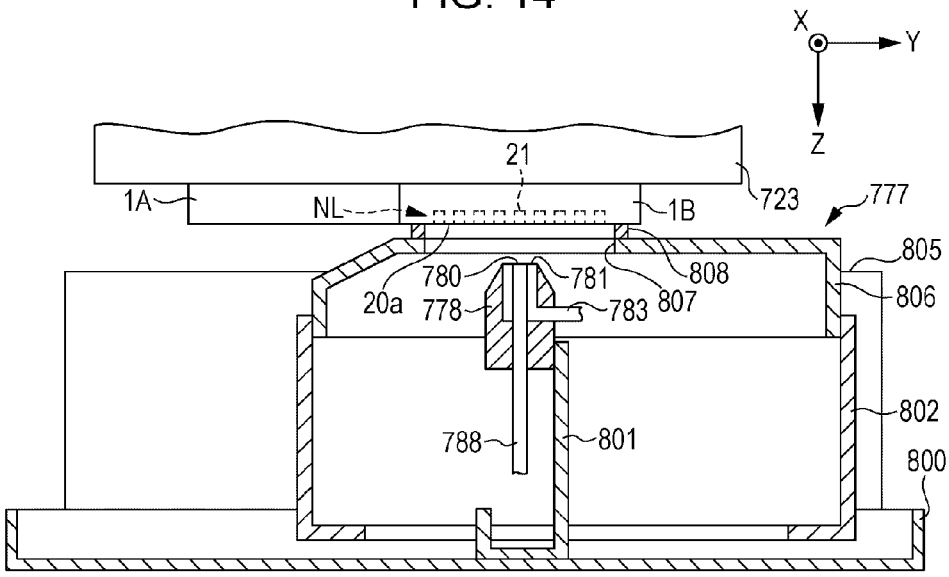
FIG. 14 is a side cross-sectional schematic view showing the usage state of the ejecting unit.

In a case where a clogged nozzle 21 is also present in the liquid ejecting unit 1B, as shown in FIG. 14, similarly to the case of the liquid ejecting unit 1A, the case 802 is moved passing through the support member 801 so that the rib portion 808 comes in contact with the liquid ejecting surface 20*a* in a state where the nozzle row NL including the clogged nozzle 21 of the liquid ejecting unit 1B is surrounded. Similarly to the case of the liquid ejecting unit 1A, the mixed fluid is ejected to the clogged nozzle 21 of the liquid ejecting unit 1B in a state where the first electromagnetic valve 790 is opened, and the clogging of the nozzle 21 is resolved.

Ejection of the mixed fluid from the fluid ejecting nozzle 778 to the liquid ejecting units 1A and 1B that include the clogged nozzle 21 may be performed a plurality of times spaced separated by the time interval. In this case the time interval may or may not be fixed. In this way, even in a case where the mixed fluid ejected from the liquid ejecting units 1A and 1B become foamy, and the opening of the nozzle 21 is blocked, the foamy mixed fluid by which the nozzle 21 is blocked during stoppage of the ejection of the mixed fluid returns to a droplet form. Therefore, it is possible to afterwards suppress hindering of the entrance into the nozzles 21 by the droplets in the mixed fluid ejected to the liquid ejecting units 1A and 1B by the mixed fluid by which the opening of the nozzle 21 is blocked first being ejected to the liquid ejecting units 1A and 1B and becoming foamy. If pure water not including a preservative is used as the second liquid, it is possible to suppress such foaming.

Figure 15:
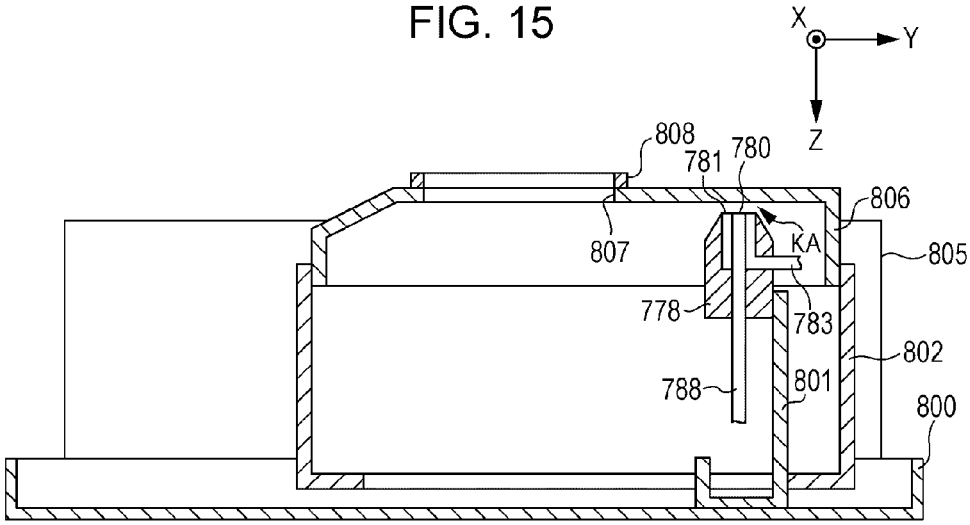
FIG. 15 is a side cross-sectional schematic view showing the standby state of the ejecting unit.

As shown in FIG. 15, after the cleaning of the clogged nozzle 21 of the liquid ejecting units 1A and 1B by the fluid ejecting device 775 is finished, the support member 801 is moved to the standby position in a state where the mixed fluid is ejected from the fluid ejecting nozzle 778, and the fluid ejecting nozzle 778 faces a position not corresponding to the through hole 807 in the upper wall of the cover member 806. At this time, a slight gap is formed between the fluid ejecting nozzle 778 and the upper wall of the cover member 806.

Thus, by the air ejected from the annular gas ejecting nozzle 781 that surrounds the liquid ejecting nozzle 780 striking the upper wall of the cover member 806 and flowing along the upper wall, the inside of the air ejected from the annular gas ejecting nozzle 781, that is the pressure on the upper side of the liquid ejecting nozzle 780 rises. The second liquid in the liquid flow channel 788*a* is pushed downward (to the storage tank 787 side) by the pressure rising on the upper side of the liquid ejecting nozzle 780. That is, the gas-liquid interface KK of the second liquid in the liquid flow channel 788*a* is in a state of being constantly pushed further downward than the mixing unit KA.

In this state, when the air pump 782 is stopped, air is not ejected from the gas ejecting nozzle 781. In this case, since the air pump 782 is stopped in a state where the gas-liquid interface KK of the second liquid in the liquid flow channel 788*a* is positioned further to the downward side than the mixing unit KA, the second liquid in the liquid flow channel 788*a* overflowing the mixing unit KA and entering the gas ejecting nozzle 781 is suppressed.

Thereafter, the printing unit 720 is moved to the home position HP, the second liquid, air bubbles or the like remaining in the liquid ejecting unit 1A and 1B are removed by suction cleaning or flushing the ink from the openings of each nozzle 21 of the liquid ejecting units 1A and 1B being performed. The suction cleaning or flushing at this time may be light with a small discharge amount (consumption amount) of ink. The reason for this is that, since the ejection of the mixed fluid to the clogged nozzle 21 is performed in a state where the ink in the pressure generating chamber 12 that communicates with the clogged nozzle 21 is pressurized as described above, entrance (back flow) of the mixed fluid into the interior of the liquid ejecting units 1A and 1B passing through the pressure generating chamber 12 is suppressed.

Second Embodiment

Next, the second embodiment of the liquid ejecting apparatus will be described with reference to the drawings.

Figure 16:
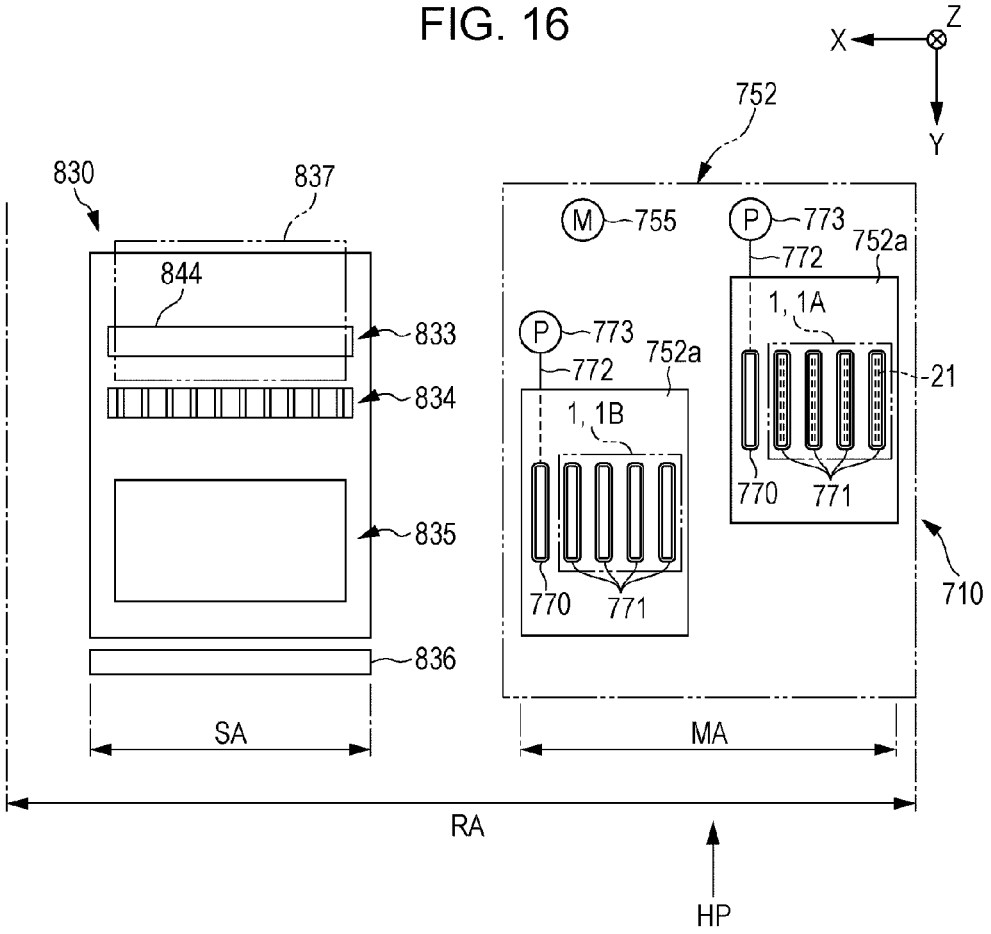
FIG. 16 is a schematic plan view showing a configuration of a maintenance apparatus of a second embodiment.

As shown in FIG. 16, in the second embodiment, the wiper unit 750 and the flushing unit 751 in the maintenance device 710 of the first embodiment are modified to a maintenance unit 830. Since configurations to which the same reference numerals at the first embodiment are applied in the second embodiments include the same configurations as the first embodiment, description thereof will not be provided, and description below will be provided focusing on the points of difference from the first embodiment.

Figure 17:
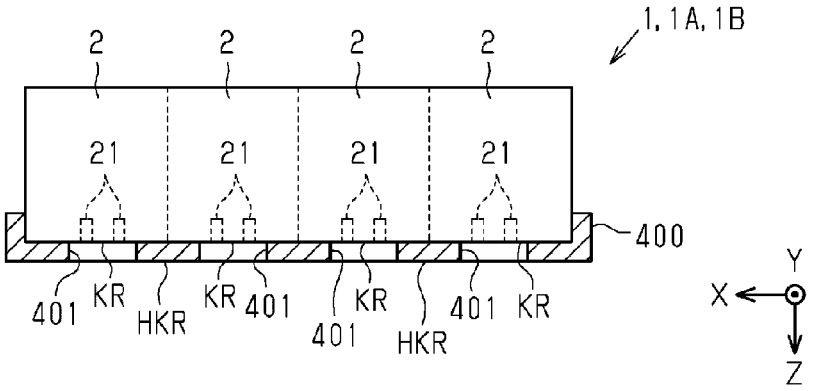
FIG. 17 is a cross-sectional schematic view of a liquid ejecting unit.

As shown in FIG. 17, the liquid ejecting unit 1 (1A and 1B) includes four head units 2 having the liquid ejecting surface 20*a* in which the nozzle 21 opens and the cover head 400 that collectively covers the liquid ejecting surfaces 20*a* that are the lower surfaces of the four head units 2. The four second exposure openings 401 exposing the nozzles 21 of the four head units 2 are provided passing through the cover head 400.

The region inside the second exposure opening 401 in the lower surface of the head unit 2 is defined as an opening region KR in which the nozzle 21 opens, and a region that does not include the opening region KR in the liquid ejecting unit 1 is defined as a non-opening region HKR. That is, in the present embodiment, a region of the lower surface of the liquid ejecting unit 1 that is not covered with the cover head 400 is the opening region KR and the lower surface of the cover head 400 is the non-opening region HKR. The liquid repellency of the opening region KR is set higher than the liquid repellency of the non-opening region HKR.

Figure 18:
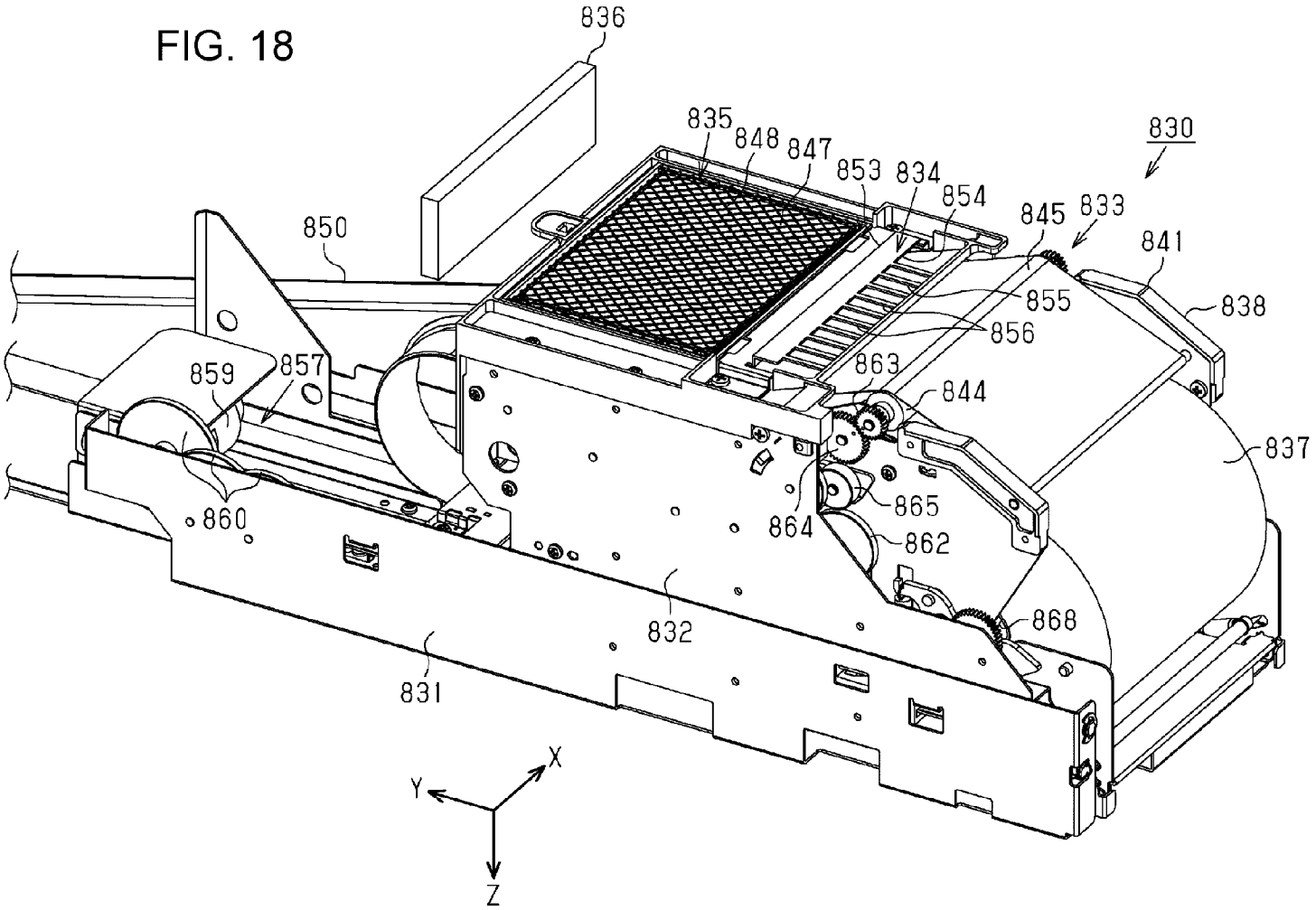
FIG. 18 is a perspective view of a maintenance unit.

As shown in FIGS. 16 and 18, the maintenance unit 830 is disposed at a setting region SA in the non-printing region RA and includes a base 831 extending in the transport direction Y and a base portion 832 is supported to be able to reciprocate in the transport direction Y by the base 831. Furthermore, the maintenance unit 830 includes a wiping unit 833, a fluid ejecting unit 834, a waste liquid receiving unit 835, and a recovering unit 836. The wiping unit 833, the fluid ejecting unit 834, and the waste liquid receiving unit 835 are provided in the base portion 832, and the recovering unit 836 is disposed above the base portion 832.

Figure 19:
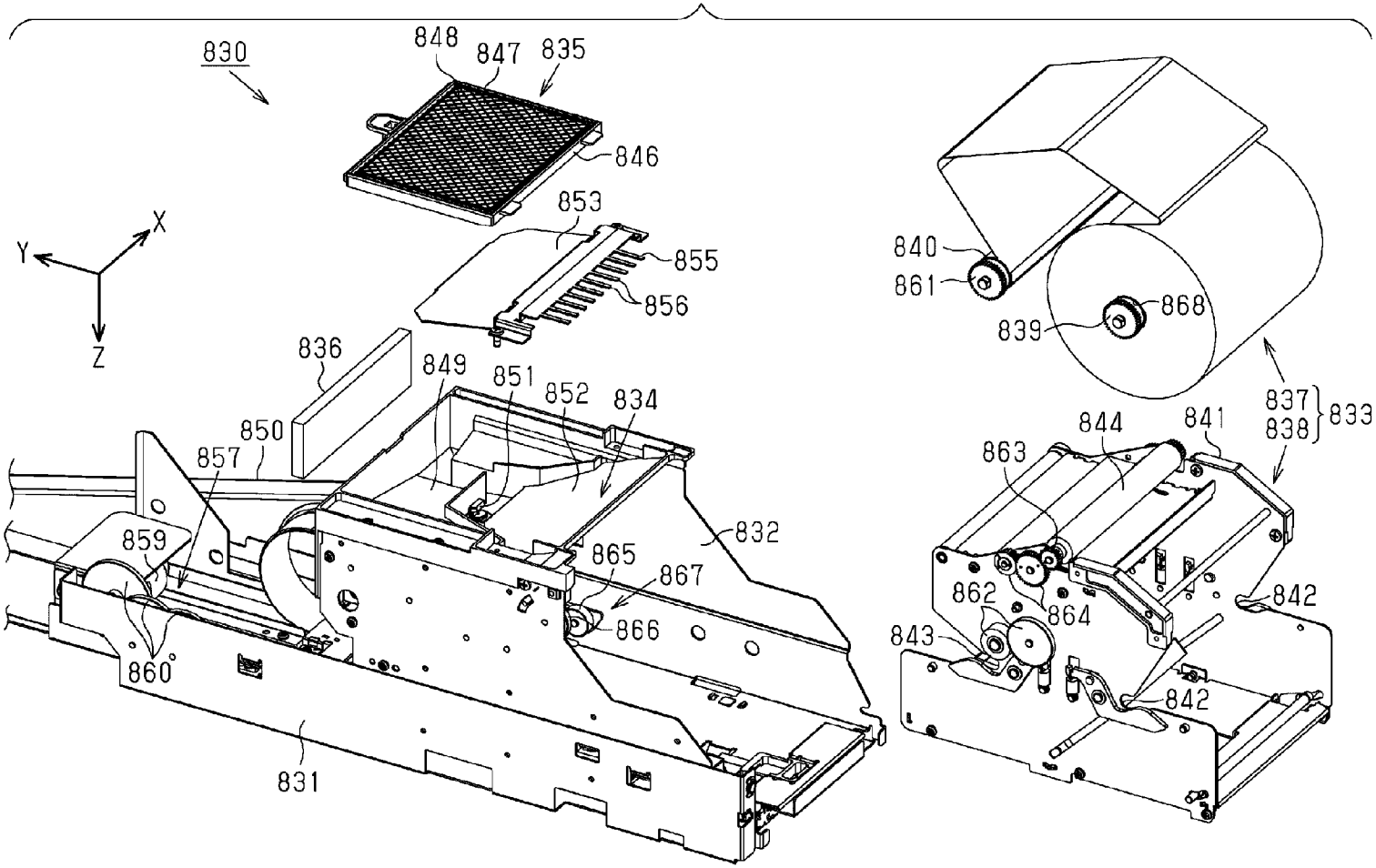
FIG. 19 is an exploded perspective view of FIG. 18.

As shown in FIGS. 18 and 19, the wiping unit 833 is configured so that the liquid ejecting unit 1 positioned in the setting region SA can be wiped by moving the base portion 832 in a wiping direction (that is the same as the transport direction Y, in the present embodiment), and the wiping unit 833 is detachably attached from the upstream side of the base portion 832 in the transport direction Y.

The wiping unit 833 includes a long strip-like cloth sheet 837 wound in a roll shape and a cloth holder 838 to which the cloth sheet 837 is detachably mounted. The cloth sheet 837 has absorbency to absorb the liquid or the like. The base end of the cloth sheet 837 is connected to a delivery shaft 839 extending in the scanning direction X and a tip end of the cloth sheet 837 is connected to a winding shaft 840 extending in the scanning direction X, and almost the cloth sheet 837 is wounded in the delivery shaft 839 in a state of a new cloth sheet. That is, the delivery shaft 839 supports an unused roll-like cloth sheet 837 and the winding shaft 840 supports the used roll-like cloth sheet 837.

The cloth holder 838 includes a winding potion 841 in which the cloth sheet 837 is wounded around the central portion in the transport direction Y, and the winding potion 841 has a substantially fan shape when viewed from the scanning direction X. A delivery shaft receiving unit 842 which rotatably supports the both end portion of the delivery shaft 839 is provided at the upper stream side of the winding potion 841 in the transport direction Y so as to paired in the scanning direction X and a winding shaft receiving unit 843 which rotatably supports the both end portion of the winding shaft 840 is provided so as to paired in the scanning direction X at the lower stream side of the winding potion 841 in the transport direction Y.

For example, a rubber pressing roller 844 extending in the scanning direction X is provided at the central portion of the winding potion 841 in the transport direction Y. The pressing roller 844 is disposed at the highest position in the winding potion 841. The cloth sheet 837 positioned between the delivery shaft 839 and the winding shaft 840 is wound on the upper surface of the pressing roller 844. A semi-cylindrical (convex) wiping member 845 is formed by a portion where the cloth sheet 837 is wound on the pressing roller 844. The wiping member 845 is in a state of being biased upward through the pressing roller 844 by a biasing member (not shown).

The two liquid ejecting units 1A and 1B are sequentially moved with respect to the setting region SA, and wiping on the two liquid ejecting units 1A and 1B is separately performed in one direction moved to the setting region SA by the wiping member 845 accompanying with the moving the base portion 832 in the wiping direction (same as the transport direction Y).

The waste liquid receiving unit 835 is detachably attached to the base portion 832 and includes a rectangular frame body 846, a rectangular plate-like liquid absorbing material 847 to be stored in the frame body 846, and a rectangular plate-like net body 848 which is disposed on the liquid absorbing material 847 for pressing the absorbing material 847. The frame body 846 is formed of a synthetic resin, the liquid absorbing material 847 is formed of, for example, a nonwoven fabric, and the net body 848 is formed of, for example, a stainless steel.

The waste liquid receiving unit 835 is disposed further to the downstream side than the wiping unit 833 in the wiping direction (same as the transport direction Y in the present embodiment) when the wiping unit 833 wipes the liquid ejecting unit 1. The waste liquid receiving unit 835 receives a waste ink (waste liquid) which is discharged from the opening of each nozzle 21 (refer to FIG. 17) by the flushing operation (maintenance operation) for performing flushing (maintenance) of the liquid ejecting unit 1 at the position facing the liquid ejecting unit 1.

A receiving recessed portion 849 for receiving the waste liquid flowing down from the waste liquid receiving unit 835 is formed at the down side of the waste liquid receiving unit 835 in the base portion 832. A waste liquid pip 850 is connected to the bottom portion of the receiving recessed portion 849 and the waste ink flowing down to the receiving recessed portion 849 is collected in the waste liquid collecting container (not shown) through the waste liquid pip 850.

The fluid ejecting unit 834 is disposed between the wiping unit 833 and the receiving recessed portion 849 in the base portion 832. The fluid ejecting unit 834 includes an ejecting port 851 able to eject the fluid including a second liquid with respect to the liquid ejecting unit 1 and a stainless steel path forming plate 853 for covering the ejecting port 851 and for forming a liquid path 852 of the fluid to be ejected from the ejecting port 851.

The ejecting port 851 of the present embodiment is configured by a fan-shaped nozzle for ejecting the second liquid so as to spread in a fan shape. A supplying pip (not shown) for supplying the fluid including the second liquid is connected to the ejecting port 851 and an ejecting pump (not shown) for ejecting the fluid from the ejecting port 851 is provided in the supplying pipe. The ejecting pump (not shown) is driven and controlled by the controller 810 (refer to FIG. 13)

The path 852 extends obliquely upward toward the wiping unit 833 side and the tip end of the path 852 servers as an ejecting opening portion 854 through which the fluid is ejected from the inside the path 852 to the outside the path 852. The ejecting opening portion 854 is positioned between the wiping unit 833 and the waste liquid receiving unit 835 in the base portion 832. A part of the ejecting opening portion 854 is shield by a comb teeth shielding mechanism 855 formed on the path forming plate 853.

The shielding mechanism 855 includes a plurality of thin shielding plates 856 arranged at equal intervals in the scanning direction X across the ejecting opening portion 854 and extending along the transport direction Y. The plurality of shielding plates 856 are disposed so as to shield the fluid toward the opening region KR (refer to FIG. 17) when fluid ejecting is performed to the liquid ejecting unit 1 moved to the setting region SA through the path 852 and the ejecting opening portion 854 from the ejecting port 851.

The recovering unit 836 is configured by, for example, a rectangular plate-like rubber blade or the like, and fixed to the printer main body 11*a* (refer to FIG. 1). By contacting the waste liquid receiving unit 835, the collection unit 836 collects the waste ink to be stored in the waste liquid receiving unit 835 or the accumulated material thereof so as to be scraped off. That is, by moving the waste liquid receiving unit 835 accompanying to the moving of the base portion 832 in the transport direction Y, the collection unit 836 slides on the net body 848 so as to remove the waste liquid or the accumulated material thereof attached on the net body 848 of the waste liquid receiving unit 835 by the moving of the waste liquid receiving unit 835 along with the movement of the base portion 832 in the transport direction Y.

Figure 20:
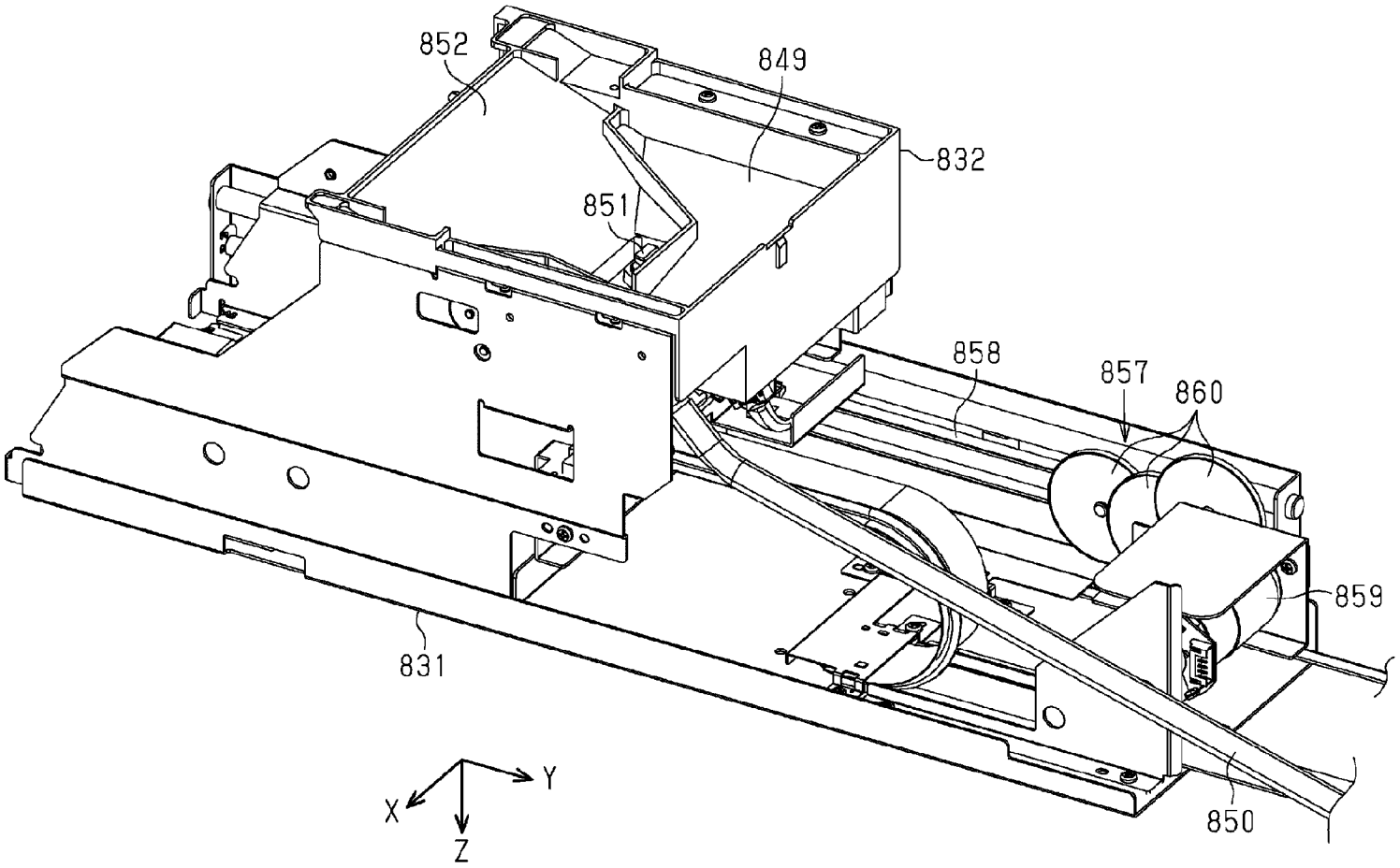
FIG. 20 is an enlarged view of a main portion of FIG. 19.

As shown in FIG. 20, a relative moving mechanism 857 which reciprocates the base portion 832 in the transport direction Y is provided in the base 831. The relative moving mechanism 857 includes a pair of pulley (not shown) rotatably provided at both end portions in the transport direction Y on the inner side surface of the base 831, an endless timing belt 858 wounded around the pair of pulleys, a movement motor 859, a reduction gear group 860 that transmits the rotational driving force of the movement motor 859 to the pair of pulleys. The movement motor 859 is driven and controlled by the controller 810 (refer to FIG. 13).

A part of the timing belt 858 is connected to the base portion 832 and the base portion 832 is reciprocated in the transport direction Y by moving the timing belt 858 due to the driving of the movement motor 859. In this case, since the base portion 832 holds the wiping unit 833 and the waste liquid receiving unit 835, by moving the base portion 832 to the liquid ejecting unit 1 and the collection unit 836 by the relative moving mechanism 857 in a state where the liquid ejecting unit 1 is moved to the setting region SA, the wiping unit 833 and the waste liquid receiving unit 835 can be moved to the liquid ejecting unit 1 and the collection unit 836.

By moving the base portion 832 in the transport direction Y that is the movement direction thereof, the relative moving mechanism 857 relatively moves the wiping unit 833 and the waste liquid receiving unit 835, and the liquid ejecting unit 1 and the collection unit 836 in the wiping direction (same as the transport direction Y) where the wiping unit 833 wipes the liquid ejecting unit 1.

Figure 24:
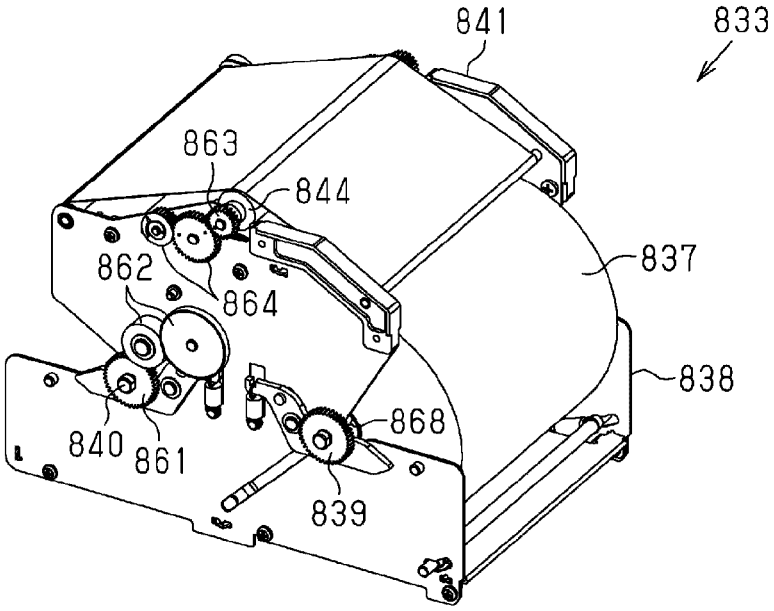
FIG. 24 is a perspective view of the wiping unit after the cloth sheet is attached to the cloth holder.

As shown in FIGS. 19 and 24, two first transmission gears 862 which are meshed with a winding gear 861 which is provided at one end portion of the winding shaft 840 of the cloth sheet 837 mounted on the cloth holder 838 and two second transmission gears 864 which are meshed with a pressing gear 863 which is provided at the one end portion of the pressing roller 844 are provided at one side surface of the cloth holder 838 of the wiping unit 833 in the scanning direction X. A transmission gear group 865 which is meshed with the first transmission gears 862 and the second transmission gears 864 when the wiping unit 833 is mounted on the base portion 832 and a winding driving mechanism 867 including a winding motor 866 for rotatably driving the transmission gear group 865 are provided in the base portion 832. The winding motor 866 is driven and controlled by the controller 810 (refer to FIG. 13).

When the winding motor 866 of the winding driving mechanism 867 is driven, the rotational driving force is transmitted to the first transmission gears 862 and the second transmission gears 864, respectively through the transmission gear group 865. Since the first transmission gears 862 and the second transmission gears 864 are rotated, the winding gear 861 and the pressing gear 863 are rotated. Accordingly, the winding shaft 840 and the pressing roller 844 is synchronously rotated in a direction in which the cloth sheet 837 is wound and the cloth sheet 837 is wound by the winding shaft 840. At this time, since the sliding between the pressing roller 844 and the cloth sheet 837 is suppressed, abrasion of the pressing roller 844 is suppressed.

Next, a method for mounting the cloth sheet 837 on the cloth holder 838 will be described.

Figure 21:
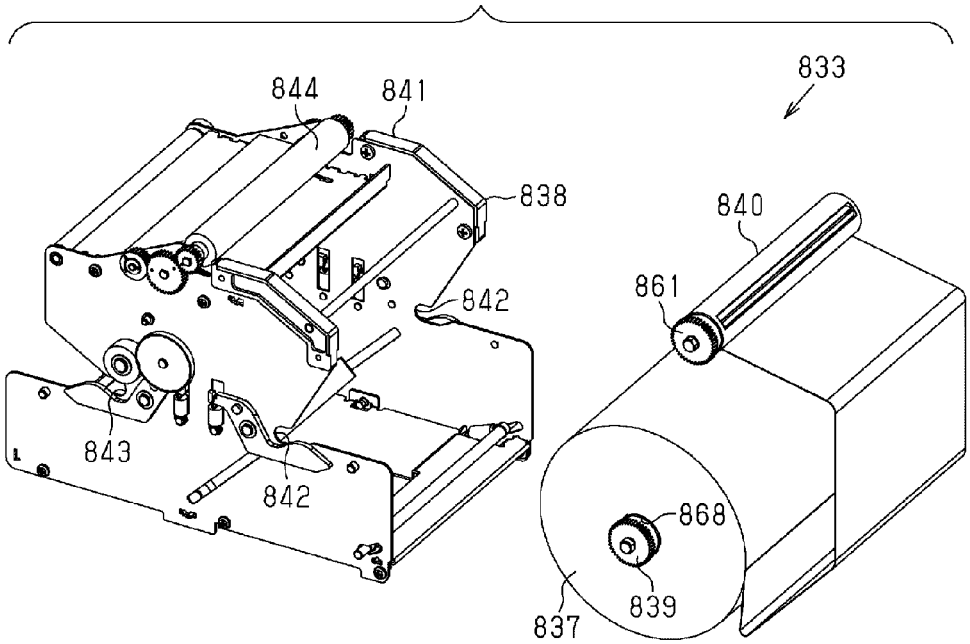
FIG. 21 is a perspective view of a wiping unit before a cloth sheet is attached to a cloth holder.
Figure 22:
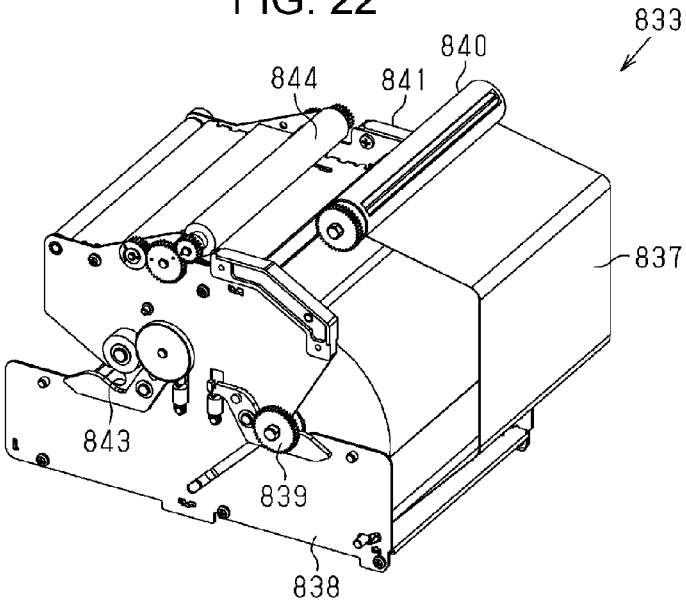
FIG. 22 is a perspective view of the wiping unit when the cloth sheet is attached to the cloth holder.

As shown in FIG. 21, in a case where the cloth sheet 837 is mounted on the cloth holder 838, firstly, the delivery shaft 839 is inserted to a central hole 868 of the unused roll-like cloth sheet 837 and the winding shaft 840 is attached to the tip end of the cloth sheet 837 slightly unwound from the delivery shaft 839. Subsequently, as shown in FIG. 22, when the both end portion of the delivery shaft 839 is supported to the pair of the delivery shaft receiving units 842, the unused roll-like cloth sheet 837 is set on one end side in the cloth holder 838.

Figure 23:
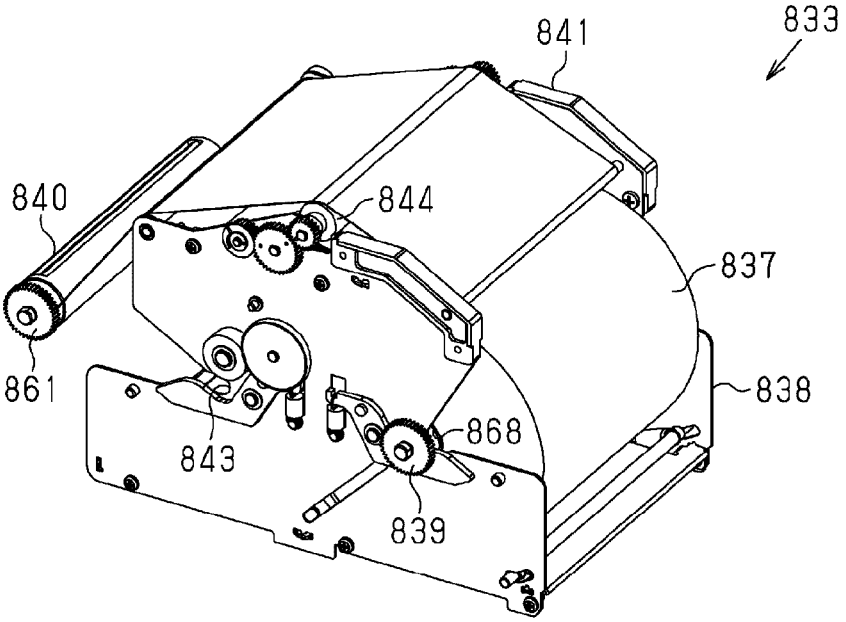
FIG. 23 is a perspective view of the wiping unit when the cloth sheet is attached to the cloth holder.

Subsequently, as shown in FIG. 23, the cloth sheet 837 is delivered from the delivery shaft 839, the delivered cloth sheet 837 is wound around the entire the winding potion 841 including the upper surface of the pressing roller 844 from the upside. Subsequently, as shown in FIG. 24, the both end portion of the winding shaft 840 is supported to the pair of the winding shaft receiving unit 843 positioned at a side opposing the side where the unused roll-like cloth sheet 837 is set in the cloth holder 838. Accordingly, the mounting work of the cloth sheet 837 to the cloth holder 838 is complied. In a case where the cloth sheet 837 is removed from the cloth holder 838 in which the cloth sheet 837 is mounted, the mounting work of the cloth sheet 837 to the cloth holder 838 may be performed in the reverse procedure.

Next, a maintenance operation that performs maintenance of the liquid ejecting unit 1 in the liquid ejecting apparatus 7 will be described.

Figure 25:
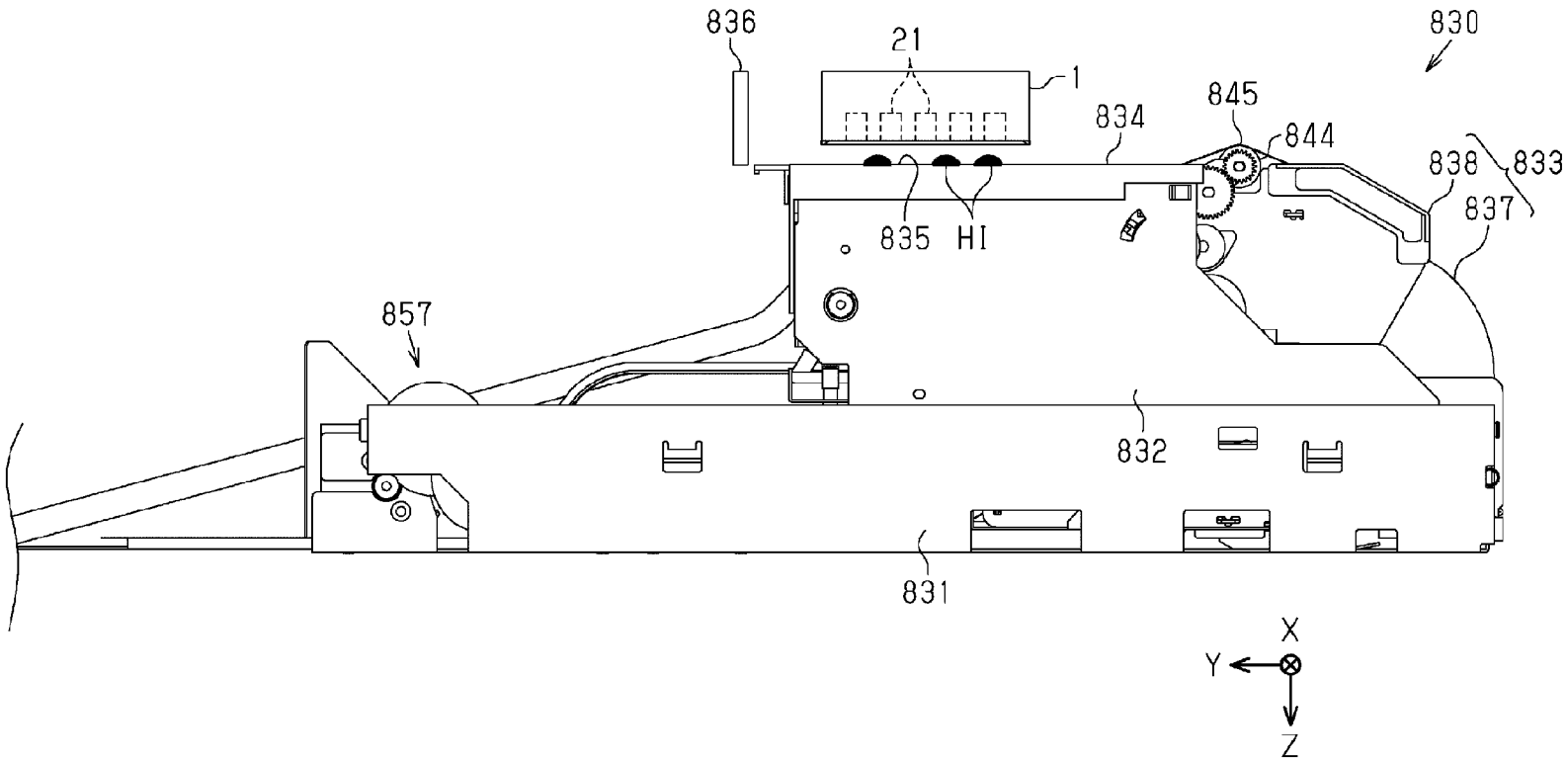
FIG. 25 is a side schematic view showing a state where the liquid ejecting unit is moved to the setting region.

As shown in FIG. 25, in a case where the maintenance of the liquid ejecting unit 1 is performed, firstly, the carriage 723 is moved by driving the carriage motor 748 configuring the movement mechanism in a state where the base portion 832 stands at the standby position (the position shown in FIG. 25), and the liquid ejecting unit 1 is moved to the setting region SA. That is, the liquid ejecting unit 1 is moved to the position where the liquid ejecting unit 1 can face the waste liquid receiving unit 835 and the wiping unit 833. When flushing for ejecting (discharging) the ink as a waste ink HI (waste liquid) to the waste liquid receiving unit 835 from the nozzle 21 of the liquid ejecting unit 1 independently from printing in a state where the liquid ejecting unit 1 faces the waste liquid receiving unit 835 is performed, the meniscus in the nozzle 21 is adjusted.

Figure 26:
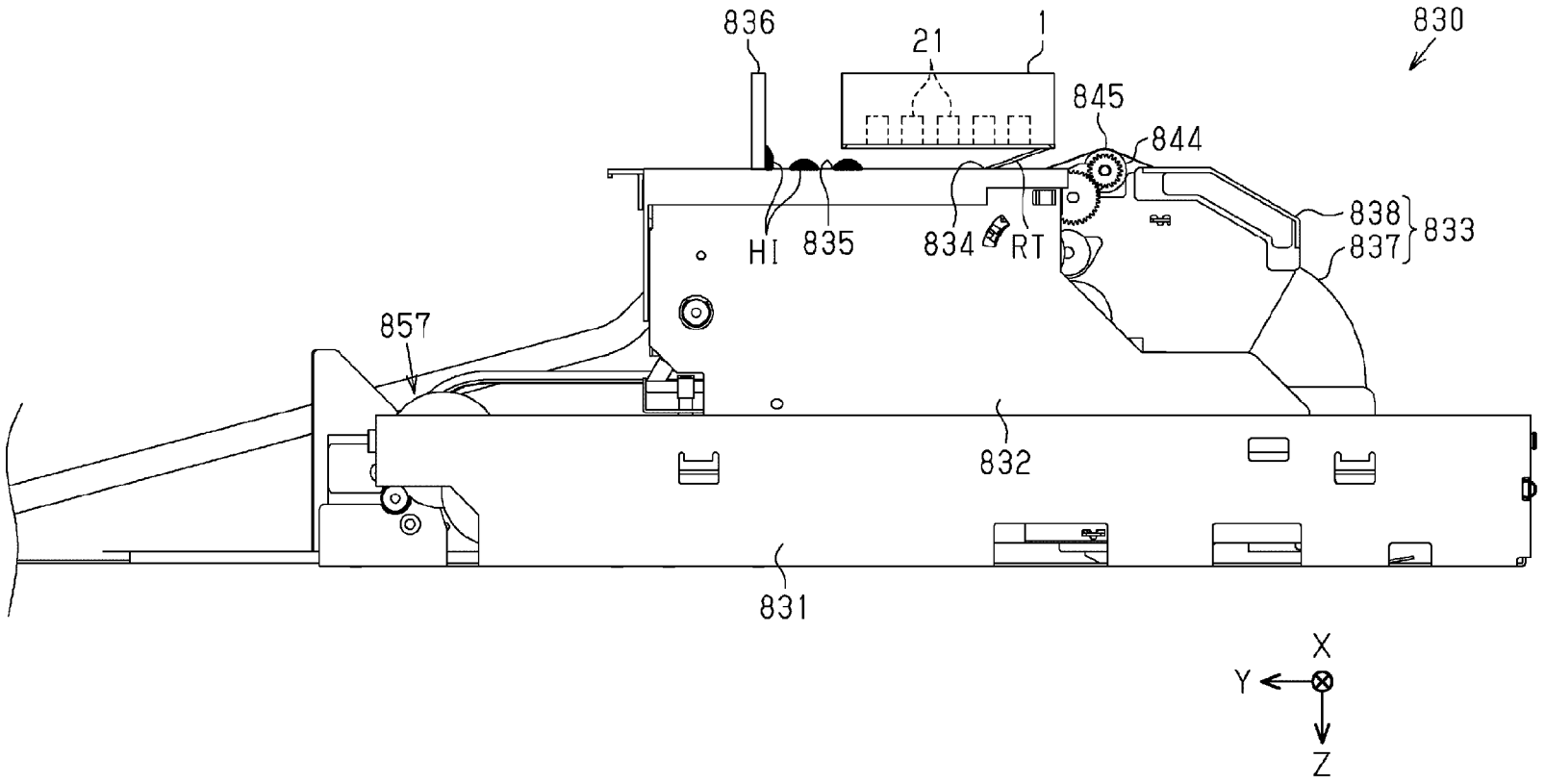
FIG. 26 is a side schematic view showing a state where a fluid ejecting unit ejects a fluid to the liquid ejecting unit.

When performing the flushing, a part of the received waste ink HI is accumulated on the net body 848 of the waste liquid receiving unit 835. When the waste ink HI stored on the net body 848 is dried, the waste ink HI is thickened or solidified to become an accumulated material, and remains on the net body 848. Subsequently, as shown in FIG. 26, when moving the base portion 832 in the transport direction Y by the relative moving mechanism 857, the waste ink HI on the net body 848 starts to be recovered so as to be scraped off by the collection unit 836. At this time, the fluid RT is obliquely ejected from the fluid ejecting unit 834 toward the end portion of the upstream side of the lower surface of the liquid ejecting unit 1 in the transport direction Y and the fluid ejecting to the liquid ejecting unit 1 is started.

In this case, the fluid ejecting unit 834 ejects the fluid RT obliquely upward toward the side opposite to the transport direction Y that is the movement direction of the base portion 832. In addition, the fluid RT of the present embodiment is formed of only the second liquid. The fluid RT may be formed by a mixed fluid which is obtained by mixing the second liquid and a gas such as air. After the fluid RT to be ejected and flown down to the liquid ejecting unit 1 is flown from the ejecting opening portion 854 to the path 852, the fluid RT and the waste ink HI are discharged and recovered to the waste liquid covering container (not shown) through the waste liquid pip 850 via the receiving recessed portion 849.

Figure 27:
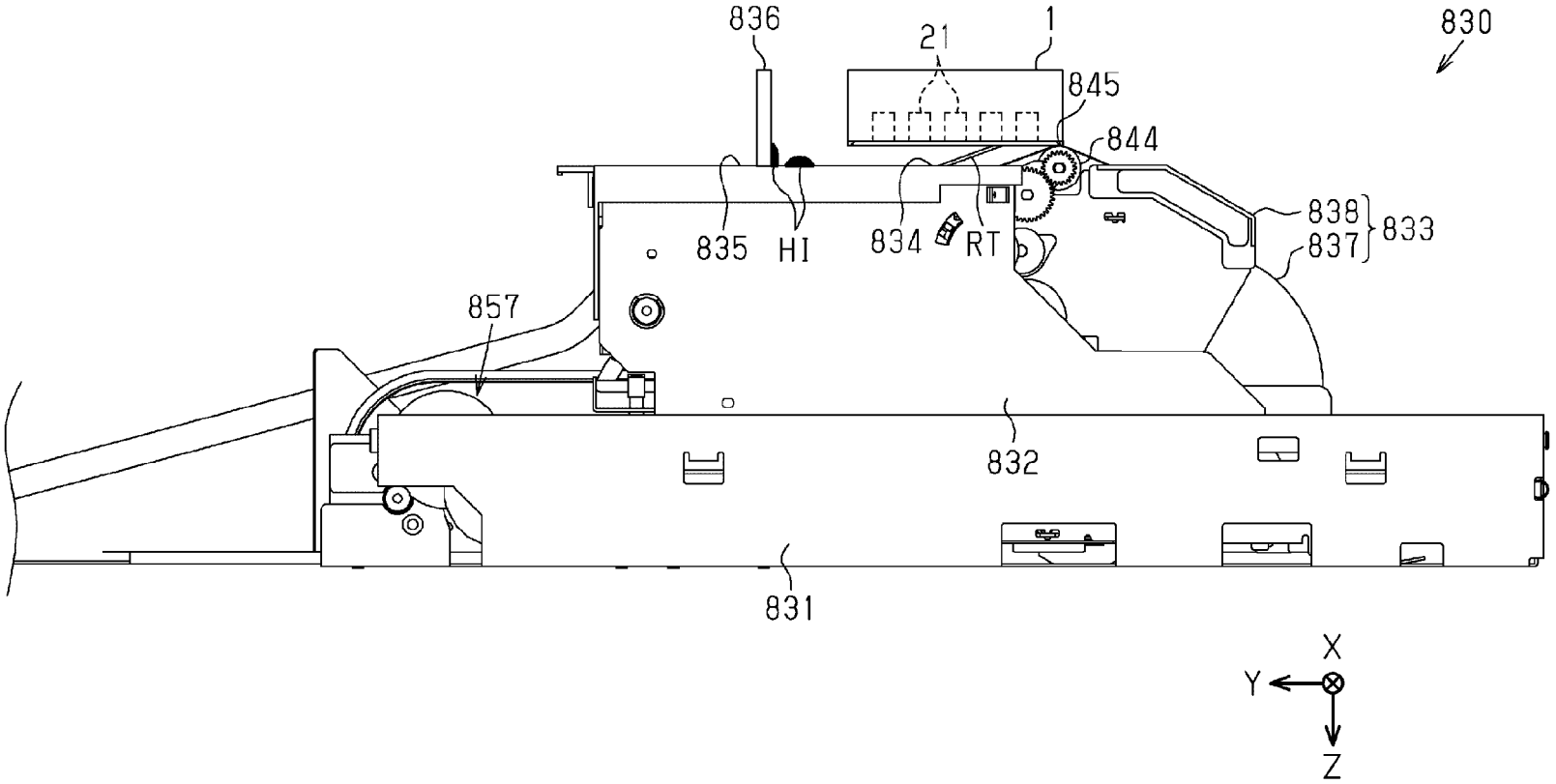
FIG. 27 is a side schematic view showing a state when the wiping unit wipes the liquid ejecting unit.

Subsequently, as shown in FIG. 27, when the relative moving mechanism 857 moves the base portion 832 in the transport direction Y, the waste ink HI on the net body 848 is recovered by further scraping off by the collection unit 836. At this time, the position of the fluid RT ejected onto the lower surface of the liquid ejecting unit 1 accompanying with the moving of the base portion 832 in the transport direction Y also moves in the transport direction Y. Furthermore, at this time, the wiping member 845 is in contact with the end portion of the upstream side in the transport direction Y in the lower surface of the liquid ejecting unit 1, the wiping operation of the wiping unit 833 with respect to the lower surface of the liquid ejecting unit 1 is started.

Figure 28:
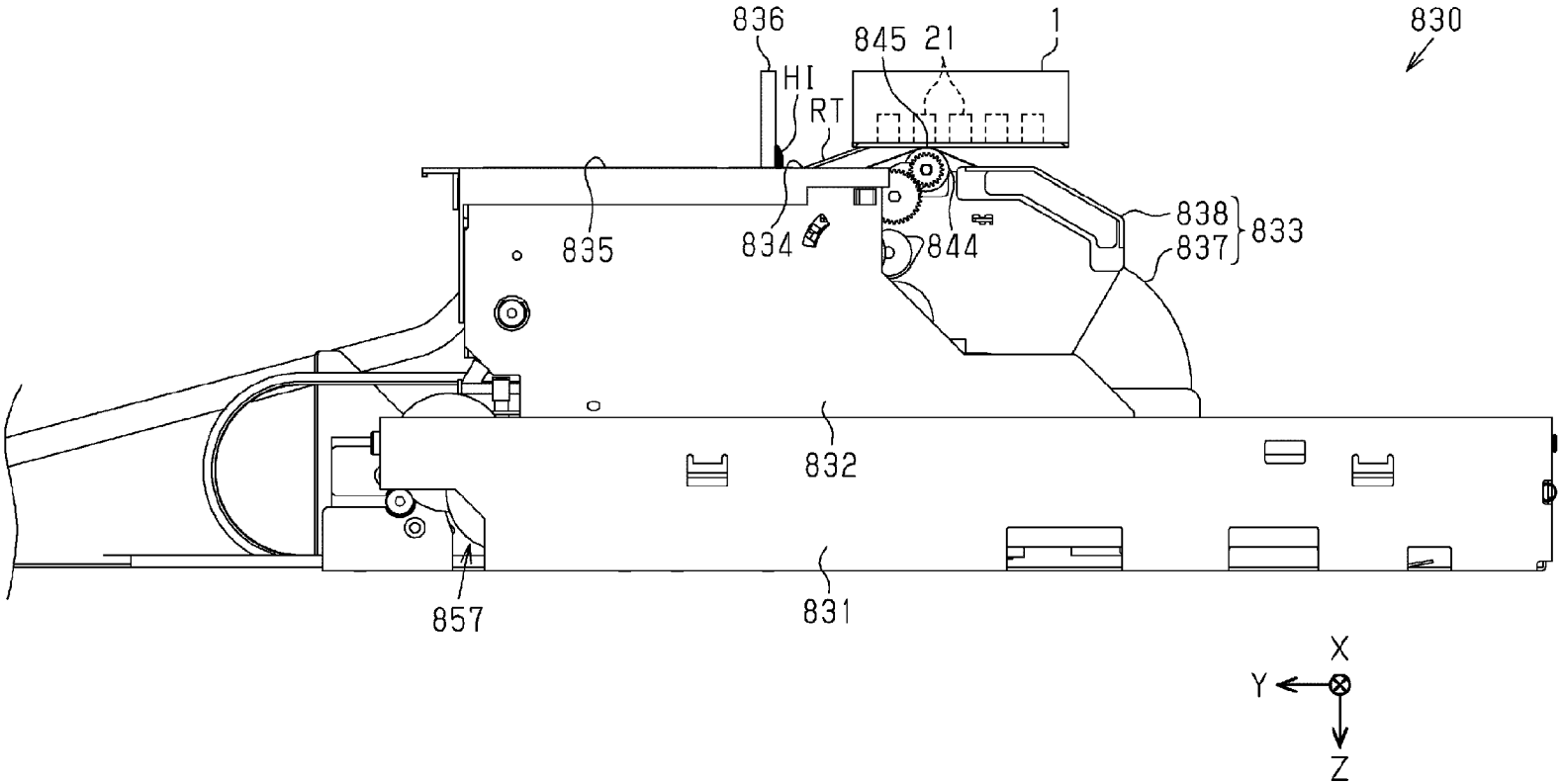
FIG. 28 is a side schematic view showing a state where the wiping unit is wiping the liquid ejecting unit.

Subsequently, as shown in FIG. 28, when the relative moving mechanism 857 moves the base portion 832 in the transport direction Y, the waste ink HI on the net body 848 is recovered by being scraped off by the collection unit 836. Therefore, the accumulated material of the waste ink HI on the net body 848 is suppressed from being contacted with the liquid ejecting unit 1. In addition, the waste ink HI recovered by the collection unit 836 is attached to the collection unit 836. At this time, the position of the fluid RT to be ejected on the lower surface of the liquid ejecting unit 1 accompanying with the moving to the transport direction Y of the base portion 832 is moved to the end portion of the downstream side of the transport direction Y in the lower surface of the liquid ejecting unit 1, and the fluid ejecting to entire the lower surface of the liquid ejecting unit 1 is completed. That is, ejecting of the fluid RT from the fluid ejecting unit 834 is stopped.

Furthermore, at this time, the wiping member 845 contact with the lower surface of the liquid ejecting unit 1 is moved with respect to the liquid ejecting unit 1 of the wiping unit 833 accompanying with the moving of the base portion 832, the lower surface of the liquid ejecting unit 1 slides in the transport direction Y to wipe the lower surface. That is, as the maintenance operation of the liquid ejecting unit 1, wiping the lower surface of the liquid ejecting unit 1 by the wiping member 845 is performed after the fluid ejecting is performed at the lower surface of the liquid ejecting unit 1.

Figure 32:
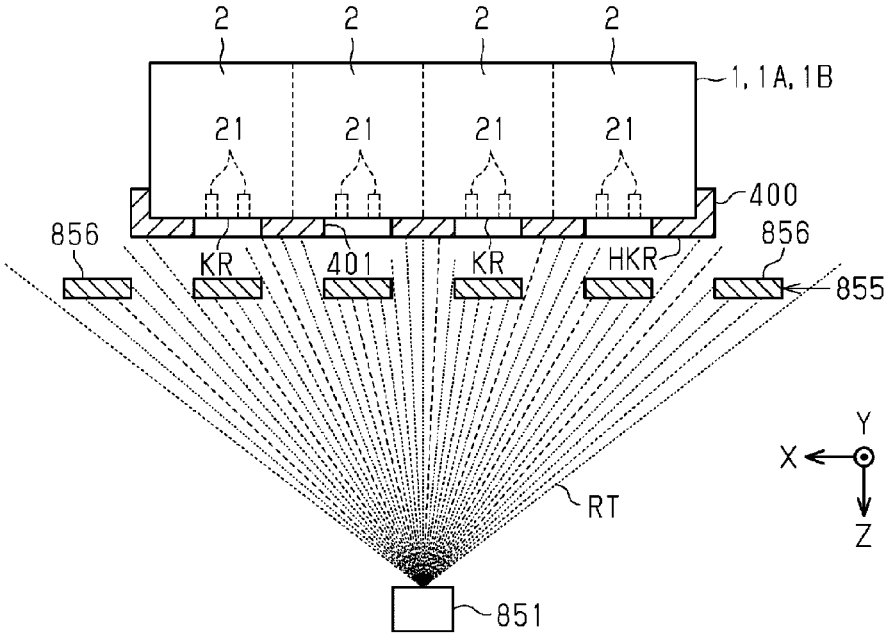
FIG. 32 is a side schematic view showing a state where a part of the fluid ejected to the liquid ejecting unit from an ejecting port is shield by a shielding mechanism.

Here, ejecting of the fluid RT to the lower surface of the liquid ejecting unit 1 by the fluid ejecting unit 834 will be described. As shown in FIG. 32, the fluid RT is ejected toward the lower surface of the liquid ejecting unit 1 in a state where the fluid RT is spread in a fan shape from the ejecting port 851 in the scanning direction X. At this time, the fluid RT toward the opening region KR of the liquid ejecting unit 1 is shield by the plurality of shielding plates 856 of the shielding mechanism 855 and the fluid RT ejected from the ejecting port 851 is directed to the non-opening region HKR.

That is, the fluid ejecting unit 834 performs fluid ejecting that positively ejects the fluid RT to the non-opening region HKR as the maintenance operation for performing maintenance of the liquid ejecting unit 1. In this case, the fluid RT is scattered by hitting the non-opening region HKR and a part of the fluid RT is applied to the opening region KR. However, since the fluid RT ejected from the ejecting port 851 rarely directly applied to the opening region KR, the fluid RT is suppressed from entering the nozzle 21 and destroying the meniscus.

Figure 29:
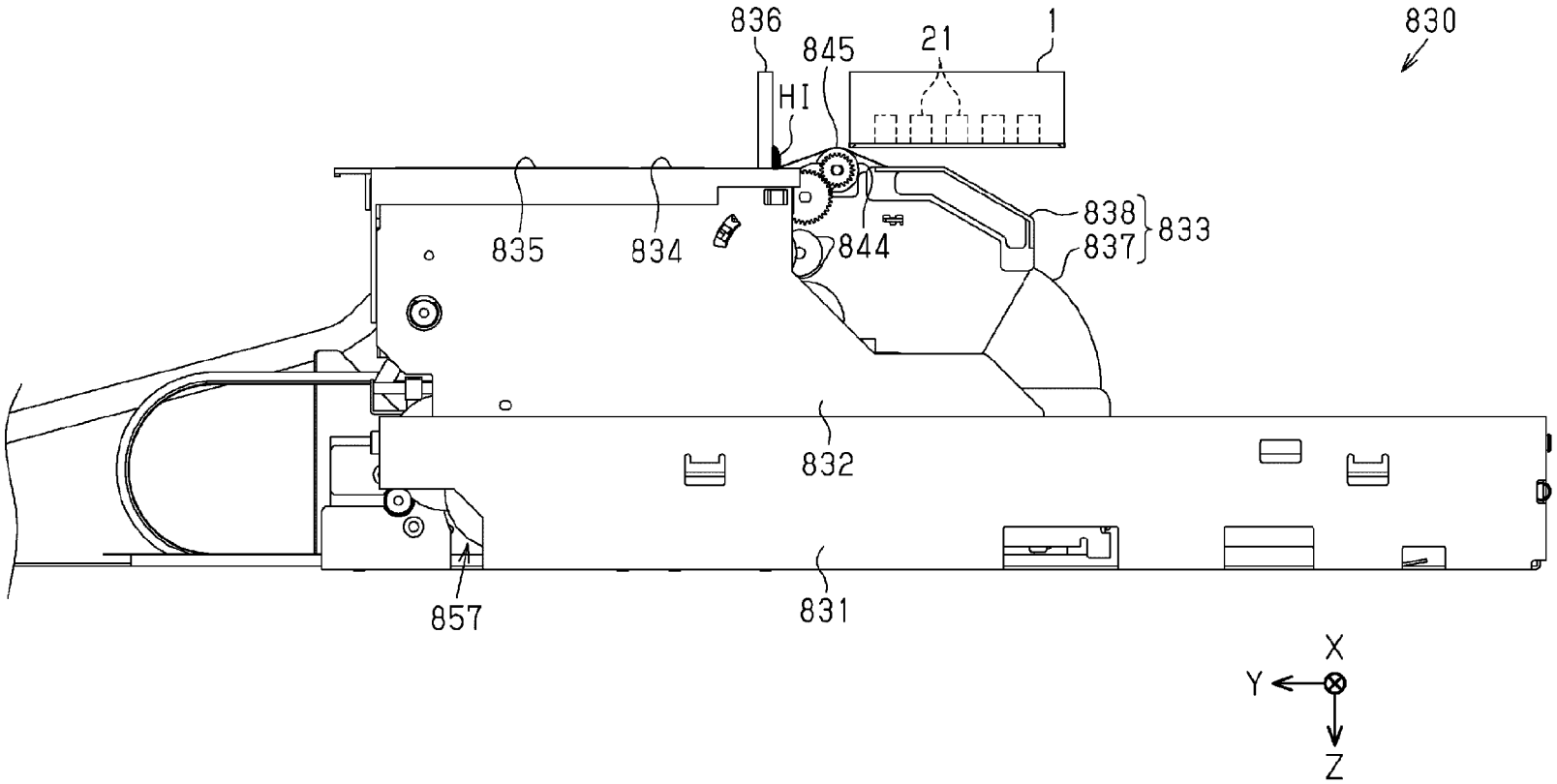
FIG. 29 is a side schematic view showing a state when the wiping unit completes wiping the liquid ejecting unit.

Subsequently, as shown in FIG. 29, when the relative moving mechanism 857 moves the base portion 832 in the transport direction Y, the wiping member 845 in contact with the lower surface of the liquid ejecting unit 1 passes the liquid ejecting unit 1. Accordingly, wiping of entire the lower surface of the liquid ejecting unit 1 by the wiping member 845 is ended, the maintenance of the liquid ejecting unit 1 is completed.

Figure 33:
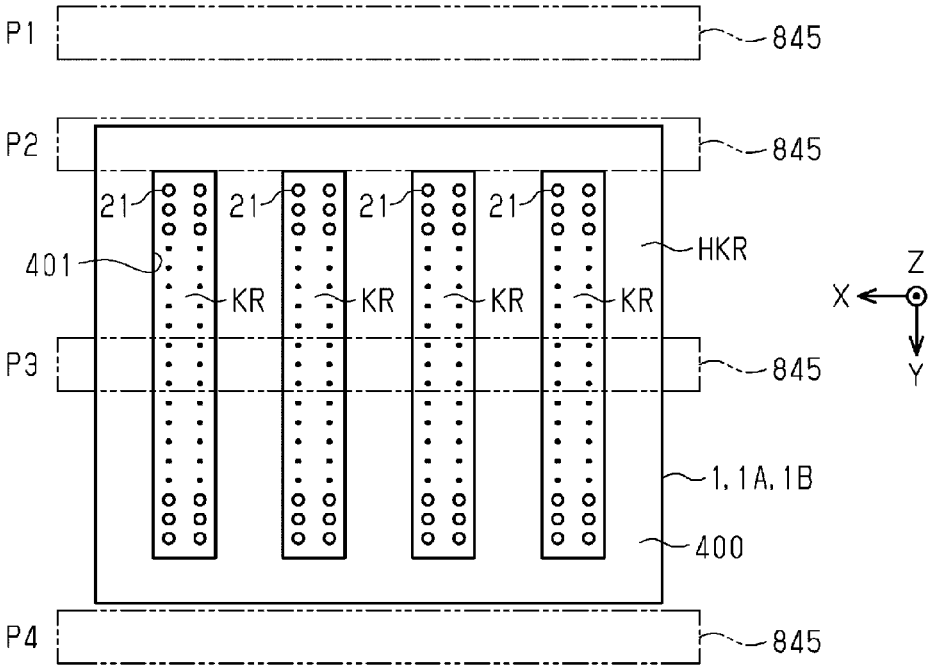
FIG. 33 is a bottom schematic view showing a state when a wiping member wipes the liquid ejecting unit.

Here, wiping of the lower surface of the liquid ejecting unit 1 by the wiping member 845 will be described in detail. As shown in FIG. 33, after fluid ejecting is performed as the maintenance operation as described above, the lower surface of the liquid ejecting unit 1 is wiped by moving the wiping member 845 to a P1 position, a P2 position, a P3 position, and a P4 position in this order along the transport direction Y. Accordingly, the lower surface of the liquid ejecting unit 1 is wiped by the wiping member 845 in a state where the lower surface is wet with the fluid RT (second liquid).

In a case where the wiping of the lower surface of the liquid ejecting unit 1 is performed, the wiping member 845 is firstly in contact with the lower surface of the liquid ejecting unit 1 in the P2 position. That is, the wiping member 845 is firstly in contact with the end portion of the upstream side in the transport direction Y that is the non-opening region HKR in the lower surface of the liquid ejecting unit 1. That is, the wiping member 845 wipes the opening region KR in a state where the fluid RT (second liquid) attached to the non-opening region HKR is absorbed by wiping the non-opening region HKR. Accordingly, since the wiping member 845 wipes the opening region KR that is a wiping target unit in a state where the wiping member 845 is wet with the fluid RT (second liquid), damage caused by the wiping member 845 to the opening region KR when the wiping member 845 wipes the opening region KR is reduced.

Figure 30:
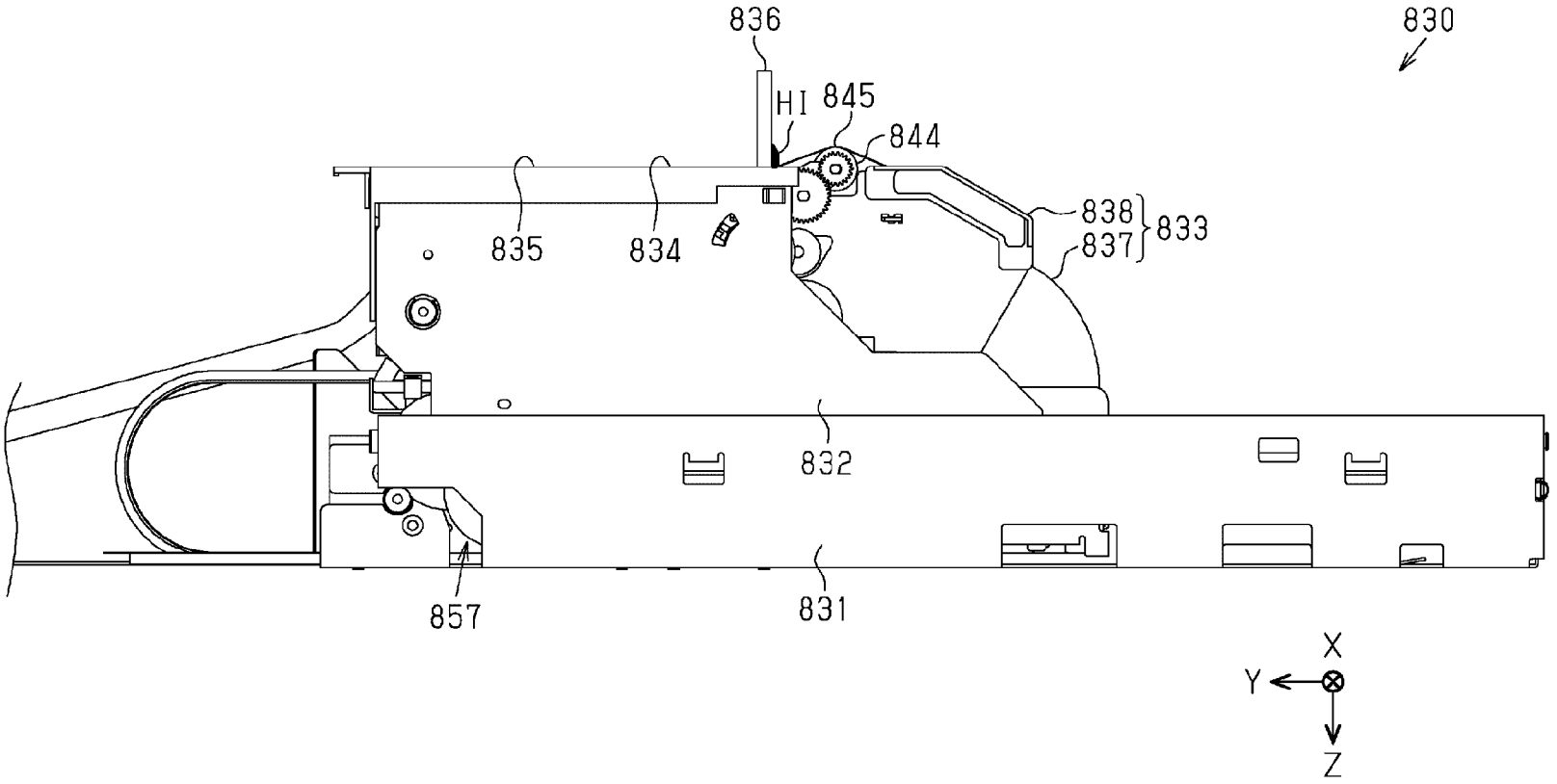
FIG. 30 is a side schematic view showing a state when the liquid ejecting unit is retreated from the setting region.

Subsequently, as shown in FIG. 30, the carriage 723 is moved by driving the carriage motor 748 configuring the movement mechanism to retreat the liquid ejecting unit 1 from the position facing the setting region SA (refer to FIG. 16) that is a region where the base portion 832 moves.

Figure 31:
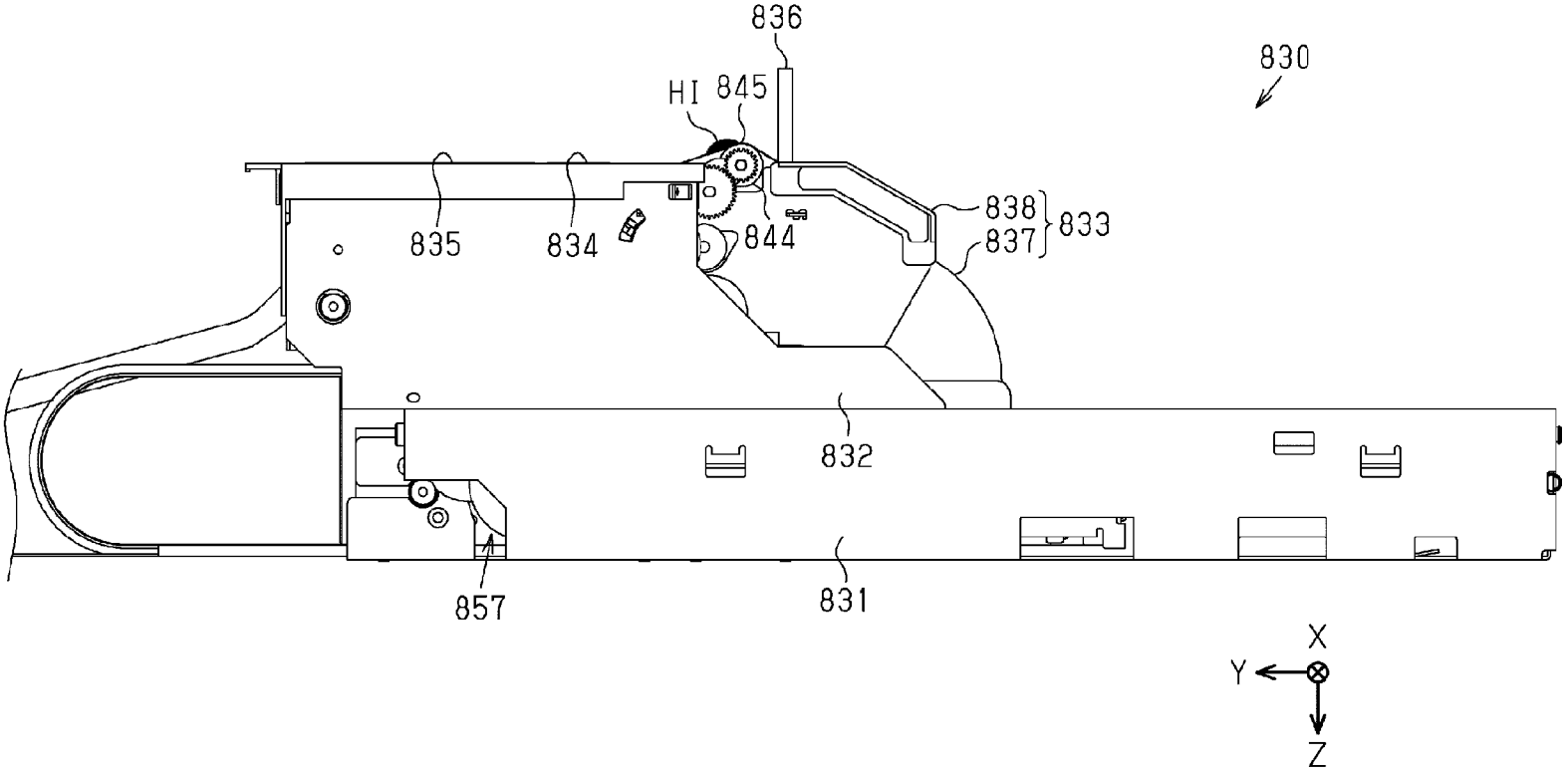
FIG. 31 is a side schematic view showing a state when the wiping unit wipes the collection unit.

Subsequently, as shown in FIG. 31, when the relative moving mechanism 857 moves the base portion 832 in the transport direction Y, a portion (unused portion) at the downstream side in the transport direction Y further than the wiping member 845 in the wiping member 845 and the cloth sheet 837 of the wiping unit 833 passes through the collection unit 836 while contacting the collection unit 836.

At this time, the pressing roller 844 is temporarily pressed down by the collection unit 836 through the cloth sheet 837 against biasing force of the biasing member (not shown) and the pressing roller 844 returns from the position pressed by the biasing force of the biasing member (not shown) to the original position after the pressing roller 844 passes through the collection unit 836. Accordingly, the waste ink HI which is attached and collected on the collection unit 836 is wiped by the cloth sheet 837 and the waste ink HI is removed from the collection unit 836. Therefore, the wiping unit 833 wipes the waste ink HI which is collected by the collection unit 836 after the lower surface of the liquid ejecting unit 1 is wiped.

Subsequently, by winding the cloth sheet 837 in a predetermined amount (for example, 10 mm) by rotating the winding shaft 840, the used wiping member 845 that is a portion where the cloth sheet 837 is wound the pressing roller 844 to the winding shaft 840 side, and the wiping member 845 is configured of the unused cloth sheet 837. Thereafter, the base portion 832 is moved by the relative moving mechanism 857 in a direction facing the transport direction Y and the base portion 832 returns to the standby position (position shown in FIG. 25).

According to the above-described second embodiment, the following effects can be obtained.

(1) The liquid ejecting apparatus 7 performs fluid ejecting for ejecting the fluid RT to the non-opening region HKR by the fluid ejecting unit 834 as the maintenance operation for performing maintenance of the liquid ejecting unit 1. Accordingly, since the fluid ejecting is performed to the opening region KR in which the nozzle 21 opens, the maintenance of the liquid ejecting unit 1 can be performed by the fluid ejecting without breaking the meniscus inside the nozzle 21.

(2) In the liquid ejecting apparatus 7, after the fluid ejecting performed with respect to the liquid ejecting unit 1 by the fluid ejecting unit 834 as the maintenance operation, the wiping member 845 wipes the liquid ejecting unit 1. Accordingly, since wiping can be performed by the wiping member 845 in a state where the fluid RT (second liquid) is attached to a region including the nozzle 21 of the liquid ejecting unit 1 by the liquid ejecting, the damage to be applied to the region including the nozzle 21 of the liquid ejecting unit 1 can be reduced by the wiping member 845 and wiping performance (wiping effect) in the wiping member 845 can be improved.

(3) In the liquid ejecting apparatus 7, the wiping member 845 has absorbency. Accordingly, after the fluid ejecting is performed to the liquid ejecting unit 1, various types of liquids such as the ink or the second liquid attached on the region including the nozzle 21 in the liquid ejecting unit 1 can be suitably absorbed and removed by the wiping member 845.

(4) In the liquid ejecting apparatus 7, after the fluid ejecting is performed to the liquid ejecting unit 1 by the fluid ejecting unit 834 as the maintenance operation, the wiping member 845 firstly wipes the non-opening region HKR in the liquid ejecting unit 1. Accordingly, since the wiping member 845 wipes the non-opening region HKR to wipe the opening region KR in a state where the opening region KR is wet with the fluid RT (second liquid), the damage to be applied to the opening region KR by the wiping member 845 can be reduced and the wiping performance (wiping effect) of the wiping member 845 can be improved.

(5) When the fluid ejecting is performed to the liquid ejecting unit 1 by the fluid ejecting unit 834, the liquid ejecting apparatus 7 includes the shielding mechanism 855 for shielding the fluid RT directed to the opening region KR. Accordingly, when the fluid ejecting is performed to the non-opening region HKR by the fluid ejecting unit 834, applying fluid RT to the opening region KR can be suppressed by the shielding mechanism 855.

(6) In the liquid ejecting apparatus 7, the liquid repellency of the opening region KR in the liquid ejecting unit 1 is higher than the liquid repellency of the non-opening region HKR. Accordingly, the fluid RT (second liquid) attached on the non-opening region HKR can be suppressed from being reached to the nozzle 21 of the opening region KR.

(7) In the liquid ejecting apparatus 7, the wiping unit 833 is in contact with the collection unit 836, and wipes the waste ink HI collected by the collection unit 836. Therefore, the waste ink HI (an accumulated material generated by drying the waste ink HI) received by the waste liquid receiving unit 835 is collected by the collection unit 836 the waste ink HI collected by the collection unit 836 can be wiped by the wiping unit 833 and collected. Accordingly, since the waste ink HI collected by the collection unit 836 can be suppressed from being contacted with the other member (supporting stand 712 or medium ST), the contamination due to the waste ink HI can be suppressed.

(8) In the liquid ejecting apparatus 7, the wiping unit 833 wipes the collection unit 836 after wiping the liquid ejecting unit 1. Therefore, the waste ink HI collected by the collection unit 836 can be suppressed from being attached to the liquid ejecting unit 1.

(9) The waste liquid receiving unit 835 in the liquid ejecting apparatus 7 disposed at further downstream side than the wiping unit 833 in the wiping direction (same as the transport direction Y) when the wiping unit 833 wipes the liquid ejecting unit 1. Therefore, since the ink is easily scattered toward the downstream side in the wiping direction when the wiping unit 833 wipes the liquid ejecting unit 1, the scattered ink can be easily collected by the waste liquid receiving unit 835. Additionally, after the liquid ejecting unit 1 performs flushing to the waste liquid receiving unit 835, the condition is good when the wiping unit 833 wipes the liquid ejecting unit 1.

(10) The liquid ejecting apparatus 7 includes the relative moving mechanism 857 which relatively moves the wiping unit 833 and the waste liquid receiving unit 835, and the liquid ejecting unit 1 and the collection unit 836 in the wiping direction where the wiping unit 833 wipes the liquid ejecting unit 1. Therefore, by the relative moving mechanism 857, the wiping unit 833 and the waste liquid receiving unit 835, and the liquid ejecting unit 1 and the collection unit 836 are relatively moved in the wiping direction.

(11) The liquid ejecting apparatus 7 includes the base portion 832 that holds the wiping unit 833 and the waste liquid receiving unit 835 and the relative moving mechanism 857 moves the base portion 832 to the liquid ejecting unit 1 and the collection unit 836. Accordingly, by the relative moving mechanism 857, the base portion 832, the wiping unit 833, and the waste liquid receiving unit 835 are moved to the liquid ejecting unit 1 and the collection unit 836.

(12) In the liquid ejecting apparatus 7, the relative moving mechanism 857 moves the wiping unit 833 to the liquid ejecting unit 1 to wipe the liquid ejecting unit 1, retreats the carriage 723 and the liquid ejecting unit 1 from the position facing the setting region SA by the driving the carriage motor 748, and wipes the collection unit 836 by causing the wiping unit 833 to contact with the collection unit 836 by the relative moving mechanism 857. Therefore, before the waste ink HI collected by the collection unit 836 is wiped by the wiping unit 833, since the liquid ejecting unit 1 is retreated from the position facing the setting region SA, in a case where the waste ink HI is scattered when wiping the collection unit 836 by the wiping unit 833, the liquid ejecting unit 1 can be suppressed from being contaminated due to attaching the scattered waste ink HI on the liquid ejecting unit 1.

Modification Examples

Each of the embodiments may be modified as follows. It is possible for each of the above embodiments and the following modification examples to be arbitrarily combined and used.

Figure 34:
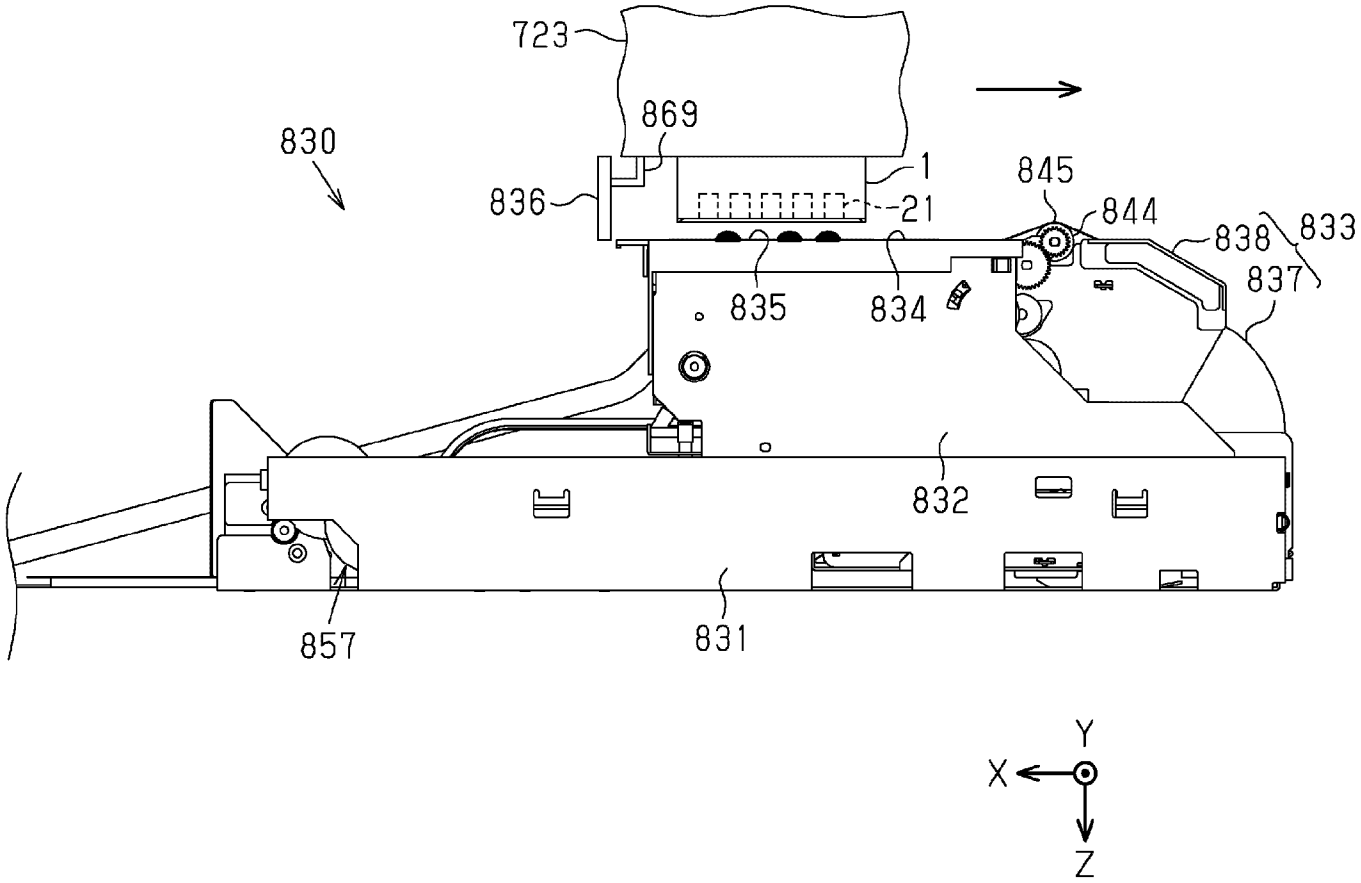
FIG. 34 is a schematic side view showing a main portion of the liquid ejecting apparatus of a modification example.

As shown in FIG. 34, the collection unit 836 is attached to the carriage 723 via the arm 869, the carriage 723 holds the liquid ejecting unit 1 and the collection unit 836, and the base 831 may be disposed so as to extend in the scanning direction X by changing the direction of the maintenance unit 830 by 90°. In a case where the maintenance of the liquid ejecting unit 1 is performed, by the driving the carriage motor 748, the carriage 723 is moved to the wiping unit 833 and the waste liquid receiving unit 835 so as to along the scanning direction X. In this case, the carriage 748 configures the relative moving mechanism. In this manner, by the driving of the carriage motor 748, the carriage 723, the liquid ejecting unit 1, and the collection unit 836 can be moved to the wiping unit 833 and the waste liquid receiving unit 835. When moving the carriage 723 if the maintenance of the liquid ejecting unit 1 is performed, the base portion 832 may be moved in a direction opposite to the carriage 723 in the scanning direction X.

The collection unit 836 may be configured to be displaceable along the power direction Z that is a direction where the liquid ejecting unit 1 ejects the ink (first liquid). In this manner, by displacing the collection unit 836, the amount of contact between the waste liquid receiving unit 835 and the recovering unit 836 and the amount of the contact between the wiping unit 833 and the collection unit 836 can be adjusted.

The shielding mechanism 855 may be configured to be moveable between the position for shielding the ejecting of the fluid RT toward the opening region KR of the liquid ejecting unit 1 and the position for shielding the ejecting of the fluid RT toward the non-opening region HKR of the liquid ejecting unit 1. In addition, the shielding mechanism 855 may be configured to be moveable to a position allowing ejecting of the fluid RT toward the opening region KR and the non-opening region HKR of the liquid ejecting unit 1. In a case where the liquid ejecting unit 1 moves, the position of the above-described shielding mechanism 855 may be changed by moving the liquid ejecting unit 1.

The size of gaps in the shielding plates 856 of the shielding mechanism 855 (the size of the shielding plates 856) may be changed according to the ink type of the nozzle row NL provided in the opening region KR of the corresponding liquid ejecting unit 1. In this manner, the attaching amount of the fluid RT (second liquid) in the opening region KR can be adjusted by the degree of solidification of the ink.

In a case where the liquid ejecting unit 1 moves in the scanning direction X, for example, the shielding mechanism 855 is configured by a plate material having an slit-like opening portion at only one location, and by moving the liquid ejecting unit 1, the fluid RT may be ejected in a state where the non-opening region HKR of the corresponding liquid ejecting unit 1 matches with the position of the plate material opening portion.

The shielding mechanism 855 may be configured to be displaceable such that the distance from the liquid ejecting unit 1 can be changed. In this manner, by changing the distance between the shielding mechanism 855 and the liquid ejecting unit 1, the shielding range of the fluid RT ejected from the ejecting port 851 can be changed.

The fluid ejecting unit 834 may change an angle θ of the ejecting direction of the fluid RT with respect to the opening region KR (lower surface of the liquid ejecting unit 1) to a range of $0° < \theta < 90°$.

The liquid repellency of the opening region KR in the liquid ejecting unit 1 may be substantially the same as the liquid repellency of the non-opening region HKR.

In consideration of exchangeability of the cloth sheet 837, the maintenance unit 830 may be disposed the wiping unit 833, the fluid ejecting unit 834, and the waste liquid receiving unit 835 in this order from the access side that is the front side of the printer main body 11*a*.

The collection unit 836 may be fixed to the base 831 of the maintenance unit 830 via, for example, a gate-shaped attachment member.

An elevating mechanism for elevating the collection unit 836 along the power direction Z may be provided in the liquid ejecting apparatus 7. In this case, it is preferable that the height of the collection unit 836 when wiping by the wiping unit 833 be set to the height higher than the height when the waste ink HI on the new body 848 of the waste liquid receiving unit 835 is scrapped off.

The elevating mechanism for elevating the waste liquid receiving unit 835 along the power direction Z may be provided in the maintenance unit 830. In this case, it is preferable that the height of the waste liquid receiving unit 835 when the waste ink HI on the net body 848 is scrapped off by the collection unit 836 be set to the height higher than the height when the flushing ink is received.

The cloth sheet 837 in the wiping unit 833 may perform the winding operation by the winding shaft 840 instead of the winding operation of the cloth sheet 837 at a predetermined amount between the wiping operation of the collection unit 836 and the wiping operation of the liquid ejecting unit 1 such that the position wiping the collection unit 836 is different from the position wiping the liquid ejecting unit 1. In this case, when the cloth sheet 837 wipes the collection unit 836, the position at which the liquid ejecting unit 1 is wiped may be left as it is before the collection unit 836 is wiped.

The liquid repellency of the opening region KR in the liquid ejecting unit 1 may be set to be lower than the liquid repellency of the non-opening region HKR.

The shielding mechanism 855 may be omitted. In this case, it is preferable that the ejecting port 851 be configured by the ejecting nozzle able to eject the fluid RT to the non-opening region HKR of the liquid ejecting unit 1.

The liquid ejecting apparatus 7 does not necessarily have to firstly wipe the non-opening region HKR in the liquid ejecting unit 1 by the wiping member 845 after the fluid ejecting is performed to the liquid ejecting unit 1 by the fluid ejecting unit 834.

The wiping member 845 of the wiping unit 833 does not necessarily have the absorbency. For example, the wiping unit 833 (wiping member 845) may be configured by a rubber blade or the like.

In the liquid ejecting apparatus 7, the wiping member 845 does not necessarily have to wipe the liquid ejecting unit 1 after the fluid ejecting is performed to the liquid ejecting unit 1 by the fluid ejecting unit 834.

When the wiping unit 833 wipes the recovering unit 836, the liquid ejecting apparatus 7 does not necessarily have to retreat the liquid ejecting unit 1 from the position facing the setting region SA.

The waste liquid receiving unit 835 in the liquid ejecting apparatus 7 is not necessarily disposed at further the downstream side than the wiping unit 833 in the wiping direction (same as the transport direction Y) when the wiping unit 833 wipes the liquid ejecting unit 1.

In the liquid ejecting apparatus 7, the wiping unit 833 does not necessarily have to wipe the collection unit 836 after wiping the liquid ejecting unit 1.

Figure 35:
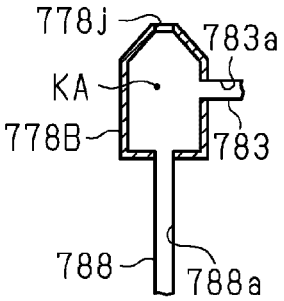
FIG. 35 is a schematic diagram of a fluid ejecting nozzle of the modification example.

As shown in FIG. 35, a so-called internal mixing-type fluid ejecting nozzle 778B having a mixing unit KA that generates the mixed fluid by mixing the second liquid supplied from the liquid flow channel 788*a* and air supplied from the gas flow channel 783*a* in the interior thereof may be used instead of the external mixing-type fluid ejecting nozzle 778. In this case the mixed fluid generated by the mixing unit KA is ejected from the ejection port 778*j* provided on the tip (upper end) of the fluid ejecting nozzle 778B.

The second liquid may be ejected to the liquid ejecting units 1A and 1B that include the nozzles 21 before performing ejection of the mixed fluid from the fluid ejecting nozzle 778 to the liquid ejecting units 1A and 1B that include the nozzles 21. In this case, although the ejection of the second liquid from the liquid ejecting nozzle 780 may use the liquid supply pump 793, it is preferable to separately provide a pump for causing the second liquid to be ejected from the liquid ejecting nozzle 780 to a position partway along the liquid supply pipe 788. In this way, since the second liquid is first ejected to the liquid ejecting units 1A and 1B that include the nozzles 21, and thereafter the mixed fluid is ejected while mixing air into the second liquid, it is possible to prevent only air from being ejected to the liquid ejecting units 1A and 1B that include the nozzles 21. Accordingly, it is possible to prevent air ejected to the liquid ejecting units 1A and 1B that include the nozzles 21 from entering into the interior of the liquid ejecting unit 1A and 1B from the opening of the nozzle 21. In this case, even in a case where the ejection of the mixed fluid to the liquid ejecting units 1A and 1B that include the nozzles 21 is stopped, it is possible to prevent only air from being ejected to the liquid ejecting units 1A and 1B that include the nozzles 21 by first stopping the ejection of air and thereafter stopping the ejection of the second liquid.

A pressure pump for supplying ink in the ink tank (not shown) to the storage portion 730 may be provided, and pressurizing of the ink in the pressure generating chamber 12 that communicates with the clogged nozzle 21 during the fluid ejection from the fluid ejecting nozzle 778 to clogged nozzle 21 may be performed by the pressure pump in a state where the differential pressure valve 731 is opened.

The second liquid may be ejected to region not including the nozzles 21 of the liquid ejecting units 1A and 1B before performing ejection of the mixed fluid from the fluid ejecting nozzle 778 to the liquid ejecting units 1A and 1B that include the nozzles 21. The fluid ejecting nozzles 778 may eject the second liquid may at a position not facing the liquid ejecting units 1A and 1B before performing ejection of the mixed fluid from the fluid ejecting nozzle 778 to the liquid ejecting units 1A and 1B that include the nozzles 21. Even in doing so, it is possible to suppress the ejection of only air to the liquid ejecting units 1A and 1B that include the nozzles 21.

The second liquid may be configured by pure water (pure water not including the preservative) only. In doing so, it is possible to prevent the second liquid exerting an adverse influence on the ink in a case where the second liquid mixing into the ink in the nozzle 21.

In a case of ejecting the mixed fluid to the clogged nozzle 21, the actuator 130 corresponding to the clogged nozzle 21 may be driven in the same manner as during discharging of the ink during printing or during flushing. Even in doing so, it is possible to prevent the mixed fluid from entering into the clogged nozzle 21.

In a case of ejecting the mixed fluid to the clogged nozzle 21, the pressure generating chambers 12 corresponding to nozzles 21 other than the clogged nozzle 21 may be pressurized while driving the actuator 130 corresponding to the nozzle 21 other than the clogged nozzle 21, respectively. In this way, it is possible to prevent the mixed fluid from entering into nozzles 21 other than the clogged nozzle 21.

The fluid ejecting device 775 may be arranged in the non-printing region RA.

A wiping member that wipes the liquid ejecting surfaces 20*a* of the liquid ejecting units 1A and 1B may be separately provided between the fluid ejecting device 775 in the non-printing region LA and the printing region PA. In this way, after the ejection of the mixed fluid to the liquid ejecting units 1A and 1B by the fluid ejecting device 775 and before the printing unit 720 is moved to the home position HP side by crossing the printing region PA, it is possible to wipe the liquid ejecting surface 20*a* wet with the mixed fluid (second liquid) with the wiper. Accordingly, it is possible to suppress trickling of the mixed fluid (second liquid) attached to the liquid ejecting surface 20*a* during movement of the printing unit 720 in the printing region PA.

An air compressor installed in a factor or the like may be used instead of the air pump 782. In this case, a three-way electromagnetic valve able to open the gas flow channel 783*a* to the atmosphere may be provided at a position between the pressure regulating valve 784 and the air filter 785 in the gas supply pipe 783, and the gas flow channel 783*a* may be opened to the atmosphere when the fluid ejecting device 775 is unused.

In a case where a nozzle 21 in which clogging is not resolved even when the controller 810 performs suction cleaning a predetermined number of times based on a clogging detection history, so-called complementary printing in which printing is performed while ejecting ink instead with another normal nozzle 21, without using the nozzle 21 in which clogging is not resolved may be temporarily performed. In this case, clogging may be resolved by cleaning the nozzle 21 in which clogging is not resolved with the fluid ejecting device 775 even when suction cleaning is performed a predetermined number of times after complementary printing.

The nozzle row NL (nozzle 21) that ejects the color (type) of ink with an extremely low usage frequency may resolve clogging while cleaning with the fluid ejecting device 775 when the usage time arrives without performing the usual maintenance (suction cleaning, flushing, and wiping or the like). In this way, since the consumption amount of color (type) ink with an extremely low usage frequency in the suction cleaning or flushing is reduced, it is possible to conserve ink.

During ejection of the mixed fluid from the fluid ejecting nozzle 778 to the clogged nozzle 21, the pressure generating chamber 12 that communicates with the clogged nozzle 21 is not necessarily pressurized.

It is not necessary that the product of the mass of the second liquid that is smaller than the opening of the nozzle 21 and the square of the flight speed at the opening position of the nozzle 21 of the droplets is not necessarily larger than the product of the mass of the ink droplets ejected from the opening of the nozzle 21 and the square of the flight speed of the ink droplets.

The liquid that the liquid ejecting unit ejects is not limited to ink and may be a liquid or the like in which particles of a functional material are dispersed or mixed. For example, a configuration may be used that performs recording while ejecting a liquid body including an electrode material or coloring material (pixel material) or the like in a dispersed or dissolved form used in the manufacturing or the like of a liquid crystal display, EL (electroluminescence) display, and a surface emitting display.

The medium ST is not limited to a sheet, and may be a plastic film, a thin plate material, or the like, or may be a fabric used in textile printing or the like.

Next, the ink (colored ink) as the first liquid will be described in detail below.

The ink used in the liquid ejecting apparatus 7 contains a resin with the above constitution and does not substantially contain glycerin with a boiling point at one atmosphere of 290° C. When the ink substantially includes glycerin, the drying properties of the ink significantly decrease. As a result, in various media, in particular a medium that is non-absorbent or has low absorbency to ink, not only are light and dark unevennesses in the image noticeable, but the fixing properties of the ink are also not obtained. It is preferable that the ink does not substantially include an alkyl polyol (except the above glycerin) with a boiling point corresponding to one atmosphere is 280° C. or higher.

Here, the wording "does not substantially include" in the specification signifies a not containing an amount or more that sufficiently exhibits the meaning of adding. To put this quantitatively, it is preferable that glycerin is not included at 1.0 mass % or higher with respect to the total mass (100 mass %) of the ink, not including 0.5 mass % or higher is more preferable, not including 0.1 mass % or higher is still more preferable, not including 0.05 mass % or higher is even more preferable, and not including 0.01 mass % or higher is particularly preferable. It is most preferable that 0.001 mass % or more of glycerin is not included.

Next, additives (components) included in or that can be included in the ink will be described.

1. Coloring Material

The ink may contain a coloring material. The coloring material is selected from a pigment and a dye.

1-1. Pigment

It is possible for the light resistance of the ink to be improved by using a pigment as the coloring material. It is possible to use either of an inorganic pigment or an organic pigment for the pigment. Although not particularly limited, examples of the inorganic pigment include carbon black, iron oxide, titanium oxide and silica oxide.

Although not particularly limited, examples of the organic pigment include quinacridone-based pigments, quinacridonequinone-based pigments, dioxazine-based pigments, phthalocyanine-based pigments, anthrapyrimidine-based pigments, anthanthrone-based pigments, indanthrone-based pigments, flavanthrone-based pigments, perylene-based pigments, diketo-pyrrolo-pyrrole-based pigments, perinone-based pigments, quinophthalone-based pigments, anthraquinone-based pigments, thioindigo-based pigments, benzimidazolone-based pigments, isoindolinone-based pigments, azomethine-based pigments and azo-based pigments. Specific examples of the organic pigment include those below.

Examples of the pigment used in the cyan ink include C.I. Pigment Blue 1, 2, 3, 15, 15:1, 15:2, 15:3, 15:4, 15:6, 15:34, 16, 18, 22, 60, 65, and 66, and C.I. Vat Blue 4 and 60. Among these, either of C.I. Pigment Blue 15:3 and 15:4 is preferable.

Examples of the pigment used in the magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, and C.I. Pigment Violet 19, 23, 32, 33, 36, 38, 43, and 50. Among these, at least one type selected from a group consisting of C.I. Pigment Red 122, C.I. Pigment Red 202, and C.I. Pigment Violet 19 is preferable.

Examples of the pigment used in the yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among these, at least one type selected from a group consisting of C.I. Pigment Yellow 74, 155, and 213 is preferable.

Examples of pigments used in other colors of ink, such as green ink and orange ink, include pigments known in the related art.

It is preferable that the average particle diameter of the pigment is 250 nm or less in order to be able to suppress clogging in the nozzle 21 and for the discharge stability to be more favorable. The average particle diameter in the specification is volumetric based. As the measurement method, it is possible to perform measurement with a particle size distribution analyzer in which a laser diffraction scattering method is the measurement principle. Examples of the particle size distribution analyzer include a particle size distribution meter (for example, Microtrac UPA manufactured by Nikkiso Co., Ltd.) in which dynamic light scattering is the measurement principle.

1-2. Dye

It is possible for a pigment to be used as the coloring material. Although not particularly limited, acid dyes, direct dyes, reactive dyes, and basic dyes can be used as the dye. It is preferable that the content of the coloring material is 0.4 to 12 mass % to the total mass (100 mass %) of the ink, and 2 mass % or more to 5 mass % or less is more preferable.

2. Resin

The ink contains a resin. Through the ink containing a resin, a resin film is formed on the medium, the ink is sufficiently fixed on the medium as an effect, and an effect of favorable abrasion resistance of the image is mainly exhibited. Therefore, it is preferable that the resin emulsion is a thermoplastic resin. It is preferable that the thermal deformation temperature of the resin is 40° C. or higher in order for advantageous effects such as clogging of the nozzle 21 not easily occurring, and maintaining the abrasion resistance of the medium to be obtained, and 60° C. or higher is more preferable.

Here, the wording "thermal deformation temperature" in the specification is the temperature value represented by the glass-transition temperature (Tg) or the minimum film forming temperature (MFT). That is, the wording "a thermal deformation temperature of 40° C. or higher" signifies that either of the Tg or the MFT may be 40° C. or higher. Because it is easily ascertained that the MFT is superior to the Tg for redispersibility of the resin, it is preferable that the thermal deformation temperature is the temperature value represented by the MFT. When the ink is superior in redispersibility of the resin, the nozzle 21 is not easily clogged because the ink is not fixed.

Although not particularly limited, examples of the thermoplastic resin include (meth)acrylic polymers, such as poly(meth)acrylic ester or copolymers thereof, polyacrylonitrile or copolymers thereof, polycyanoacrylate, polyacrylamide, and poly(meth)acrylic acid, polyolefin-based polymers, such as polyethylene, polypropylene, polybutene, polyisobutylene, polystyrene and copolymers thereof, petroleum resins, coumarone-indene resins and terpene resins; vinyl acetate or vinyl alcohol polymers, such as polyvinyl acetate or copolymers thereof, polyvinyl alcohol, polyvinyl acetal, and polyvinyl ether; halogen-containing polymers, such as polyvinyl chloride or copolymers thereof, polyvinylidene chloride, fluororesins and fluororubbers; nitrogen-containing vinyl polymers, such as polyvinyl carbazole, polyvinylpyrrolidone or copolymers thereof, polyvinylpyridine, or polyvinylimidazole; diene based polymers, such as polybutadiene or copolymers thereof, polychloroprene and polyisoprene (butyl rubber); and other ring-opening polymerization type resins, condensation polymerization-type resins and natural macromolecular resins.

It is preferable that the content of the resin is 1 to 30 mass % with respect to the total mass (100 mass %) of the ink, and 1 to 5 mass % is more preferable. In a case where the content is in the above-described range, it is possible for the glossiness and the abrasion resistance of the coated image formed to be significantly superior. Examples of the resin that may be included in the ink include a resin dispersant, a resin emulsion and a wax.

2-1. Resin Emulsion

The ink may include a resin emulsion. The resin emulsion exhibits an effect of favorable abrasion resistance of the image with the ink being sufficiently fixed on the medium preferably by forming a resin coating film along with a wax (emulsion) when the medium is heated. In a case of printing the medium with an ink that contains a resin emulsion according to the above effects, the ink has particularly superior abrasion resistance on a medium that is non-absorbent or has low absorbency to ink.

The resin emulsion that functions as a binder is contained in an emulsion state in the ink. By containing a resin that functions as a binder in the ink in an emulsion state, it is possible to easily adjust the viscosity of the ink to an appropriate range in an ink jet recording method, and to increase the storage stability and discharge stability of the ink.

Although not limited to the following, examples of the resin emulsion include simple polymers or copolymers of (meth)acrylate, (meth)acrylic ester, acrylonitrile, cyanoacrylate, acrylamide, olefin, styrene, vinyl acetate, vinyl chloride, vinyl alcohol, vinyl ethyl, vinyl pyrrolidone, vinyl pyridine, vinyl carbazole, vinyl imidazole, and vinylidene chloride, fluororesins, and natural resins. Among these, either of a methacrylic resin and a styrene-methacrylate copolymer resin is preferable, either of an acrylic resin and a styrene-acrylate copolymer resin is more preferable, and a styrene-acrylate copolymer resin is still more preferable. The above copolymers may have the form of any of random copolymers, block copolymers, alternating copolymers, and graft copolymers.

It is preferable that the average particle diameter of the resin emulsion is in a range of 5 nm to 400 nm, and more preferably in a range 20 nm to 300 nm in order to significantly improve the storage stability and recording stability of the ink. It is preferable that the content of resin emulsion among the resins is in a range of 0.5 to 7 mass % to the total mass (100 mass %) of the ink. When the content is in the above range, it is possible for the discharge stability to be further improved because the solid content concentration is lowered.

2-2. Wax

The ink may include a wax. Through the ink including a wax, the fixability of the ink on a medium that is non-absorbent or with low absorbency to ink is still superior. Among these, it is preferable that the wax is an emulsion type. Although not limited to the following, examples of the wax include a polyethylene wax, a paraffin wax, and a polyolefin wax, and among these, a polyethylene wax, described later, is preferable. In the specification, the wording "wax" mainly signifies solid wax particles dispersed in water using a surfactant, described later.

Through the ink including a polyethylene wax, it is possible to make the abrasion resistance of the ink superior. It is preferable that the average particle diameter of polyethylene wax is in a range of 5 nm to 400 nm, and more preferably in a range 50 nm to 200 nm in order to significantly improve the storage stability and recording stability of the ink.

It is preferable that the content (solid content conversion) of the polyethylene wax is independently of one another is in a range of 0.1 to 3 mass % to the total content (100 mass %) of the ink, a range of 0.3 to 3 mass % is more preferable, and a range of 0.3 to 1.5 mass % is still more preferable. When the content is within the above ranges, it is possible for the ink to be favorable solidified and fixed even on a medium that is non-absorbent or with low absorbency to ink, and it is possible for the storage stability and discharge stability of the ink to be significantly improved.

3. Surfactant

The ink may include a surfactant. Although not limited to the following, examples of the surfactant include a nonionic surfactants. The nonionic surfactant has an action of evenly spreading the ink on the medium. Therefore, when printing is performed using an ink including the nonionic surfactant, a high definition image with very little bleeding may be obtained. Although not limited to the following, examples of such a nonionic surfactant include silicon-based, polyoxyethylene alkylether-based, polyoxypropylene alkylether-based, polycyclic phenyl ether-based, sorbitan derivative and fluorine-based surfactants, and among these a silicon-based surfactant is preferable.

It is preferable that the content of the surfactant is 0.1 mass % or more to 3 mass % or less to the total content (100 mass %) of the ink in order for the storage stability and discharge stability of the ink to be significantly improved.

4. Organic Solvent

The ink may include a known volatile water-soluble organic solvent. Here, as described above, it is preferable that the ink does not substantially include glycerin (boiling point at 1 atmosphere of 290° C.) that is one type of organic solvent, and does not substantially include an alkyl polyol (excluding glycerin) with a boiling point corresponding to one atmosphere of 280° C. or higher.

5. Aprotic Polar Solvent

The ink may contain an aprotic polar solvent. By containing an aprotic polar solvent in the ink, it is possible to effectively suppress clogging of the nozzles 21 when printing because the above-described resin particles included in the ink are dissolved. Since a material by which the medium, such as vinyl chloride, is melted is present, the adhesiveness of the image is improved.

Although not particularly limited, the aprotic polar solvent preferably includes at least one type selected from pyrrolidones, lactones, sulfoxides, imidazolidinones, sulfolanes, urea derivatives, dialkylamides, cyclic ethers, and amide ethers. Representative examples of the pyrrolidone include 2-pyrrolidone, N-methyl-2-pyrrolidone, and N-ethyl-2-pyrrolidone, representative examples of the lactone include γ-butyrolactone, γ-valerolactone, and ϵ-caprolactone, and representative examples of the sulfoxide include dimethyl sulfoxide, and tetramethylene sufloxide.

Representative examples of the imidazolidinone include 1,3-dimethyl-2-imidazolidinone, representative examples of the sulfolane include sulfolane, and dimethyl sulfolane, and representative examples of the urea derivative include dimethyl urea and 1,1,3,3-tetramethyl urea. Representative examples of the dialkylamide include dimethyl formamide and dimethylacetamide, and representative examples of the cyclic ether include 1,4-dioxsane, and tetrahydrofuran.

Among these, pyrrolidones, lactones, sulfoxides and amide ethers, are particularly preferable from the viewpoint of the above-described effects, and 2-pyrrolidone is the most preferable. The content of the above-described aprotic polar solvent is preferably in a range of 3 to 30 mass % with respect to the total mass (100 mass %) of the ink, and a range of 8 to 20 mass % is more preferable.

6. Other Components

The ink may further include a fungicide, an antirust agent, and a chelating agent in addition to the above components.

Next, the components of the surfactant mixed into the second liquid will be described.

Although It is possible to use cationic surfactants such as alkylamine salts and quaternary ammonium salts; anionic surfactant such as dialkyl sulfosuccinate salts, alkylnaphthalenesulfonic acid salts and fatty acid salts; amphoteric surfactants, such as alkyl dimethyl amine oxide, and alkylcarboxybetaine; nonionic surfactants such as polyoxyethylene alkyl ethers, polyoxyethylene alkyl allyl ethers, acetylene glycols, and polyoxyethylene-polyoxypropylene block copolymers as the surfactant, among these, anionic surfactants or nonionic surfactants are preferable.

The content of the surfactant is preferably from 0.1 to 5.0 mass % with respect to the total mass of the second liquid. It is preferable that the content of the surfactant is 0.5 to 1.5 mass % to the total content of the second liquid, from the viewpoint of foamability and defoaming after forming air bubbles. The surfactant may be either used singly or as a combination of two or more. It is preferable that the surfactant included in the second liquid is the same as the surfactant included in the ink (first liquid), and, for example, although not limited to the following, preferable examples of nonionic surfactants in a case where the surfactant included in the ink (first liquid) is a nonionic surfactant include silicon-based, polyoxy ethylene alkylether-based, polyoxy propylene alkyl ether-based, polycyclic phenyl ether-based, sorbitan derivatives, and fluorine-based surfactants, and among these, silicon-based surfactants are preferable.

In particular, it is preferable that an adduct in which 4 to 30 added mols of ethyleneoxide (EO) are added to acetylene diol is used as the surfactant, and preferable that the content of the adduct is 0.1 to 3.0 wt % to the total weight of the cleaning solution in order that the height of the foam directly before foaming using the Ross Miles method and five minutes after foaming is made to be within the above range (foam height directly before foaming is 50 mm or higher, and foam height five minutes after foaming is 5 mm or lower). It is preferable that an adduct in which 10 to 20 added mols of ethyleneoxide (EO) are added to acetylene diol is used as the surfactant, and preferable that the content of the adduct is 0.5 to 1.5 wt % to the total weight of the cleaning solution in order that the height of the foam directly before foaming using the Ross Miles method and five minutes after foaming is made to be within the above range (foam height directly before foaming is 100 mm or higher, and foam height five minutes after foaming is 5 mm or lower). However, when the content of the ethyleneoxide adduct of acetylene diol is excessively high, there is concern of reaching the critical micelle concentration and not forming an emulsion.

The surfactant has the function of easing the wetting and spreading of the aqueous ink on the recording medium. The surfactants able to be used in the invention are not particularly limited, and examples thereof include anionic surfactants, such as dialkyl sulfosuccinate salts, alkyl naphthalene sulfosuccinate salts, fatty acid salts; nonionic surfactants, such as polyoxyethylene alkyl ethers, polyoxyethylene alkyl allyl ethers, acetylene glycols, and polyoxyethylene-polyoxypropylene block copolymers; cationic surfactants, such as alkyl amine salts and quaternary ammonium salts; silicone-based surfactants, and fluorine-based surfactants.

The surfactant has an effect of causing aggregations to be divided and dispersed due to the surface activity effect between the cleaning solution (second liquid) and the aggregation. Because of the ability to lower the surface tension of the cleaning solution, the cleaning solution easily infiltrates between the aggregation and the liquid ejecting surface 20*a*, and has an effect of making the aggregation easier to peel from the liquid ejecting surface 20*a*.

As long as the compound has a hydrophilic portion and a hydrophobic portion in the same molecule, it is possible to suitably use any surfactant. Specific examples thereof preferably include the compounds represented by the following formulae (I) to (IV). That is, examples include the polyoxyethylene alkyl phenyl ether-based surfactant in the following formula (I), the acetylene glycol-based surfactant in formula (II), the polyoxyehtylenealkyl ether-based surfactants in the following formula (III), and the polyoxyethylene polyoxypropylenealkyl ether-based surfactants in formula (IV).

(I)

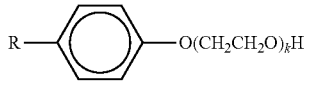

(R is an optionally branched (C6-C14) hydrocarbon chain, and k: 5 to 20)

(II)

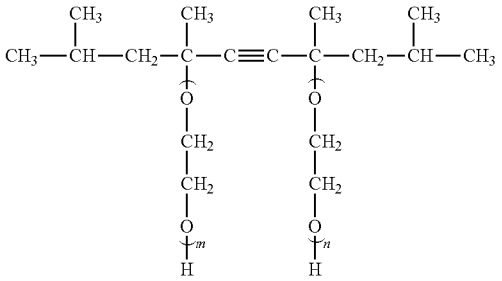

(m and n≤20, 0<m+n≤40)

$$R—(OCH_2CH_2)nH \quad (III)$$

(R is an optionally branched (C6-C14) hydrocarbon chain, and n is 5 to 20)

(IV)

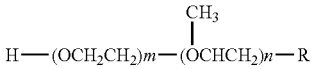

(R is a (C6-C14) hydrocarbon chain, and m and n are numerals of 20 or lower)

Although it is possible to use alkyl and aryl ethers of polyhydric alcohols, such as diethylene glycol monophenyl ether, ethylene glycol monophenyl ether, ethylene glycol monoallyl ether, diethylene glycol monophenyl ether, diethylene glycol mono-butyl ether, propylene glycol mono-butyl ether, and tetraethylene glycol chlorophenyl ether, nonionic surfactants such as polyoxyethylene polyoxypropylene block copolymers, fluorine-based surfactants, and lower alcohols such as ethanol, 2-propanol as a compound other than the compounds in formulae (I) to (IV), diethylene glycol monobutyl ether is particularly preferable.

The entire disclosure of Japanese Patent Application No. 2016-044123, filed Mar. 8, 2016 is expressly incorporated by reference herein.

What is claimed is:

1. A liquid ejecting apparatus comprising:

a liquid ejecting unit having nozzles able to eject a liquid to a medium;

a wiping unit able to wipe the liquid ejecting unit;

a waste liquid receiving unit that receives a waste liquid that is discharged by a maintenance operation for maintaining the liquid ejecting unit, at a position facing the liquid ejecting unit; and a collection unit that comes in contact with the waste liquid receiving unit to collect the waste liquid that is received by the waste receiving unit, wherein the wiping unit comes in contact with the collection unit to wipe the waste liquid that is collected by the collection unit.

2. The liquid ejecting apparatus according to claim 1, wherein the wiping unit comes in contact with the collection unit after wiping the liquid ejecting unit.

3. The liquid ejecting apparatus according to claim 1, wherein the waste liquid receiving unit is disposed further to the downstream side than the wiping unit in a wiping direction when the wiping unit wipes the liquid ejecting unit.

4. The liquid ejecting apparatus according to claim 3, further comprising:

a relative moving mechanism that relatively moves the wiping unit and the waste liquid receiving unit, and the liquid ejecting unit and the collection unit in the wiping direction where the wiping unit wipes the liquid ejecting unit.

5. The liquid ejecting apparatus according to claim 4, further comprising:

a base portion that holds the wiping unit and the waste liquid receiving unit, wherein the relative moving mechanism moves the base portion to the liquid ejecting unit and the collection unit.

6. The liquid ejecting apparatus according to claim 4, further comprising:

a carriage that holds the liquid ejecting unit and the collection unit, wherein the relative moving mechanism moves the carriage to the wiping unit and the waste liquid receiving unit.

7. The liquid ejecting apparatus according to claim 5, further comprising:

a moving mechanism that moves the liquid ejecting unit in a direction orthogonal to both directions of the movement direction where by the relative moving mechanism moves the base portion and a direction where the liquid ejecting unit ejects the liquid, wherein the moving mechanism moves the liquid ejecting unit to a position capable of facing the waste liquid receiving unit and the wiping unit, wherein the liquid is ejected to the waste liquid receiving unit from the nozzle in a state where the liquid ejecting unit faces the waste liquid receiving unit, wherein the relative moving mechanism relatively moves the wiping unit to the liquid ejecting unit to wipe the liquid ejecting unit, wherein the liquid ejecting unit is retreated by the moving mechanism from a position facing a region where the base portion moves, and wherein the wiping unit comes in contact with the collection unit by the relative moving mechanism.

8. The liquid ejecting apparatus according to claim 1, wherein the collection unit is displaceable in a direction where the liquid ejecting unit ejects the liquid.

* * * * *